US011519093B2

(12) United States Patent
Lomasney et al.

(10) Patent No.: US 11,519,093 B2
(45) Date of Patent: Dec. 6, 2022

(54) APPARATUSES, SYSTEMS, AND METHODS FOR PRODUCING A PLURALITY OF ARTICLES WITH NANOLAMINATED COATINGS USING ROTATION

(71) Applicant: MODUMETAL, Inc., Seattle, WA (US)

(72) Inventors: Christina A. Lomasney, Seattle, WA (US); Guohua Li, Bothell, WA (US); Nicholas Angelo, Buckley, WA (US)

(73) Assignee: MODUMETAL, INC., Snohomish, WA (US)

( * ) Notice: Subject to any disclaimer, the term of this patent is extended or adjusted under 35 U.S.C. 154(b) by 0 days.

(21) Appl. No.: 17/050,395

(22) PCT Filed: Apr. 26, 2019

(86) PCT No.: PCT/US2019/029484

§ 371 (c)(1),
(2) Date: Oct. 23, 2020

(87) PCT Pub. No.: WO2019/210264

PCT Pub. Date: Oct. 31, 2019

(65) Prior Publication Data

US 2021/0054522 A1 Feb. 25, 2021

Related U.S. Application Data

(60) Provisional application No. 62/689,038, filed on Jun. 22, 2018, provisional application No. 62/664,042, filed on Apr. 27, 2018.

(51) Int. Cl.

| | |
|---|---|
| ***C25D 17/08*** | (2006.01) |
| ***C25D 5/56*** | (2006.01) |
| ***C25D 7/04*** | (2006.01) |
| ***C25D 17/12*** | (2006.01) |

(52) U.S. Cl.

CPC ..... *C25D 17/08* (2013.01); *C25D 5/56* (2013.01); *C25D 7/04* (2013.01); *C25D 17/12* (2013.01)

(58) Field of Classification Search

None

See application file for complete search history.

(56) References Cited

U.S. PATENT DOCUMENTS

| | | | |
|---|---|---|---|
| 1,733,404 | A | 10/1929 | Fahrenwald |
| 1,982,009 | A | 11/1934 | McKinney et al. |
| 2,428,033 | A | 9/1947 | Nachtman |

(Continued)

FOREIGN PATENT DOCUMENTS

| | | | |
|---|---|---|---|
| CN | 1236024 | A | 11/1999 |
| CN | 1380446 | A | 11/2002 |

(Continued)

OTHER PUBLICATIONS

U.S. Appl. No. 17/179,351, filed Feb. 18, 2021.

(Continued)

*Primary Examiner* — Louis J Rufo

(74) *Attorney, Agent, or Firm* — Seed IP Law Group LLP

(57) ABSTRACT

Provided herein are apparatuses, systems, and methods for the electrodeposition of nano- or microlaminate coatings, which have improved heat, wear, and corrosion resistance, on a plurality of workpieces.

19 Claims, 28 Drawing Sheets

(56) References Cited

U.S. PATENT DOCUMENTS 2,436,316 A 2/1948 Lum et al.
2,470,775 A 5/1949 Jemstedt et al.
2,558,090 A 6/1951 Jemstedt
2,642,654 A 6/1953 Ahrens
2,678,909 A 5/1954 Jemstedt et al.
2,694,743 A 11/1954 Ruskin et al.
2,706,170 A 4/1955 Marchese
2,891,309 A 6/1959 Fenster
3,090,733 A 5/1963 Brown
3,255,781 A 6/1966 Gillespie, Jr.
3,282,810 A 11/1966 Odekerken
3,359,469 A 12/1967 Levy et al.
3,362,851 A 1/1968 Dunster
3,483,113 A 12/1969 Carter
3,549,505 A 12/1970 Hanusa
3,616,286 A 10/1971 Aylward et al.
3,633,520 A 1/1972 Stiglich, Jr.
3,673,073 A 6/1972 Tobey et al.
3,716,464 A 2/1973 Kovac et al.
3,753,664 A 8/1973 Klingenmaier et al.
3,759,799 A 9/1973 Reinke
3,787,244 A 1/1974 Schulmeister et al.
3,866,289 A 2/1975 Brown et al.
3,941,674 A * 3/1976 Vanmunster ..... C25D 7/04 204/297.08
3,994,694 A 11/1976 Clauss et al.
3,996,114 A 12/1976 Ehrsam
4,053,371 A 10/1977 Towsley
4,105,526 A 8/1978 Lewellen, Jr. et al.
4,107,003 A 8/1978 Anselrode
4,125,447 A 11/1978 Bachert
4,191,617 A 3/1980 Hurley et al.
4,204,918 A 5/1980 McIntyre et al.
4,216,272 A 8/1980 Clauss
4,246,057 A 1/1981 Janowski et al.
4,269,672 A 5/1981 Inoue
4,284,688 A 8/1981 Stücheli et al.
4,314,893 A 2/1982 Clauss
4,405,427 A 9/1983 Byrd
4,422,907 A 12/1983 Birkmaier et al.
4,461,680 A 7/1984 Lashmore
4,464,232 A 8/1984 Wakano et al.
4,510,209 A 4/1985 Hada et al.
4,519,878 A 5/1985 Hara et al.
4,529,492 A 7/1985 Buchholz et al.
4,540,472 A 9/1985 Johnson et al.
4,543,300 A 9/1985 Hara et al.
4,543,803 A 10/1985 Keyasko
4,591,418 A 5/1986 Snyder
4,592,808 A 6/1986 Doubt
4,597,836 A 7/1986 Schaer et al.
4,613,388 A 9/1986 Walter et al.
4,620,661 A 11/1986 Slatterly
4,652,348 A 3/1987 Yahalom et al.
4,666,567 A 5/1987 Loch
4,670,356 A 6/1987 Sato et al.
4,678,552 A 7/1987 Chen
4,678,721 A 7/1987 den Broeder et al.
4,702,802 A 10/1987 Umino et al.
H543 H 11/1988 Chen et al.
4,795,735 A 1/1989 Liu et al.
4,834,845 A 5/1989 Muko et al.
4,839,214 A 6/1989 Oda et al.
4,869,971 A 9/1989 Nee et al.
4,885,215 A 12/1989 Yoshioka et al.
4,904,542 A 2/1990 Mroczkowski
4,904,543 A 2/1990 Sakakima et al.
4,909,917 A 3/1990 Harrison et al.
4,923,574 A 5/1990 Cohen
4,975,337 A 12/1990 Hyner et al.
5,043,230 A 8/1991 Jagannathan et al.
5,045,356 A 9/1991 Uemura et al.
5,056,936 A 10/1991 Mahrus et al.
5,059,493 A 10/1991 Takahata
5,073,237 A 12/1991 Bacher et al.
5,079,039 A 1/1992 Heraud et al.
5,096,564 A 3/1992 Jowitt et al.
5,156,729 A 10/1992 Mahrus et al.
5,156,899 A 10/1992 Kistrup et al.
5,158,653 A 10/1992 Lashmore et al.
5,190,637 A 3/1993 Guckel
5,228,967 A 7/1993 Crites et al.
5,234,562 A * 8/1993 Uenishi ..... B65C 3/10 118/500
5,268,235 A 12/1993 Lashmore et al.
5,300,165 A 4/1994 Sugikawa
5,320,719 A 6/1994 Lasbmore et al.
5,326,454 A 7/1994 Engelhaupt
5,352,266 A 10/1994 Erb et al.
5,364,523 A 11/1994 Tanaka et al.
5,378,583 A 1/1995 Guckel et al.
5,413,874 A 5/1995 Moy, III et al.
5,431,800 A 7/1995 Kirchhoff et al.
5,461,769 A 10/1995 McGregor
5,472,795 A 12/1995 Atita
5,489,488 A 2/1996 Asai et al.
5,500,600 A 3/1996 Moyes
5,547,096 A 4/1996 Kleyn
5,527,445 A 6/1996 Palumbo
5,545,435 A 8/1996 Steffier
5,620,800 A 4/1997 De Leeuw et al.
5,660,704 A 8/1997 Murase
5,679,232 A 10/1997 Fedor et al.
5,738,951 A 4/1998 Goujard et al.
5,742,471 A 4/1998 Barbee, Jr. et al.
5,775,402 A 7/1998 Sachs et al.
5,783,259 A 7/1998 McDonald
5,798,033 A 8/1998 Uemiya et al.
5,800,930 A 9/1998 Chen et al.
5,828,526 A 10/1998 Kagawa et al.
5,912,069 A 6/1999 Yializis et al.
5,930,085 A 7/1999 Kitade et al.
5,942,096 A 8/1999 Ruzicka et al.
5,952,111 A 9/1999 Sugg et al.
5,958,604 A 9/1999 Riabkov et al.
6,036,832 A 3/2000 Knol et al.
6,036,833 A 3/2000 Tang et al.
6,071,398 A 6/2000 Martin et al.
6,143,424 A 11/2000 Jonte et al.
6,143,430 A 11/2000 Miyasaka et al.
6,193,858 B1 2/2001 Hradil et al.
6,200,452 B1 3/2001 Angelini
6,203,936 B1 3/2001 Cisar et al.
6,212,078 B1 4/2001 Hunt et al.
6,214,473 B1 4/2001 Hunt et al.
6,284,357 B1 9/2001 Lackey et al.
6,312,579 B1 11/2001 Bank et al.
6,344,123 B1 2/2002 Bhatnagar
6,355,153 B1 3/2002 Uzoh et al.
6,398,937 B1 6/2002 Menini et al.
6,409,907 B1 6/2002 Braun et al.
6,415,942 B1 7/2002 Fenton et al.
6,461,678 B1 10/2002 Chen et al.
6,466,417 B1 10/2002 Gill
6,468,672 B1 10/2002 Donovan, III et al.
6,482,298 B1 11/2002 Bhatnagar
6,537,683 B1 3/2003 Staschko et al.
6,547,944 B2 4/2003 Schreiber et al.
6,592,739 B1 7/2003 Sonoda et al.
6,725,916 B2 4/2004 Gray et al.
6,739,028 B2 5/2004 Sievenpiper et al.
6,777,831 B2 8/2004 Gutierrez, Jr. et al.
6,800,121 B2 10/2004 Shahin
6,884,499 B2 4/2005 Penich et al.
6,902,827 B2 6/2005 Kelly et al.
6,908,667 B2 6/2005 Christ et al.
6,923,898 B2 8/2005 Yoshimura et al.
6,979,490 B2 12/2005 Steffier
7,285,202 B2 10/2007 Rumpf
7,581,933 B2 9/2009 Bruce et al.
7,632,590 B2 12/2009 Punsalan et al.
7,736,753 B2 6/2010 Deligianni et al.
8,084,564 B2 12/2011 Kano et al.
8,128,752 B2 3/2012 Kim

(56) References Cited

U.S. PATENT DOCUMENTS

| | | | |
|---|---|---|---|
| 8,152,985 | B2 | 4/2012 | Macary |
| 8,177,945 | B2 | 5/2012 | Arvin et al. |
| 8,192,608 | B2 | 6/2012 | Matthews |
| 8,253,035 | B2 | 8/2012 | Matsumoto |
| 8,293,077 | B2 | 10/2012 | Vacheron |
| 8,585,875 | B2 | 11/2013 | Cummings et al. |
| 8,814,437 | B2 | 8/2014 | Braun |
| 8,871,065 | B2 | 10/2014 | Vacheron |
| 8,916,001 | B2 | 12/2014 | Pryce Lewis et al. |
| 9,005,420 | B2 | 4/2015 | Tomantschger et al. |
| 9,056,405 | B2 | 6/2015 | Sato et al. |
| 9,080,692 | B2 | 7/2015 | Tomomori et al. |
| 9,108,506 | B2 | 8/2015 | Whitaker et al. |
| 9,115,439 | B2 | 8/2015 | Whitaker |
| 9,234,294 | B2 | 1/2016 | Whitaker et al. |
| 9,273,932 | B2 | 3/2016 | Whitaker et al. |
| 9,732,433 | B2 | 8/2017 | Caldwell et al. |
| 9,758,891 | B2 | 9/2017 | Bao |
| 9,783,907 | B2 | 10/2017 | Cai et al. |
| 9,938,629 | B2 | 4/2018 | Whitaker et al. |
| 10,041,185 | B2 | 8/2018 | Sukenari |
| 10,253,419 | B2 | 4/2019 | Lomasney |
| 10,266,957 | B2 | 4/2019 | Sugawara et al. |
| 10,472,727 | B2 | 11/2019 | Lomasney |
| 10,513,791 | B2 | 12/2019 | Lomasney et al. |
| 10,544,510 | B2 | 1/2020 | Lomasney |
| 10,662,542 | B2 | 5/2020 | Caldwell et al. |
| 10,689,773 | B2 | 6/2020 | Whitaker et al. |
| 10,695,797 | B2 | 6/2020 | Andreae et al. |
| 10,781,524 | B2 | 9/2020 | Whitaker et al. |
| 10,808,322 | B2 | 10/2020 | Whitaker et al. |
| 10,844,504 | B2 | 11/2020 | Sklar |
| 10,851,464 | B1 | 12/2020 | Kobayashi et al. |
| 10,961,635 | B2 | 3/2021 | Whitaker |
| 11,118,280 | B2 | 9/2021 | Lomasney et al. |
| 11,168,408 | B2 | 11/2021 | Sklar |
| 11,180,864 | B2 | 11/2021 | Lomasney |
| 11,242,613 | B2 | 2/2022 | Lomasney |
| 11,286,575 | B2 | 3/2022 | Lomasney et al. |
| 11,293,272 | B2 | 4/2022 | Lomasney |
| 2001/0003384 | A1 | 6/2001 | Morita |
| 2001/0037944 | A1 | 11/2001 | Sanada et al. |
| 2002/0011419 | A1 | 1/2002 | Arao et al. |
| 2002/0100858 | A1 | 8/2002 | Weber |
| 2002/0179449 | A1 | 12/2002 | Domeier et al. |
| 2003/0134142 | A1 | 7/2003 | Ivey et al. |
| 2003/0234181 | A1 | 12/2003 | Palumbo |
| 2003/0236163 | A1 | 12/2003 | Chaturvedi et al. |
| 2004/0027715 | A1 | 2/2004 | Hixson-Goldsmith et al. |
| 2004/0031691 | A1 | 2/2004 | Kelly et al. |
| 2004/0067314 | A1 | 4/2004 | Joshi et al. |
| 2004/0154925 | A1 | 8/2004 | Podlaha et al. |
| 2004/0178076 | A1 | 9/2004 | Stonas et al. |
| 2004/0211672 | A1 | 10/2004 | Ishigami et al. |
| 2004/0232005 | A1 | 11/2004 | Hubei |
| 2004/0234683 | A1 | 11/2004 | Tanaka et al. |
| 2004/0239836 | A1 | 12/2004 | Chase |
| 2005/0002228 | A1 | 1/2005 | Dieny et al. |
| 2005/0109433 | A1 | 5/2005 | Danger et al. |
| 2005/0205425 | A1 | 9/2005 | Palumbo et al. |
| 2005/0221100 | A1 | 10/2005 | Kirihara et al. |
| 2005/0279640 | A1 | 12/2005 | Shimoyama et al. |
| 2006/0065533 | A1 | 3/2006 | Inoue et al. |
| 2006/0135281 | A1 | 6/2006 | Palumbo et al. |
| 2006/0135282 | A1 | 6/2006 | Palumbo et al. |
| 2006/0201817 | A1 | 9/2006 | Guggemos et al. |
| 2006/0243597 | A1 | 11/2006 | Matefi-Tempfli et al. |
| 2006/0269770 | A1 | 11/2006 | Cox et al. |
| 2006/0272949 | A1 | 12/2006 | Detor et al. |
| 2006/0286348 | A1 | 12/2006 | Sauer |
| 2007/0158204 | A1 | 7/2007 | Taylor et al. |
| 2007/0269648 | A1 | 11/2007 | Schuh et al. |
| 2007/0278105 | A1 | 12/2007 | Ettel |
| 2008/0063866 | A1 | 3/2008 | Allen et al. |
| 2008/0093221 | A1 | 4/2008 | Basol |
| 2008/0102360 | A1 | 5/2008 | Stimits et al. |
| 2008/0226976 | A1 | 9/2008 | Stimits |
| 2008/0245669 | A1 | 10/2008 | Yoshioka et al. |
| 2008/0271995 | A1 | 11/2008 | Savastiouk et al. |
| 2008/0283236 | A1 | 11/2008 | Akers et al. |
| 2009/0004465 | A1 | 1/2009 | Kano et al. |
| 2009/0101511 | A1 | 4/2009 | Lochtman et al. |
| 2009/0114530 | A1 | 5/2009 | Noda et al. |
| 2009/0130424 | A1 | 5/2009 | Tholen et al. |
| 2009/0130425 | A1 | 5/2009 | Whitaker |
| 2009/0155617 | A1 | 6/2009 | Kim et al. |
| 2009/0283410 | A1 | 11/2009 | Sklar et al. |
| 2010/0078330 | A1 | 4/2010 | Hyodo |
| 2010/0116675 | A1 | 5/2010 | Sklar et al. |
| 2010/0187117 | A1 | 7/2010 | Lingenfelter et al. |
| 2010/0304063 | A1 | 12/2010 | McCrea et al. |
| 2010/0304179 | A1 | 12/2010 | Facchini et al. |
| 2010/0319757 | A1 | 12/2010 | Getting |
| 2011/0111296 | A1 | 5/2011 | Berdichevsky et al. |
| 2011/0162970 | A1 | 7/2011 | Sato |
| 2011/0180413 | A1 | 7/2011 | Whitaker et al. |
| 2011/0186582 | A1 | 8/2011 | Whitaker et al. |
| 2011/0256356 | A1 | 10/2011 | Tomantschger et al. |
| 2011/0277313 | A1 | 11/2011 | Soracco et al. |
| 2012/0118745 | A1 | 5/2012 | Bao |
| 2012/0135270 | A1 | 5/2012 | Wilbuer et al. |
| 2012/0231574 | A1 | 9/2012 | Wang |
| 2012/0282417 | A1 | 11/2012 | Garcia et al. |
| 2013/0052343 | A1 | 2/2013 | Dieny et al. |
| 2013/0071755 | A1 | 3/2013 | Oguro |
| 2013/0075264 | A1 | 3/2013 | Cummings et al. |
| 2013/0130057 | A1 | 5/2013 | Caldwell et al. |
| 2013/0186852 | A1 | 7/2013 | Dietrich et al. |
| 2013/0220831 | A1 | 8/2013 | Vidaurre Heiremans et al. |
| 2013/0224008 | A1 | 8/2013 | Cheung et al. |
| 2013/0323473 | A1 | 12/2013 | Dietsch et al. |
| 2014/0163717 | A1 | 6/2014 | Das et al. |
| 2014/0178637 | A1 | 6/2014 | Rajagopalan et al. |
| 2014/0231266 | A1 | 8/2014 | Sherrer et al. |
| 2015/0315716 | A1 | 11/2015 | Whitaker |
| 2015/0322588 | A1 | 11/2015 | Lomasney et al. |
| 2016/0002790 | A1 | 1/2016 | Whitaker et al. |
| 2016/0002803 | A1 | 1/2016 | Sklar |
| 2016/0002806 | A1 | 1/2016 | Lomasney |
| 2016/0002813 | A1 | 1/2016 | Lomasney |
| 2016/0027425 | A1 | 1/2016 | Cook et al. |
| 2016/0047980 | A1 | 2/2016 | Page et al. |
| 2016/0145850 | A1 | 5/2016 | Cook et al. |
| 2016/0159488 | A1 | 6/2016 | Roach et al. |
| 2016/0160863 | A1 | 6/2016 | Roach et al. |
| 2016/0214283 | A1 | 7/2016 | Schick et al. |
| 2017/0016130 | A1 | 1/2017 | Testoni et al. |
| 2017/0191179 | A1 | 7/2017 | Sklar |
| 2017/0275775 | A1 | 9/2017 | Guadarrama Calderon et al. |
| 2018/0016694 | A1 | 1/2018 | Bao |
| 2018/0066375 | A1 | 3/2018 | Morgan et al. |
| 2018/0071980 | A1 | 3/2018 | Lomasney et al. |
| 2018/0245229 | A1 | 8/2018 | Whitaker et al. |
| 2019/0309430 | A1 | 10/2019 | Sklar |
| 2019/0360116 | A1 | 11/2019 | Collinson et al. |
| 2020/0115998 | A1 | 4/2020 | Lomasney |
| 2020/0131658 | A1 | 4/2020 | Lomasney et al. |
| 2020/0173032 | A1 | 6/2020 | Lomasney |
| 2020/0277706 | A1 | 9/2020 | Lomasney et al. |
| 2020/0283923 | A1 | 9/2020 | Lomasney |
| 2020/0318245 | A1 | 10/2020 | Lomasney |
| 2020/0354846 | A1 | 11/2020 | Whitaker et al. |
| 2020/0392642 | A1 | 12/2020 | Lomasney |
| 2021/0071303 | A1 | 3/2021 | Whitaker et al. |
| 2021/0147995 | A1 | 5/2021 | Sklar |
| 2022/0081798 | A1 | 3/2022 | Collinson et al. |

FOREIGN PATENT DOCUMENTS

| | | | |
|---|---|---|---|
| CN | 1924110 | A | 3/2007 |
| CN | 101113527 | A | 1/2008 |
| CN | 101195924 | A | 6/2008 |
| CN | 201857434 | U | 6/2011 |
| CN | 102148339 | A | 8/2011 |

(56) References Cited

FOREIGN PATENT DOCUMENTS

| | | | |
|---|---|---|---|
| CN | 203584787 | U | 5/2014 |
| CN | 105442011 | A | 3/2016 |
| DE | 39 02 057 | A1 | 7/1990 |
| DE | 10 2004 006 441 | A1 | 12/2005 |
| EP | 1 688 518 | A2 | 8/2006 |
| EP | 2 189 554 | A1 | 5/2010 |
| JP | 47-2005 | A | 2/1972 |
| JP | 47-33925 | A | 11/1972 |
| JP | 52-109439 | A | 9/1977 |
| JP | 58-197292 | A | 11/1983 |
| JP | 60-97774 | A | 5/1985 |
| JP | 61-99692 | A | 5/1986 |
| JP | 1-132793 | A | 5/1989 |
| JP | 2-214618 | A | 8/1990 |
| JP | 5-251849 | A | 9/1993 |
| JP | 6-196324 | A | 7/1994 |
| JP | 07-065347 | A | 3/1995 |
| JP | H09-119000 | A | 5/1997 |
| JP | 2000-239888 | A | 9/2000 |
| JP | 2001-152388 | A | 6/2001 |
| JP | 2001-181893 | A | 7/2001 |
| JP | 2002-53999 | A | 2/2002 |
| JP | 2006-035176 | A | 2/2006 |
| JP | 2009-215590 | A | 9/2009 |
| KR | 2003-0092463 | A | 12/2003 |
| KR | 10-2015-0132043 | A | 11/2015 |
| SU | 36121 | A1 | 4/1934 |
| WO | 83/02784 | A1 | 8/1983 |
| WO | 95/14116 | A1 | 5/1995 |
| WO | 2004/001100 | A1 | 12/2003 |
| WO | 2007/045466 | A1 | 4/2007 |
| WO | 2007/138619 | A1 | 12/2007 |
| WO | 2008/057401 | A2 | 5/2008 |
| WO | 2009/045433 | A1 | 4/2009 |
| WO | 2011/033775 | A1 | 3/2011 |
| WO | 2011/110346 | A2 | 9/2011 |
| WO | 2012/145750 | A2 | 10/2012 |
| WO | 2013/133762 | A1 | 9/2013 |
| WO | 2017/097300 | A1 | 6/2017 |

OTHER PUBLICATIONS

Paz et al., "Nano-Laminated Alloys for Improved Return on Oilfield Assets," Society of Petroleum Engineers, 2016 (14 pages).

"Appendix 1: Literature review (Task 1): Literature review concerning the improvement of galvanneal (GA) coating adherence during shear test of adhesively bonded GA steel sheets," 70 pages, no date.

"Low-temperature iron plating," web blog article found at http:blog.sina.com.en/s/blog_48ed0a9c0100024z.html, published Mar. 22, 2006, 3 pages. (with English translation).

Adams et al., "Controlling strength and toughness of multilayer films: A new multiscalar approach," *J. Appl. Phys.* 74(2): 1015-1021, 1993.

Aizenberg et al., "Skeleton of *Euplectella* sp.: Structural Hierarchy from the Nanoscale to the Macroscale," *Science* 309:215-218, 2005.

Alfantazi et al., "Synthesis of nanocrystalline Zn—Ni alloy coatings," *JMSLD5* 15(15):1361-1363, 1996.

Atanassov et al., "Electrodeposition and properties of nickel-manganese layers," *Surface and Coatings Technology* 78:144-149, 1996.

Bakonyi et al., "Electrodeposited multilayer films with giant magnetoresistance (*GMR*): Progress and problems," *Progress in Materials Science* 55:107-245, 2010.

Bartlett et al., "Electrochemical deposition of macroporous platinum, palladium and cobalt films using polystyrene latex sphere templates," *Chem. Commun.*, pp. 1671-1672, 2000.

Beattie et al., "Comparison of Electrodeposited Copper-Zinc Alloys Prepared Individually and Combinatorially," *J. Electrochem. Soc.* 150(11):C802-C806, 2003.

Bird et al., "Giant Magnetoresistance in Electrodeposited Ni/Cu and Co/Cu Multilayers," *J. Electrochem. Soc.* 142(4):L65-L66, 1995.

Blum, "The Structure and Properties of Alternately Electrodeposited Metals," presented at the Fortieth General Meeting of the American Electrochemical Society, Lake Placid, New York, Oct. 1, 1921, 14 pages.

Cohen et al., "Electroplating of Cyclic Multilayered Alloy (CMA) Coatings," *J. Electrochem. Soc.* 130(10):1987-1995, 1983.

Cowles, "High cycle fatigue in aircraft gas turbines—an industry perspective," *International Journal of Fracture* 80(2-3):147-163, 1996.

"Designing with Metals: Dissimilar Metals and The Galvanic Series," printed Oct. 5, 2017, 3 pages.

Despic et al., "Electrochemical Formation of Laminar Deposits of Controlled Structure and Composition," *J. Electrochem. Soc.* 136(6):1651-1657, 1989.

Dini et al. "On the High Temperature Ductility Properties of Electrodeposited Sulfamate Nickel," *Plating and Surface Finishing* 65(2):36-40, 1978.

Etminanfar et al., "Corrosion resistance of multilayer coatings of nanolayered Cr/Ni electrodeposited from Cr(III)—Ni(II) bath," *Thin Solid Films* 520:5322-5327, 2012.

Gasser et al., "Materials Design for Acoustic Liners: an Example of Tailored Multifunctional Materials," *Advanced Engineering Materials*6(1-2):97-102, 2004.

Georgescu et al., "Magnetic Behavior of [Ni/Co—Ni—Mg—N] x n Cylindrical Multilayers prepared by Magnetoelectrolysis," *Phys. Stat. Sol.* (*a*) 189(3):10501-1055, 2002.

Ghanem et al., "A double templated electrodeposition method for the fabrication of arrays of metal nanodots," *Electrochemistry Communications* 6:447-453, 2004.

Grimmett et al., "Pulsed Electrodeposition of Iron-Nickel Alloys," *J. Electrochem. Soc.* 137(11):3414-3418, 1990.

Hariyanti, "Electroplating of Cu—Sn Alloys and Compositionally Modulated Multilayers of Cu—Sn—Zn—Ni Alloys on Mild Steel Substrate," Master of Science Thesis, University of Science, Malaysia, Penang, Malaysia, 2007.

Harris et al., "Improved Single Crystal Superalloys, CMSX-4® (SLS)[La+Y] and CMSX-486®," *TMS* (*The Minerals, Metals & Materials Society*), *Superalloys*, p. 45-52, 2004.

Huang et al., "Hardness variation and annealing behavior of a Cr—Ni multilayer electroplated in a trivalent chromium-based bath," *Surface and Coatings Technology* 203:3320-3324, 2009.

Huang et al., "Characterization of Cr—Ni multilayers electroplated from a chromium(III)-nickel(II) bath using pulse current," *Scripta Materialia*, 57:61-64, 2007.

Igawa et al., "Fabrication of SiC fiber reinforced SiC composite by chemical vapor infiltration for excellent mechanical properties," *Journal of Physics and Chemistry of Solids* 66:551-554, 2005.

Ivanov et al., "Corrosion resistance of compositionally modulated multilayered Zn—Ni alloys deposited from a single bath," *Journal of Applied Electrochemistry* 33:239-244, 2003.

Jeong et al., "The Effect of Grain Size on the Wear Properties of Electrodeposited Nanocrystalline Nickel Coatings," *Scripta Mater.* 44:493-499, 2001.

Jia et al., "LIGA and Micromolding " Chapter 4, *The MEMS Handbook*, 2nd edition, CRC Press, Boca Raton, Florida, Edited by Mohamed Gad-el-Hak, 2006.

Kalu et al., "Cyclic voltammetric studies of the effects of time and temperature on the capacitance of electrochemically deposited nickel hydroxide," *Journal of Power Sources* 92:163-167, 2001.

Kaneko et al., "Vickers hardness and deformation of Ni/Cu nano-multilayers electrodeposited on copper substrates," Eleventh International Conference on Intergranular and Interphase Boundaries 2004, *Journal of Material Science* 40:3231-3236, 2005.

Karimpoor et al., "Tensile Properties of Bulk Nanocrystalline Hexagonal Cobalt Electrodeposits," *Materials Science Forum* 386-388:415-420, 2002.

Keckes et al., "Cell-wall recovery after irreversible deformation of wood," *Nature Materials* 2:810-814, 2003.

Kirilova et al., "Corrosion behaviour of Zn—Co compositionally modulated multilayers electrodeposited from single and dual baths," *Journal of Applied Electrochemistry* 29:1133-1137, 1999.

(56) References Cited

OTHER PUBLICATIONS

Kockar et al., "Effect of potantiostatic waveforms on properties of electrodeposited NiFe alloy films," *Eur. Phys. J. B*(42):497-501, 2004.
Kruth et al., "Progress in Additive Manufacturing and Rapid Prototyping" *CIRP Annals* 47(2):525-540, 1998.
Lashmore et al., "Electrodeposited Cu—Ni Textured Superlattices," *J. Electrochem. Soc.* 135(5):1218-1221, 1988.
Lashmore et al., "Electrodeposited Multilayer Metallic Coatings," *Encyclopedia of Materials Science and Engineering*, Supp. vol. 1:136-140, 1988.
Leisner et al., "Methods for electrodepositing composition-modulated alloys," Journal of Materials Processing Technology 58:39-44, 1996.
Leith et al., "Characterization of Flow-Induced Compositional Structure in Electrodeposited NiFe Composition-Modulated Alloys" *J. Electrochem. Soc.* 145(8):2827-2833, 1998.
Lekka et al., "Corrosion and wear resistant electrodeposited composite coatings," *Electrochimica Acta* 50:4551-4556, 2005.
Lewis et al., "Stability in thin film multilayers and microlaminates: the role of free energy, structure, and orientation at interfaces and grain boundaries," *Scripta Materialia* 48:1079-1085, 2003.
Low et al., "Electrodeposition of composite coatings containing nanoparticles in a metal deposit," *Surface & Coating Technology* 201:311-383, 2006.
Malone, "New Developments in Electroformed Nickel-Based Structural Alloys," *Plating and Surface Finishing* 74(1):50-56, 1987.
Marchese, "Stress Reduction of Electrodeposited Nickel," *Journal of the Electrochemical Society* 99(2):39-43, 1952.
Meng et al., "Fractography, elastic modulus, and oxidation resistance of Novel metal-intermetallic Ni/$Ni_3Al$ multilayer films," *J. Mater. Res.* 17(4):190-196, 2002.
Naslain et al., "Synthesis of highly tailored ceramic matrix composites by pressure-pulsed CVI," *Solid State Ionics* 141-142:541-548, 2001.
Naslain, "The design of the fibre-matrix interfacial zone in ceramic matrix composites," *Composites Part A* 29A:1145-1155, 1998.
Nicholls, "Advances in Coating Design for High-Performance Gas Turbines," *MRS Bulletin*, p. 659-670, 2003.
Onoda et al., "Preparation of amorphous/crystalloid soft magnetic multilayer Ni—Co—B alloy films by electrodeposition," *Journal of Magnetism and Magnetic Materials* 126(1-3):595-598, 1993.
Parkin et al., "Oscillations in Exchange Coupling and Magnetoresistance in Metallic Superlattice Structures: Co/Ru, Co/Cr, and Fe/Cr," *Physical Review Letters* 64(19):2304-2307, 1990.
Pilone et al., "Model of Multiple Metal Electrodeposition in Porous Electrodes," *Journal of the Electrochemical Society* 153(5):D85-D90, 2006.
Podlaha et al. "Induced Codeposition: I. An Experimental Investigation of Ni—Mo Alloys," *J. Electrochem. Soc.* 143(3):885-892, 1996.
Ross, "Electrodeposited Multilayer Thin Films," *Annual Review of Materials Science* 24:159-188, 1994.
Rousseau et al., "Single-bath Electrodeposition of Chromium-Nickel Compositionally Modulated Multilayers (CMM) From a Trivalent Chromium Bath," *Plating and Surface Finishing*, p. 106-110, 1999.
Saleh et al., "Effects of electroplating on the mechanical properties of stereolithography and laser sintered parts," *Rapid Prototyping Journal* 10(5)305-315, 2004.
Sanders et al., "Mechanics of hollow sphere foams," *Materials Science and Engineering* A347:70-85, 2003.
Sartwell et al., "Replacement of Chromium Electroplating on Gas Turbine Engine Components Using Thermal Spray Coatings," Report No. NRL/MR/6170-05-8890, Naval Research Laboratory, 2005. (207 pages).
Schwartz, "Multiple-Layer Alloy Plating," ASM Handbook 5: Surface Engineering, p. 274-276, 1994.
Sherik, "Synthesis, Structure and Properties of Electrodeposited Bulk Nanocrystalline Nickel," Master's Thesis, Queen's University, Ontario, Canada, 1993.
Shishkovski, "Laser synthesis of functionally graded meso structures and bulk products," FIZMATLIT, Moscow, Russia, pp. 30-38, 2009, (with English Abstract).
Simunovich et al., "Electrochemically Layered Copper-Nickel Nanocomposites with Enhanced Hardness," *J. Electrochem. Soc.* 141(1):L10-L11, 1994.
Sperling et al., "Correlation of stress state and nanohardness via heat treatment of nickel-aluminide multilayer thin films," *J. Mater. Res.* 19(11):3374-3381, 2004.
Srivastava et al., "Corrosion resistance and microstructure of electrodeposited nickel-cobalt alloy coatings," *Surface & Coatings Technology* 201:3051-3060, 2006.
Stephenson, Jr., "Development and Utilization of a High Strength Alloy for Electroforming," *Plating* 53(2): 183-192, 1966.
Suresh, "Graded Materials for Resistance to Contact Deformation and Damage," *Science* 292:2447-2451, 2001.
Switzer et al., "Electrodeposited Ceramic Superlattices," *Science* 247(4941):444-446, 1990.
Tench et al., "Considerations in Electrodeposition of Compositionally Modulated Alloys," *J. Electrochem. Soc.* 137(10):3061-3066, 1990.
Tench et al., "Enhanced Tensile Strength for Electrodeposited Nickel-Copper Multilayer Composiies," *Metallurgical Transactions A* (15A):2039-2040, 1984.
Thangaraj et al., "Corrosion behavior of composition modulated multilayer Zn—Co electrodeposits produced using a single-bath technique," *J. of Appl. Electrochem.* 39:339-345, 2009.
Thangaraj et al., "Surface Modification by Compositionally Modulated Multilayered Zn—Fe Alloy Coatings," *Chinese Journal of Chemistry* 26:2285-2291, 2008.
Tokarz et al., "Preparation, structural and mechanical properties of electrodeposited Co/Cu multilayers," p*hys. stat. sol.* (*c*) 5(11):3526-3529, 2008.
Touchstone Research Laboratory, Ltd., Material Safety Data Sheet, CFOAM Carbon Foams, 2008. (4 pages).
Vill et al., "Mechanical Properties of Tough Multiscalar Microlaminates," *Acta metall. mater.* 43(2):427-437, 1995.
Voevodin et al., "Superhard, functionally gradient, nanolayered and nanocomposite diamond-like carbon coatings for wear protection," *Diamond and Related Materials* 7:463-467, 1998.
Wearmouth et al., "Electroforming with Heat-Resistant, Sulfur-Hardened Nickel," *Plating and Surface Finishing* 66(10):53-57, 1979.
Weil et al., "Pulsed Electrodeposition of Layered Brass Structures," *Metallurgical Transactions A* 19A:1569-1573, 1988.
Weil et al., "Properties of Composite Electrodeposits," U.S. Army Research Office, Final Report, Contract No. DAALO3-87-K-0047, 21 pages, 1990.
Wikipedia, "Gold," URL= http://en.wikipedia.org/wiki/Gold, version modified Nov. 3, 15 pages, 2008.
Wikipedia, "Silver," URL= http://en.wikipedia.org/wiki/Silver, version modified Nov. 3, 12 pages, 2008.
Wilcox, "Surface Modification With Compositionally Modulated Multilayer Coatings," *The Journal of Corrosion Science and Engineering* 6(Paper 52): 2004 (5 pages).
Wu et al., "Preparation and characterization of superhard $CN_x$/ZrN multilayers," *J. Vac. Sci. Technol. A* 15(3):946-950, 1997.
Yahalom et al., "Formation of composition-modulated alloys by electrodeposition," *Journal of Materials Science* 22:499-503, 1987.
Yang et al., "Effects of SiC sub-layer on mechanical properties of Tyranno-SA/SiC composites with multiple interlayers," *Ceramics International* 37:525-531, 2005.
Yang et al., "Enhanced elastic modulus in composition-modulated gold-nickel and copper-palladium foils," *Journal of Applied Physics* 48(3):876-879, 1977.
Yogesha et al., "Optimization of deposition conditions for development of high corrosion resistant Zn—Fe multilayer coatings," *Journal Materials Processing Technology* 211:1409-1415, 2011.

(56) References Cited

OTHER PUBLICATIONS

Zabludovsky et al., "The Obtaining of Cobalt Multilayers by Programme-controlled Pulse Current," Transactions of the Institute of Metal Finishing 75(5):203-204, 1997.
U.S. Appl. No. 16/909,939, filed Jun. 23, 2020.
U.S. Appl. No. 16/940,314, filed Jul. 27, 2020.
U.S. Appl. No. 17/024,007, filed Sep. 17, 2020.
U.S. Appl. No. 17/077,970, filed Oct. 22, 2020.
U.S. Appl. No. 17/409,688, filed Aug. 23, 2021.
U.S. Appl. No. 17/533,015, filed Nov. 22, 2021.
U.S. Appl. No. 17/678,841, filed Feb. 23, 2022.

* cited by examiner

APPARATUSES, SYSTEMS, AND METHODS FOR PRODUCING A PLURALITY OF ARTICLES WITH NANOLAMINATED COATINGS USING ROTATION

BACKGROUND

Technical Field

The present disclosure generally relates to apparatuses, systems, and methods for electrodepositing coatings onto cylindrical articles, and more specifically to electrodepositing compositionally modulated (e.g., concentration of metals in an alloy, etc.) or structurally modulated (e.g., layer thickness, layer density, etc.), nano- or microlaminate coatings.

Background

Typical rack processing techniques require that a workpiece be mounted on a fixture, which is then lowered into a plating solution and connected to an electrical power source. Electrodeposition techniques typically require large contact areas between the electrical power source and the workpiece, and a known distance between the workpiece and an anode. This is particularly problematic for workpieces with complex geometries, such as cylindrical workpieces. Due to the shape of the workpiece, it is difficult to produce a coating that is substantially uniform in thickness, and, in particular, when attempting to coat multiple workpieces at once.

There has been effort in the field to improve the efficiency of producing heat, wear, and corrosion resistant coatings for cylindrical substrates. While some progress has been made, a need exists for improved apparatuses, systems, and methods to produce nanolaminate coatings on cylindrical substrates that provide such improvements. The present disclosure addresses these issues and provides related improvements with significant advantages.

SUMMARY

In various aspects, the present disclosure provides an apparatus comprising: at least one support structure configured to support a plurality of workpieces around a rotational axis, each workpiece of the plurality of workpieces having a substantially cylindrical shape with an outer surface and a longitudinal axis; and a drive assembly configured to rotate the plurality of workpieces around the rotational axis.

In embodiments, an apparatus further comprises a contact point assembly is further configured to enable electrical contact with the plurality of workpieces. In some embodiments, the contact point assembly is configured to rotate each workpiece of the plurality of workpieces rotate around its respective longitudinal axis.

In other aspects, the present disclosure provides a system comprising: a plurality of workpieces around a rotational axis, each workpiece of the plurality of workpieces having a substantially cylindrical shape with an outer surface and a longitudinal axis; and an apparatus described herein.

In some embodiments, individual workpieces of the plurality of workpieces are coupled in series with individual couplers of the plurality of couplers arranged between the individual workpieces.

In further aspects, the present disclosure provides a method for producing a nanolaminate coating on a plurality of workpieces, the method comprising: introducing the plurality of workpieces, each workpiece being substantially cylindrical, having a longitudinal axis, and having an outer surface, to a system described herein; rotating the plurality of workpieces around a rotational axis at a rotational speed; and electrodepositing an electrodepositable species onto the plurality of workpieces as a first nanolaminate coating on at least a portion of the outer surface of each of the plurality of workpieces

BRIEF DESCRIPTION OF THE DRAWINGS

The detailed description is described with reference to the accompanying figures. In the figures, the left-most digit(s) of a reference number identifies the figure in which the reference number appears. The same right-most digits of a reference number in different figures indicates similar or identical components or features.

The sizes and relative positions of elements in the figures are not necessarily drawn to scale. For example, the shapes of various elements and angles are not drawn to scale and some of these elements are arbitrarily enlarged and positioned to improve figure legibility. Further, the particular shapes of the elements as drawn, are not intended to convey any information regarding the actual shape of the particular elements, and have been solely selected for ease of recognition in the figures.

DETAILED DESCRIPTION

Figure 1A:
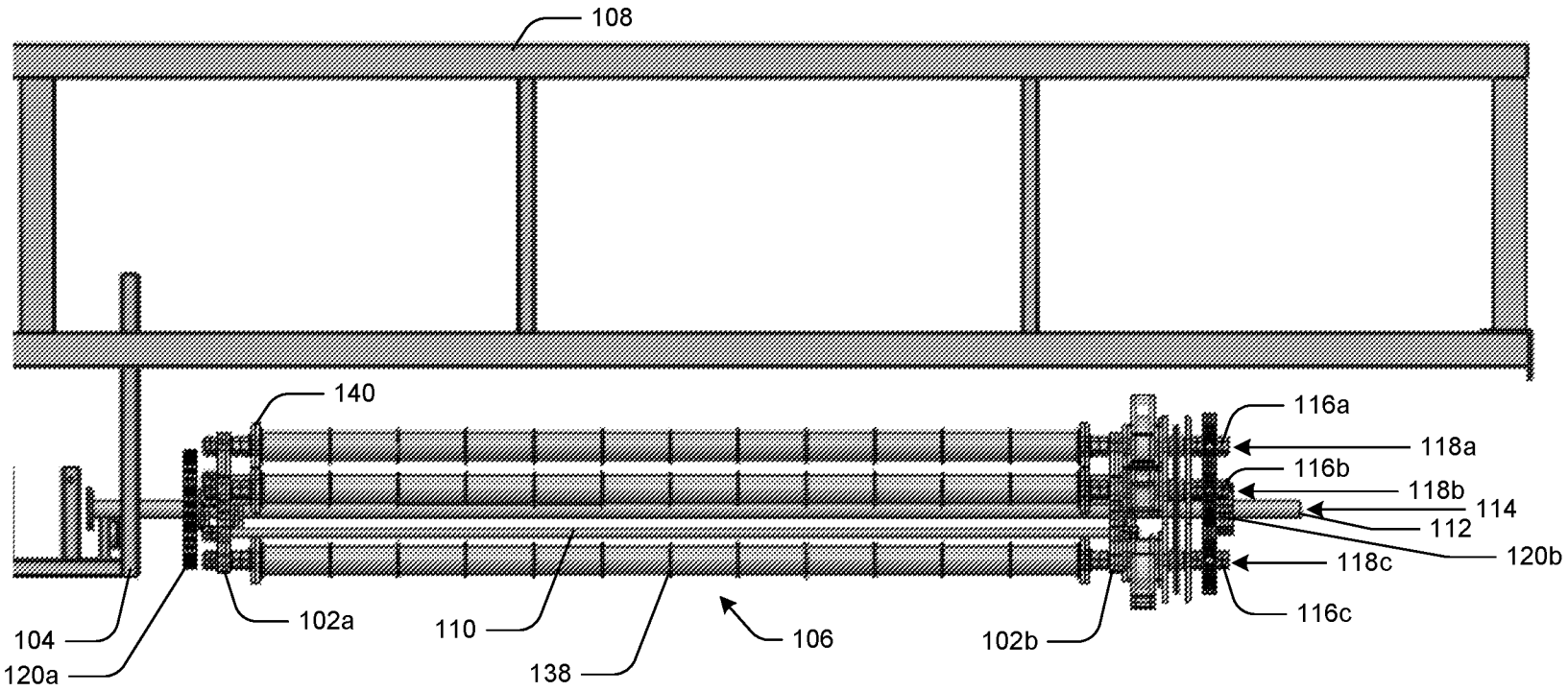
FIGS. 1A-1C are several views of an example of an electrodeposition apparatus of the disclosure.

The present disclosure is generally directed to electrodeposited nanolaminate coatings on tubular substrates, which have improved heat, wear, and corrosion resistance, as well as methods of making and using the same.

Prior to setting forth this disclosure in more detail, it may be helpful to an understanding thereof to provide definitions of certain terms to be used herein. Additional definitions are set forth throughout this disclosure.

"Electrodeposition" or "electrodeposited" refers to a process or a resultant product, respectively, in which electrolysis is used to deposit a coating onto a workpiece. In other words, a workpiece is contacted with (e.g., partially immersed in, or fully immersed in) an electrolyte solution containing one or more ions (e.g., metal, ceramic, etc.) while an electric current is passed through the workpiece and the electrolyte solution, resulting in a thin coating being deposited on the surface of the workpiece. Such an electrodeposited coating that includes two or more layers may be referred to as a "laminate" coating.

For the purposes of this disclosure "coatings" include any thin layers that are electrodeposited onto a surface of a workpiece. Therefore "coatings," as used herein, includes claddings, which are made of a series of thin electrodeposited layers on a surface of a mandrel, where the mandrel is removed after formation of the electrodeposited layers. Claddings are generally fastened to another article as a protective layer after formation.

A "nanolaminate coating" refers to an electrodeposited coating that includes at least one layer with a thickness of less than 10,000 nanometers (i.e., 10 microns). In embodiments, a nanolaminate coating includes two or more layers in which individual layers have a thickness of less than 10,000 nanometers. Although processes described herein are particularly suited for providing nanolaminate coatings, the same or similar processes can also be used to make similar articles in which individual layers that are thicker than 10 microns. Such coatings may be referred to as "microlaminate coatings."

The term "workpiece" includes any item with a surface onto which a coating is electrodeposited. Workpieces include substrates, which are objects on which a coating is applied, and mandrels, which are substrates from which the coating is removed after formation. Generally, for the purposes of this disclosure cylindrical workpieces are used.

"Cylindrical workpieces" have a substantially cylindrical shape and a longitudinal axis, which runs from a center of one base of the substantially cylindrical shape to a center of the other base. As used herein, "cylindrical workpieces" include tubular workpieces and columnar workpieces.

"Tubular workpieces" have a substantially cylindrical shape and a hollow cavity defined by an inner surface of a tubular workpiece. A hollow cavity of a tubular workpiece is generally substantially cylindrical in shape and is aligned along a longitudinal axis. Additionally, a base of a hollow cavity is centered substantially in the center of a base of a tubular workpiece. In contrast, a "columnar workpiece" is substantially cylindrical, but does not have a hollow cavity.

An "article" describes a finished product of a workpiece that has been coated by a method as described herein. Therefore, an article is a workpiece with a nanolaminate or microlaminate coating.

"Balance" or "balance of the composition," as used herein in reference to the composition of materials, refers to the portion of the composition not defined by an explicit amount or range, or, in other words, the remainder of the composition.

All compositions given as percentages are given as percent by weight unless stated otherwise.

The term "about" has the meaning reasonably ascribed to it by a person of ordinary skill in the art when used in conjunction with a stated numerical value or range, i.e. denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

The term "substantially" has the meaning reasonably ascribed to it by a person of ordinary skill in the art when used to describe a physical characteristic of an item, i.e., indicating that the item possesses the referenced characteristic to a significant extent, e.g., to within a range of ±20% of the referenced characteristic; ±19% of the referenced characteristic; ±18% of the referenced characteristic; ±17% of the referenced characteristic; ±16% of the referenced characteristic; ±15% of the referenced characteristic; ±14% of the referenced characteristic; ±13% of the referenced characteristic; ±12% of the referenced characteristic; ±11% of the referenced characteristic; ±10% of the referenced characteristic; ±9% of the referenced characteristic; ±8% of the referenced characteristic; ±7% of the referenced characteristic; ±6% of the referenced characteristic; ±5% of the referenced characteristic; ±4% of the referenced characteristic; ±3% of the referenced characteristic; ±2% of the referenced characteristic; or ±1% of the referenced characteristic. For example, an item may be considered substantially circular if any two measurements of a diameter of the item are within a range of ±20%, ±19%; ±18%; ±17%; ±16%; ±15%; ±14%; ±13%; ±12%; ±11%; ±10%; ±9%; ±8%; ±7%; ±6%; ±5%; ±4%; ±3%; ±2%; or ±1% of each other. When used in conjunction with a comparator (e.g., a first coating is substantially thicker than a second coating) substantially is used to mean that the difference is at least ±20% of the referenced characteristic; ±19% of the referenced characteristic; ±18% of the referenced characteristic; ±17% of the referenced characteristic; ±16% of the referenced characteristic; ±15% of the referenced characteristic; ±14% of the referenced characteristic; ±13% of the referenced characteristic; ±12% of the referenced characteristic; ±11% of the referenced characteristic; ±10% of the referenced characteristic; ±9% of the referenced characteristic; ±8% of the referenced characteristic; ±7% of the referenced characteristic; ±6% of the referenced characteristic; ±5% of the referenced characteristic; ±4% of the referenced characteristic; ±3% of the referenced characteristic; ±2% of the referenced characteristic; or ±1% of the referenced characteristic.

The terms "a," "an," "the," and similar articles or terms used in the context of describing the disclosure (especially in the context of the following claims) are to be construed to cover both the singular and the plural (i.e., "one or more"), unless otherwise indicated herein or clearly contradicted by context. Ranges of values recited herein are intended to serve as a shorthand method of referring individually to each separate value falling within the range. In the present description, any concentration range, percentage range, ratio range, or integer range is to be understood to include the value of any integer within the recited range and, when appropriate, fractions thereof (such as one tenth and one hundredth of an integer), unless otherwise indicated. Also, any number range recited herein relating to any physical feature, such as size or thickness, are to be understood to include any integer within the recited range, unless otherwise indicated. Unless otherwise indicated herein, each individual value is incorporated into the specification as if it were individually recited herein.

The use of the alternative (e.g., "or") should be understood to mean one, both, or any combination thereof of the alternatives. The various embodiments described above can be combined to provide further embodiments. Groupings of alternative elements or embodiments of the disclosure described herein should not be construed as limitations. Each member of a group may be referred to and claimed individually, or in any combination with other members of the group or other elements found herein.

Each embodiment disclosed herein can comprise, consist essentially of, or consist of a particular stated element, step, ingredient, or component. The term "comprise" or "comprises" means "includes, but is not limited to," and allows for the inclusion of unspecified elements, steps, ingredients, or components, even in major amounts. The phrase "consisting of" excludes any element, step, ingredient, or component that is not specified. The phrase "consisting essentially of" limits the scope of the embodiment to the specified elements, steps, ingredients, or components, and to those that do not materially affect the basic and novel characteristics of the claimed disclosure.

Apparatuses for Electrodepositing Nanolaminate Coatings Articles of the present disclosure may be produced using specialized apparatuses. In order to describe particular embodiments of the apparatuses and systems of the disclosure, reference is made to the appended figures. This discussion should not be construed as limiting, as the particular details of the embodiments described herein are by way of example and are for purposes of illustrative discussion of embodiments of the present disclosure.

Apparatuses of the present disclosure include a support structure, which is designed to support a plurality of workpieces arranged around a rotational axis.

In some embodiments, the support structure of the present disclosure comprises one or more guides 102*a*, 102*b*, which are used to arrange the plurality of workpieces 106 around the rotational axis, as shown in FIG. 1A. Guides may be made of any suitable materials. In embodiments, the material is non-conductive and inert when contacted with an electrolyte solution. For example, guides may be formed from an acrylic, delrin, or the like.

Figure 2:
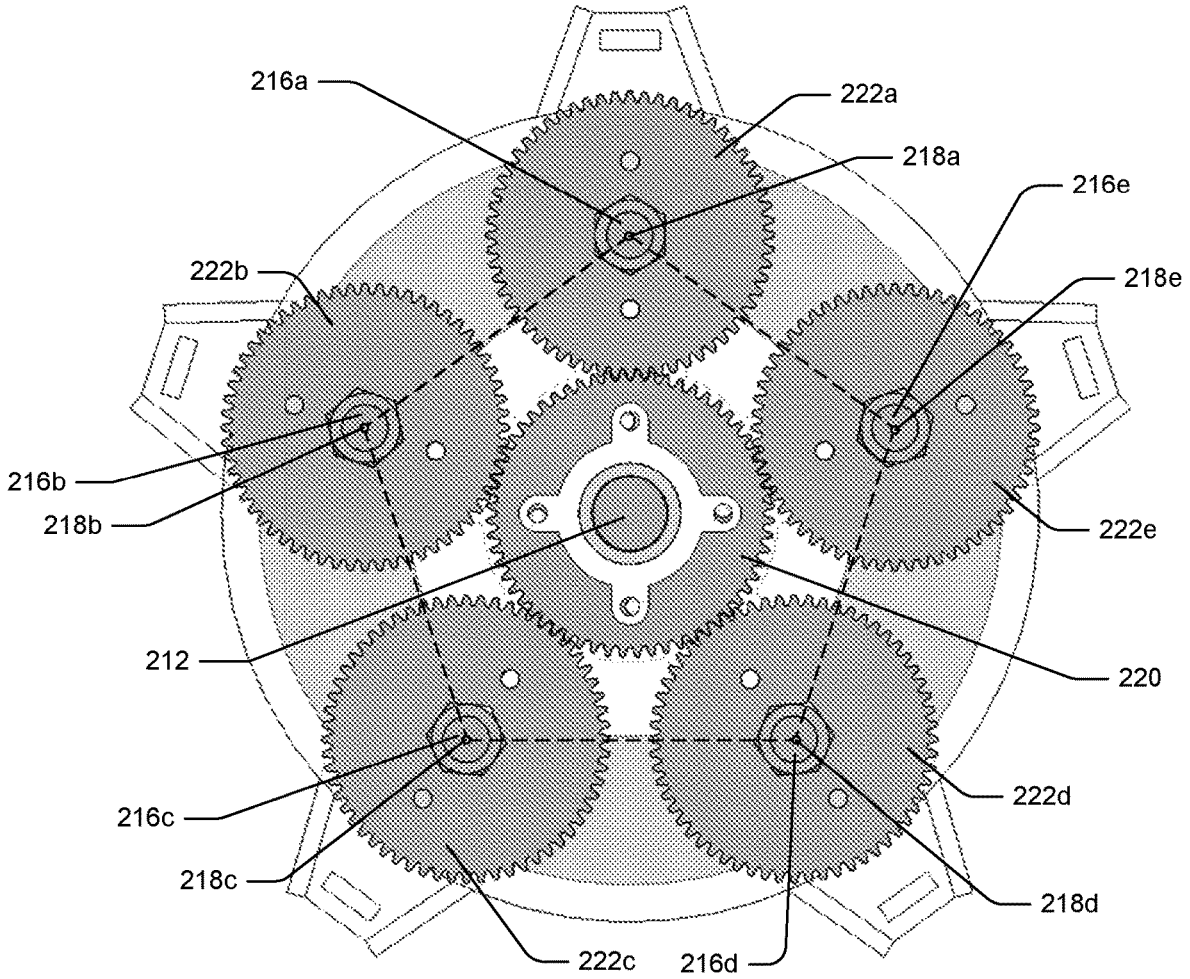
FIG. 2 is a view of a gear system of an embodiment of an electrodeposition apparatus of the disclosure.
Figure 7A:
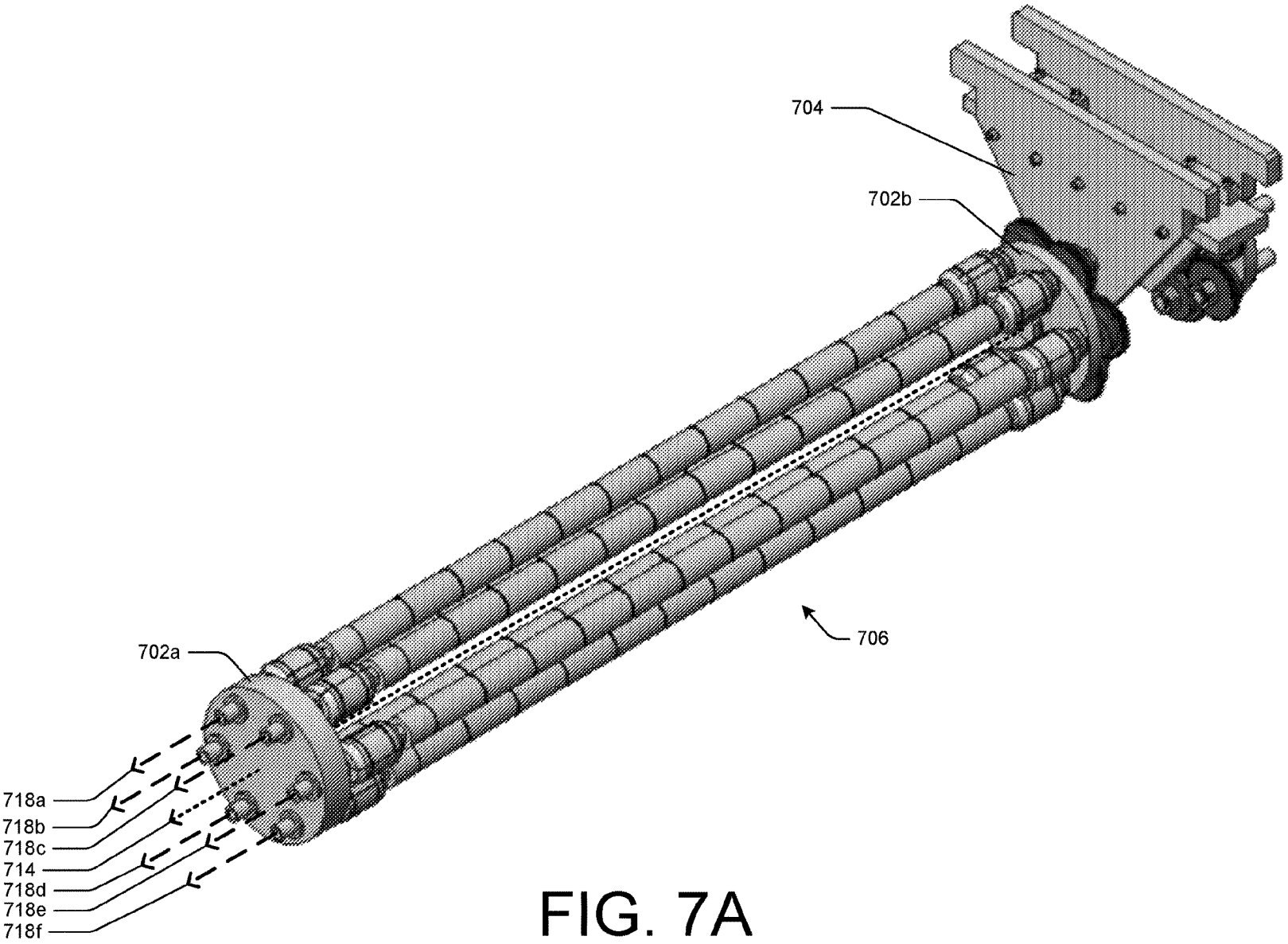
FIGS. 7A-7D are several views of an embodiment of an electrodeposition apparatus of the disclosure.

In embodiments, a plurality of workpieces is arranged substantially parallel to each other. In some embodiments, the plurality of workpieces is arranged in a polygonal configuration, as shown in FIG. 2. In other words, lines connecting the longitudinal axis 218*a*, 218*b*, 218*c*, 218*d*, 218*e* of each of the plurality of workpieces, when viewed in a direction parallel to the longitudinal axes, would form a polygon, as illustrated in FIG. 2 by the dashed lines. In some embodiments, the polygon formed has three sides. In some embodiments, the polygon formed has four sides. In some embodiments, the polygon formed has five sides, as shown in FIG. 2. In some embodiments, the polygon formed has six sides, as shown in FIG. 7A. In embodiments, the plurality of workpieces is spaced such that the individual workpieces do not make physical contact. In embodiments, the plurality of workpieces are spaced such that the distance between the individual workpieces is at least about the same as the outer diameter of a workpiece.

In some embodiments, the support structure supports a plurality of workpieces that are arranged in a planar configuration. In other words, two the workpieces are arranged next to each other in a line, such that first ends of the workpieces are aligned, second ends of the workpieces are aligned, and midpoints of the workpieces are aligned. In some such embodiments, the rotational axis may be a longitudinal axis of one of the workpieces.

Returning to FIG. 1A, in embodiments, the at least one support structure of the present disclosure comprises a support member 104 that supports the plurality of workpieces 106 during the electrodeposition process. In some embodiments, the support member(s) 104 couple to a rack 108. In some embodiments, the support member(s) 104 are integrated with a rack 108.

Figure 8:
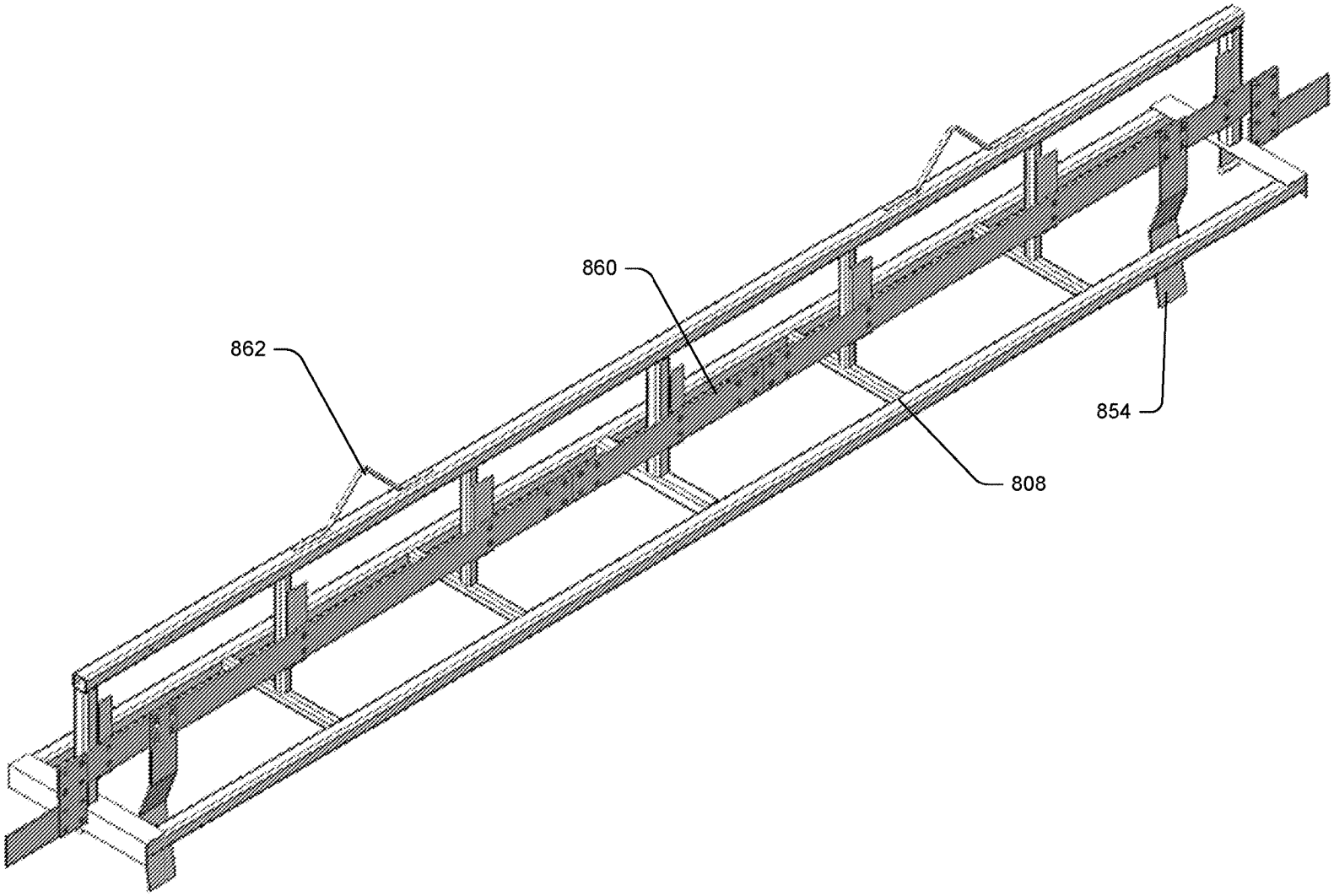
FIG. 8 is a view of an illustrative embodiment of a rack and conductive bus of the disclosure.

Additionally, support members 804 and/or rack 808 may have attachments 862 that allow a support member 804 and/or rack 808 to be coupled to (e.g., suspended from) an overhead gantry or gantry system that allows the plurality of workpieces to be transported between processing tanks, holding areas, storage areas, and the like, as shown in FIG. 8. Alternatively, support members 804 and/or rack 808 may have attachments that allow a support member to be coupled to (e.g., supported by) a vehicle such as, a trolley or a tractor, in order to facilitate transport. In some embodiments, a gantry system or a vehicle is automated. In some embodiments, a gantry crane or vehicle is coupled to a rack during an electrodeposition process. In other embodiments, a gantry crane or a vehicle releases the support member(s) during an electrodeposition process. In further embodiments, a same gantry crane or vehicle re-couples with the support member(s) after completion. In other embodiments, a different gantry crane or vehicle may couple with the support member(s) after completion.

Returning to FIG. 1A, in some embodiments, there are two or more support members that are not physically connected together. For example, support member 104 is not physically connected to a second support member (not pictured), and, therefore, is configurable to support workpieces 106 of various lengths. In some embodiments, support member 104 supports a workpieces 106 with a length ranging from about 0.1 meters (m) to 15 m. In further embodiments, support member 104 supports a workpieces 106 that has a length ranging from about 0.10 m to about 0.15 m; from about 0.10 m to about 0.5 m; from about 0.10 m to about 1.0 m; from about 0.10 m to about 0.4 m; from about 0.10 m to about 1.51 m; from about 0.10 m to about 10.7 m; from about 0.10 m to about 13.8 m; from about 0.15 m to about 0.4 m; from about 0.15 m to about 1.51 m; from about 0.15 m to about 10.7 m; from about 0.15 m to about 13.8 m; from about 0.3 m to about 0.7 m; from about 0.6 m to about 1.51 m; from about 1 m to about 2 m; from about 1 m to about 5 m; from about 1 m to about 14.5 m; from about 1.5 m to about 3.1 m; from about 1.5 m to about 6.1 m; from about 2 m to about 3 m; from about 3 m to about 4 m; from about 3 m to about 4.6 m; from about 4 m to about 5 m; from about 4.5 m to about 6.1 m; from about 5 m to about 6 m; from about 5 m to about 10 m; from about 5 m to about 14.5 m; from about 6 m to about 7 m; from about 6 m to about 7.7 m; from about 6 m to about 11 m; from about 7 m to about 8 m; from about 7.6 m to about 9.2 m; from about 8 m to about 9 m; from about 9 m to about 10 m; from about 9.1 m to about 10.7 m; from about 10 m to about 11 m; from about 10 m to about 14.5 m; from about 10.6 m to about 12.2 m; from about 10.6 m to about 13.8 m; from about 11 m to about 12 m; from about 12 m to about 13 m; from about 12.1 m to about 13.8 m; from about 13 m to about 13.5 m; from about 13.5 m to about 14 m; or from about 14 m to about 14.5 m.

In embodiments, the support structures are designed to support a plurality of workpieces where each of the workpieces has substantially the same length, substantially the same outer diameter, substantially the same inner diameter, or a combination thereof.

In other embodiments, support member 104 is configured to accommodate workpieces 106 with a fixed length ranging from about 0.1 m to 15 m. In embodiments, support member 104 support a workpieces 106 with a length of about 0.15 m, about 0.3 m, about 0.4 m, about 0.6 m, about 0.7 m, about 1 m, about 1.5 m, about 2 m, about 3 m, about 4 m, about 5 m, about 6 m, about 7 m, about 8 m, about 9 m, about 10 m, about 11 m, about 12 m, about 13 m, about 14 m, or about 15 m.

In some embodiments, additional support members are added to the rack in order to provide additional support for the workpieces. In further embodiments, additional support members are generally added at or near a mid-point of the workpiece arrangements.

Support structures of the present disclosure may hold workpieces 106 such that a longitudinal axis of the workpieces is substantially horizontal. In other embodiments, support structures hold workpieces such that the longitudinal axis is at an incline ranging from about 0.5 degrees to about 2.5 degrees relative to horizontal. In some embodiments, support structures hold a workpieces 106 such that a longitudinal axis is at an incline ranging from about 0.5 degrees to about 1 degree; from about 1 degree to about 1.5 degrees; from about 1.5 degrees to about 2 degrees; or from about 2 degrees to about 2.5 degrees.

Support structures of the present disclosure may hold workpieces 106 such that the rotational axis of the plurality of workpieces is substantially horizontal. In other embodiments, support structures hold the workpieces such that a rotational axis is at an incline ranging from about 0.5 degrees to about 2.5 degrees relative to horizontal. In some embodiments, support structures hold workpieces 106 such that the rotational axis is at an incline ranging from about 0.5 degrees to about 1 degree; from about 1 degree to about 1.5 degrees; from about 1.5 degrees to about 2 degrees; or from about 2 degrees to about 2.5 degrees.

In embodiments, support structures may further comprise one or more support rods 110. Such support rods 110 may be coupled to other support structures, such as guides 102*a*, 102*b*. In embodiments, such support rods are positioned in order to prevent flexing in the apparatus. In some embodiments, at least two support rods are present. In some embodiments, at least three support rods are present. In some embodiments, at least four support rods are present. In some embodiments, at least five support rods are present. Such support rods are generally centered around the rotational axis.

Support structures may be fabricated from a non-conductive material such as, polyvinylchloride (PVC), polyethylene (e.g. high density polyethylene (HDPE), acrylonitrile butadiene styrene (ABS), polypropylene (PP), or any combination thereof. In some embodiments, a support structure is made of a conductive material. In some embodiments, a support structure is made of a conductive material or a non-conductive material may be coated with a non-conductive coating such as, PVC, polyethylene, polycarbonate, polyurethane, synthetic rubber, acrylic, or any combination thereof.

An apparatus of the present disclosure further comprises a drive assembly that rotates the plurality of workpieces 106 around the rotational axis 114. Accordingly, in embodiments, an apparatus of the present disclosure comprises at least one support structure configured to support a plurality of workpieces around a rotational axis, each workpiece of the plurality of workpieces having a substantially cylindrical shape with an outer surface and a longitudinal axis; and a drive assembly configured to rotate the plurality of workpieces around the rotational axis.

In embodiments, a drive assembly comprises a central rod 112 that is aligned along the rotational axis 114. In embodiments, a central rod 112 is made of a suitable non-conductive material (e.g., a plastic or a polymeric material, such as a composite material). In embodiments, a central rod 112 is made of a conductive (or a non-conductive) material that is coated with a suitable non-conductive coating (e.g., a plastic or a polymeric material, such as a composite material) using methods known in the art, such as via shrink wrapping, dip coating, painting, and the like. Suitable non-conductive materials or coatings are chosen based on the chemistry of the electrolyte bath, such that the material or coating does not contaminate an electrolyte solution. In other embodiments, a central rod 112 is made of a suitable conductive material.

Figure 1B:
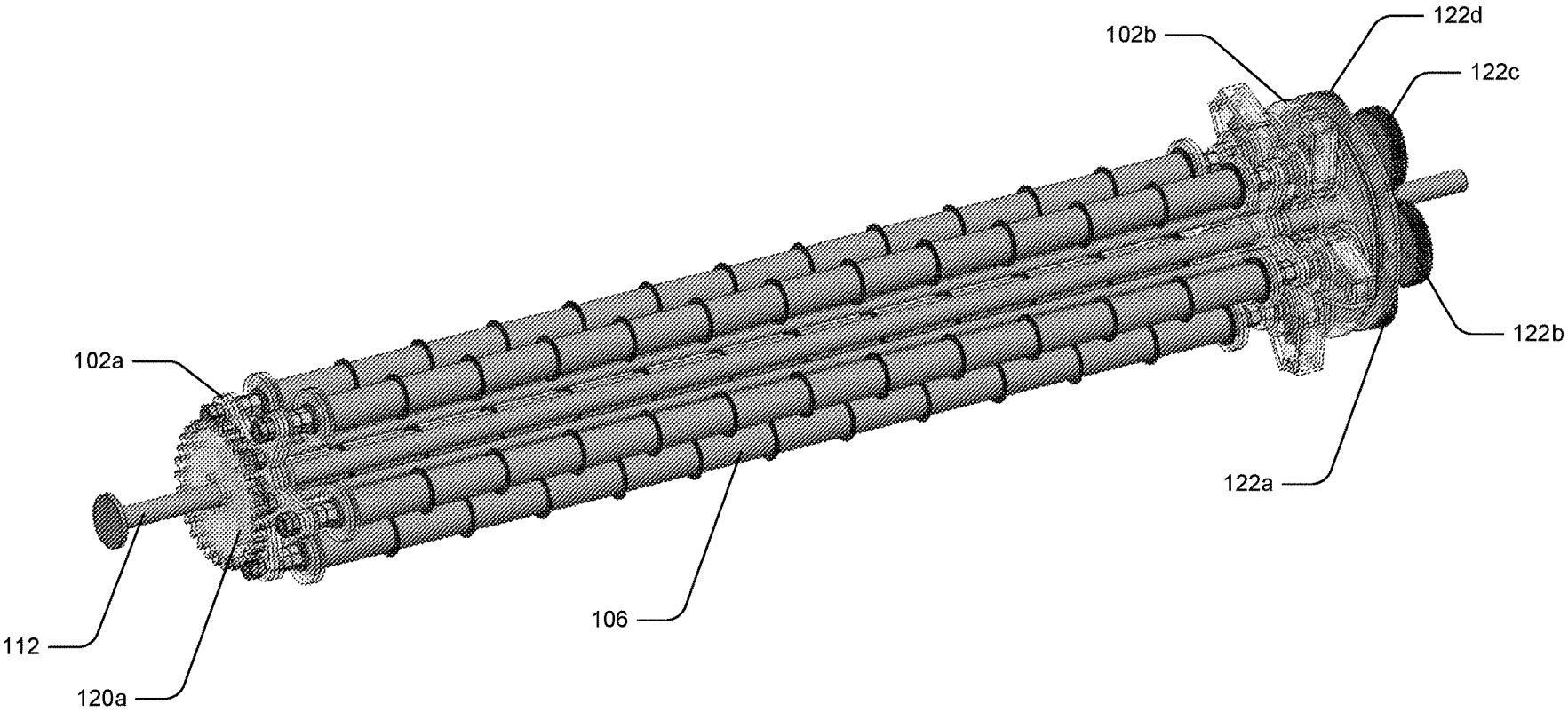
Figure 1C:
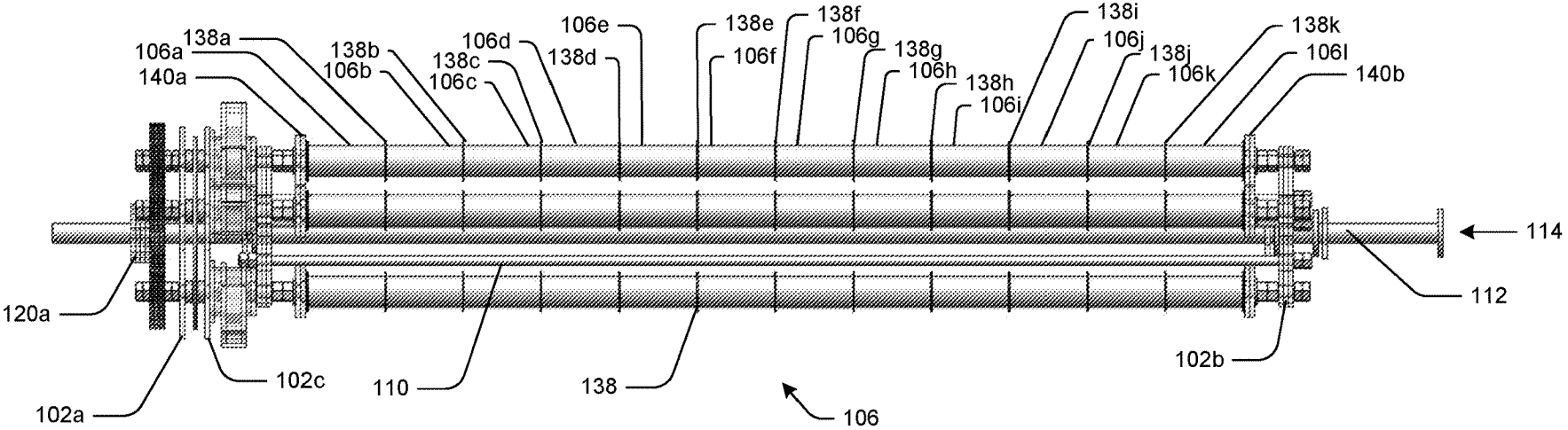

In embodiments, a drive assembly further comprises one or more central gears 120*a*, 120*b*, which surround central rod 112. Alternate views of the apparatus of FIG. 1A are shown in FIG. 1B and FIG. 1C. As can be seen central gear 120*a* surrounds central rod 112, around which the plurality of workpieces 106 are arranged. Although not necessary, central gears 120*a* may be arranged near (e.g., next to) a guide 102*a*.

As shown in FIG. 2, which is an alternate view of the apparatus of FIG. 1A as viewed in a direction parallel to the rotational axis, central gear 220 surrounds central rod 212.

In some embodiments, a central gear 220 is engaged by a motor to rotate a plurality of workpieces around a rotational axis. In use, a motor may be submerged in an electrolyte solution in a processing tank. In such embodiments, a motor may be housed in a suitable housing. In some embodiments, a housing is fabricated from a polymeric material (e.g., composite, thermoplastic, or thermoset) that is sealed (i.e., water tight).

Figure 9A:
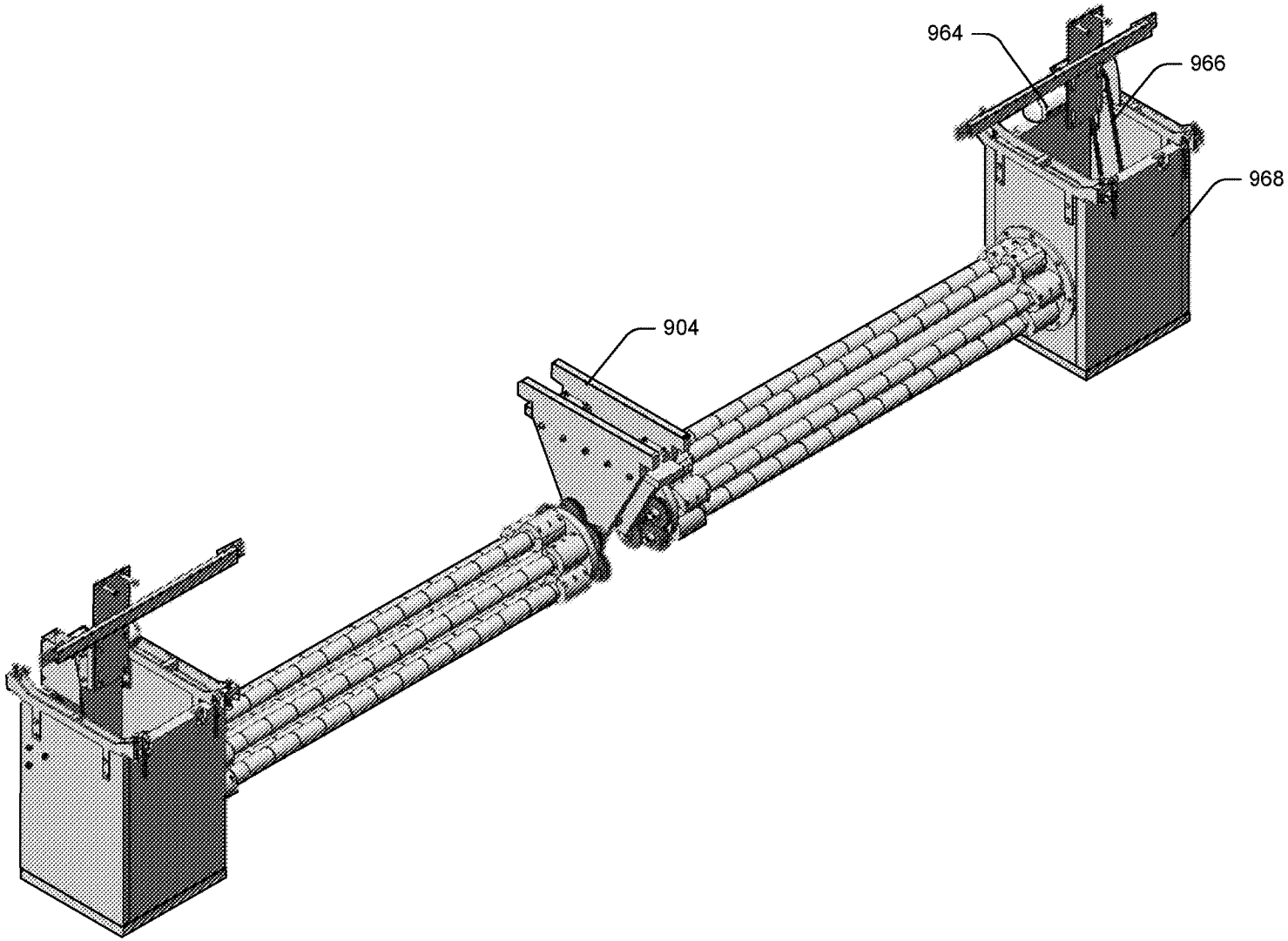
FIGS. 9A and 9B are views of an embodiment of an electrodeposition apparatus of the disclosure.

In other embodiments, a motor 964 may, in use, be maintained outside of the electrolyte solution, as shown in FIG. 9A. In such embodiments, a pulley system 966 may be arranged to translate the motion (e.g., linear motion) from the motor to the drive assembly.

A motor controller may be used to control a motor. In some embodiments, a motor controller is used to start or stop the motor, or to vary a speed as desired. In some embodiments, a motor or motor controller is a part of an apparatus of the disclosure. In other embodiments, a motor or motor controller is separate from an apparatus of the disclosure.

A plurality of workpieces may be rotated (e.g. by a motor) around the rotational axis at a rotational speed ranging from about 0.5 revolutions per minute (rpm) to about 10 rpm. In embodiments, a plurality of workpieces is rotated (e.g., by a motor) around the rotational axis at a rotational speed ranging from about 0.5 rpm to about 3 rpm, about 1 rpm to about 4 rpm, about 2 rpm to about 5 rpm, about 3 rpm to about 6 rpm, about 4 rpm to about 7 rpm, about 5 rpm to about 8 rpm, about 6 rpm to about 9 rpm, or about 7 rpm to about 10 rpm. In some embodiments, a plurality of workpieces is rotated (e.g., by a motor) around the rotational axis at a rotational speed ranging from about 0.5 rpm to about 1 rpm, about 1 rpm to about 2 rpm, about 2 rpm to about 3 rpm, about 3 rpm to about 4 rpm, about 4 rpm to about 5 rpm, about 5 rpm to about 6 rpm, about 6 rpm to about 7 rpm, about 7 rpm to about 8 rpm, about 8 rpm to about 9 rpm, or about 9 rpm to about 10 rpm.

An apparatus described herein may further include a gear box. Such a gear box may be in a same housing as a motor, or in a second housing. A motor of the present disclosure may connect to a first end of a gear box. In embodiments, a gear box is a right-angle (or 90 degree) gear drive that translates linear motion from a linear motor into rotary motion. A second end of a gear box may be connected to a gear 220.

Additionally, an apparatus of the present disclosure may further include one or more bearings that rotate as the plurality of workpieces rotate around the rotational axis. Such bearings may support the plurality of workpieces at any suitable position, such as at a coupler, at the central rod, or the like.

Figure 3A:
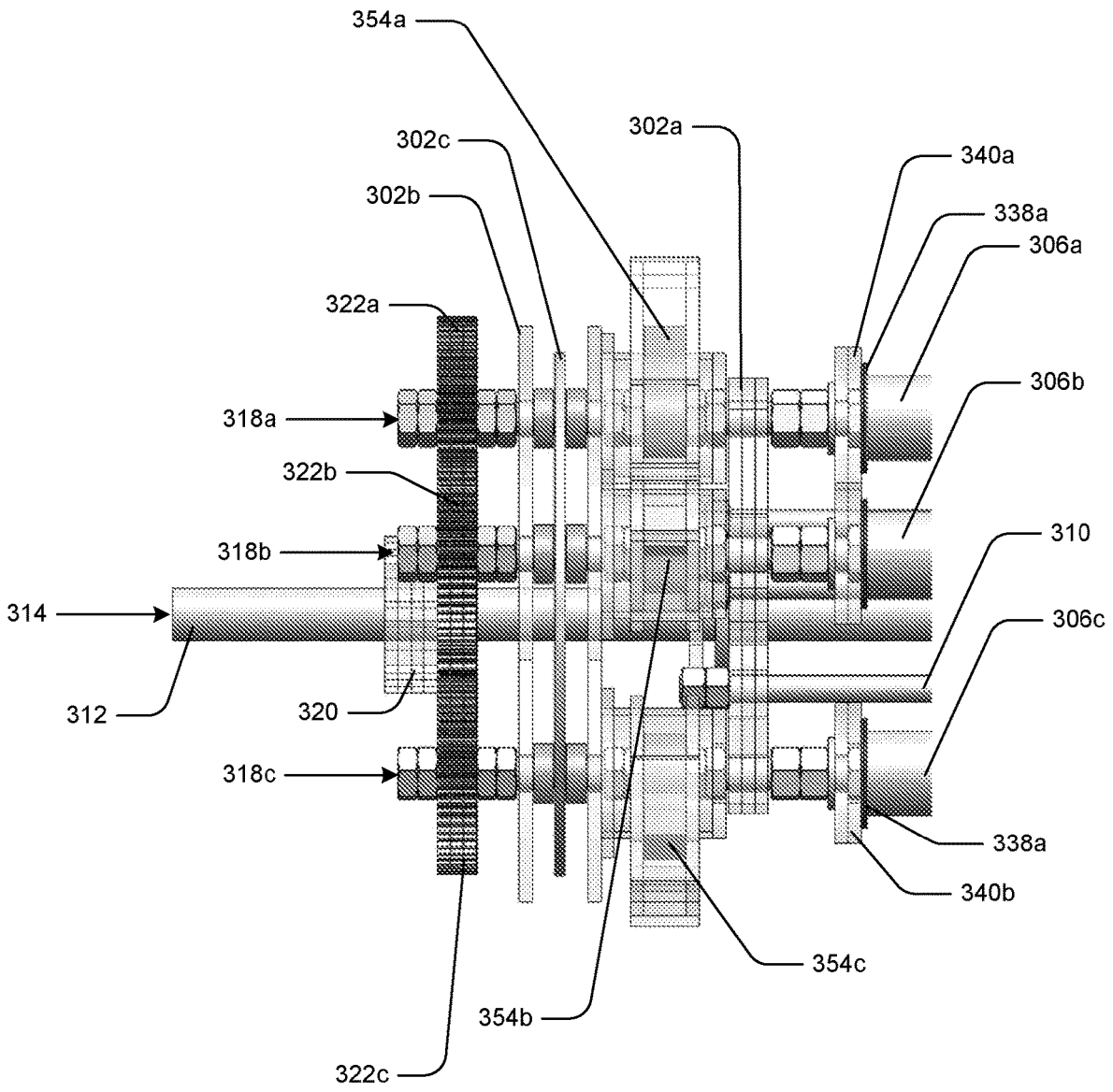
FIGS. 3A-3C are several views of an embodiment of a contact point assembly of an apparatus of the disclosure.
Figure 3B:
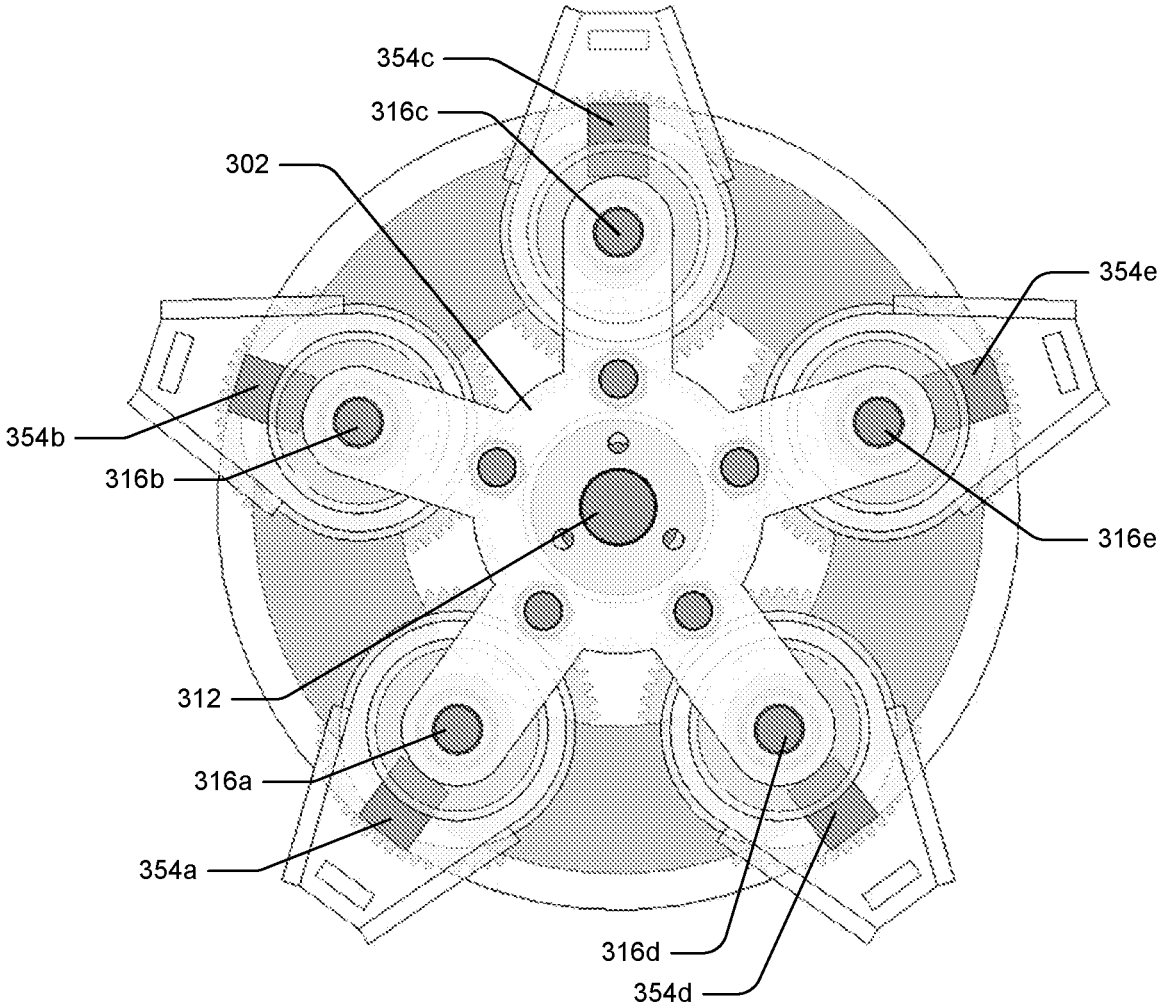
Figure 3C:
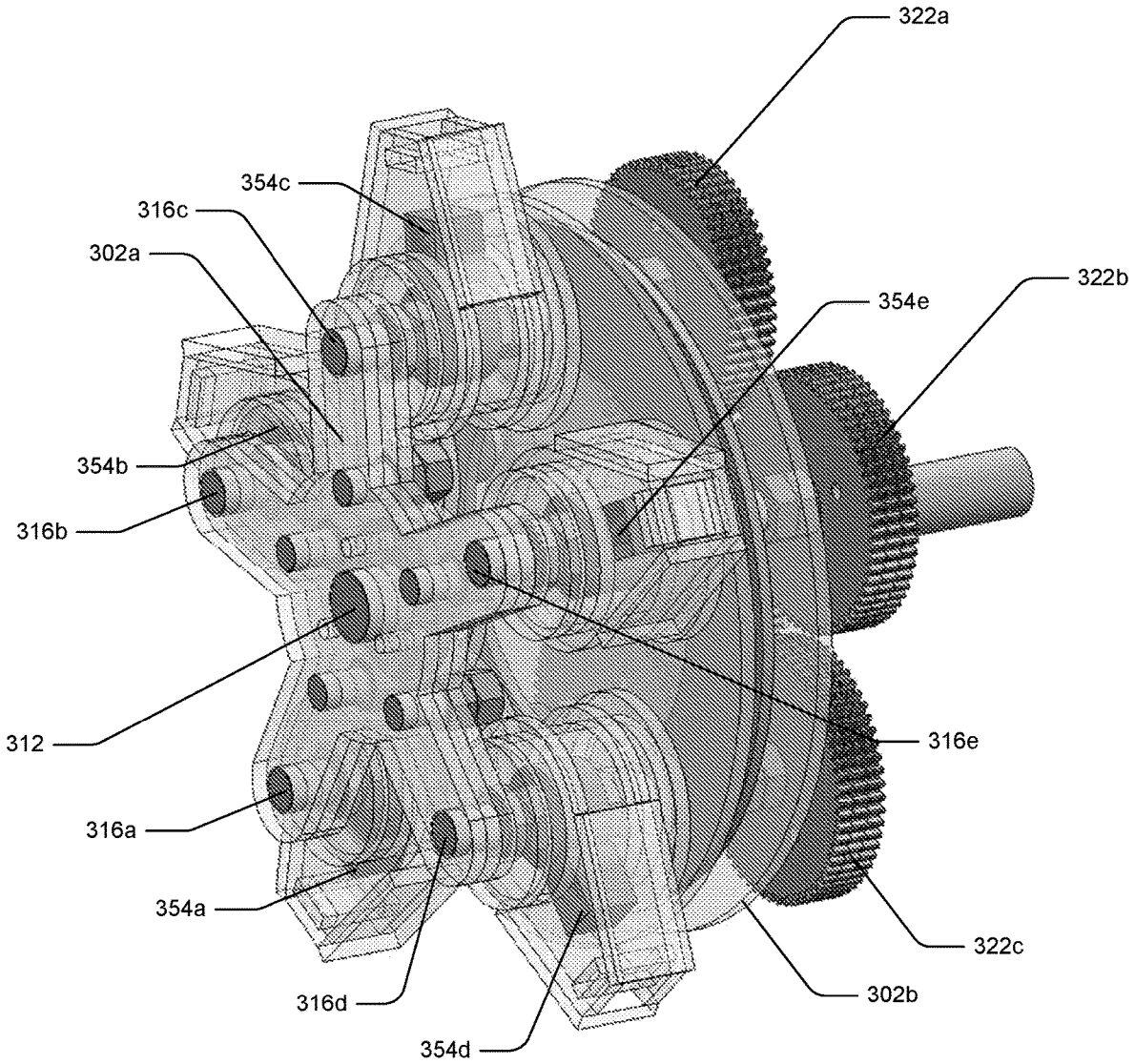

In embodiments, the racks further include a contact point assembly that, enables electrical contact with a workpiece. Several views of an embodiment of a contact point assembly are shown in FIGS. 3A-3C. In various embodiments, the contact point assembly rotates each workpiece around the respective longitudinal axis of the tubular workpiece or around an axis substantially parallel to the respective longitudinal axis.

In some embodiments, the contact point assembly comprises two or more peripheral rods 316*a*, 316*b*, 316*c* that are positioned around the rotational axis 314. In some embodiments, the two or more peripheral rods 316*a*, 316*b*, 316*c* are positioned substantially along the longitudinal axis 318*a*, 318*b*, 318*c*, or an axis substantially parallel to the longitudinal axis within the hollow cavity of one or more workpieces. In such embodiments, an inner surface of the workpieces may be coated at a separate time from (i.e., before or after) the outer surface. In some such embodiments, the peripheral rods have substantially the same diameter as the inner diameter of the workpiece(s) arranged on the respective peripheral rod.

In embodiments, at least a portion of the plurality of workpieces 106 (including individual workpieces 106*a*-1061) are arranged in series, as shown in FIG. 1C. In some embodiments, two or more workpieces are arranged on a peripheral rod. In some embodiments, a first end of a first workpiece is coupled to a first end of a second workpiece, a second end of the second workpiece is coupled to a first end of a third workpiece, and the like. In some such embodiments, at least three workpieces are serially coupled. In some embodiments, at least four workpieces are serially coupled. In some embodiments, at least five workpieces are serially coupled. In some embodiments, at least 10 workpieces are serially coupled. In some embodiments, at least 15 workpieces are serially coupled. In some embodiments, all of the plurality of workpieces are serially coupled.

In various embodiments, ends of respective workpieces are coupled by one or more couplers (including individual couplers 138*a*-138*k*). Couplers generally are cylindrical (e.g., tubular) structures. In embodiments, each coupler includes a first threaded portion and a second threaded portion that correspond to threaded portions of workpieces, such that a threaded portion of coupler may be joined to a threaded portion of a workpiece. In other embodiments, a coupler is joined to a workpiece in a manner other than corresponding threading. For example, a coupler may be welded, bonded, or fastened to the workpiece. In further embodiments, a coupler is joined to a workpiece by applying pressure such that the workpiece causes the coupler to deform, either plastically or elastically. In some such embodiments, the coupler is deformed to show, at least temporarily, an impression of the side profile of the workpiece. Thus, a seal is formed between a coupler and a workpiece. In such embodiments, the seal formed may be water tight, such that electrolyte solution is not able to reach the interior cavity of a tubular workpiece.

In some embodiments, a variety of couplers (i.e., two or more types) is used. For example, a first type of coupler 138*a*-138*k* may be used between individual workpieces that are joined in serial, and a second type of coupler 140*a*, 140*b* may be used at ends of the series of workpieces.

In various embodiments, couplers may be made of conductive or non-conductive material, with or without a conductive or non-conductive coating. In embodiments, a coupler experiences wear during an electrodeposition process, and therefore is sacrificial.

In some embodiments, workpieces coupled in a series each have a length ranging from about 0.1 m to about 1 m. In particular embodiments, workpieces coupled in a series each have a length ranging from about 0.1 m to about 0.5 m.

In some embodiments, the contact point assembly comprises one or more peripheral gears. As shown in FIG. 2, peripheral gears 222*a*-222*e* surround peripheral rods 216*a*-216*e*, respectively.

A peripheral gear may include a threaded portion. A threaded portion may be internally threaded or externally threaded. In some embodiments, a threaded portion of the peripheral gear corresponds to a threaded portion of a workpiece, such that a threaded portion of a peripheral gear and a threaded portion of a workpiece may be joined together. In other embodiments, a peripheral gear is not joined to a workpiece or coupler.

In further embodiments, a threaded portion of the peripheral gear corresponds to a threaded portion of a coupler.

In other embodiments, a peripheral gear is joined to a workpiece or coupler in a manner other than corresponding threading. For example, a peripheral gear may be welded, bonded, or fastened to a workpiece or coupler.

In some embodiments, a second peripheral gear is coupled to the opposite end of a workpiece or to the opposite end of a series of workpieces. A first and second peripheral gear may be coupled to a workpiece, or to a series of workpieces using a same manner (e.g., corresponding threading, welding, bonding, fastening, etc.) or a different manner.

In some embodiments, such as the embodiment shown in FIG. 2, a peripheral gear 222*a*-222*e* or central gear 220 is engaged by a motor (not shown) to rotate a workpiece. A peripheral gear of the present disclosure may be directly engaged by a motor to rotate a workpiece. In other embodiments, a central gear is directly engaged by a motor, the central gear then engaging with the peripheral gears, in order to rotate the plurality of workpieces.

In various embodiments, a contact point assembly comprises a plurality of peripheral gears. In embodiments, a peripheral gear is coupled to a peripheral rod. In some embodiments, the plurality of peripheral gears are coupled to the plurality of workpieces, respectively. In such embodiments, the plurality of peripheral gears may be engaged by a single motor to rotate the workpieces. In other embodiments, the plurality of peripheral gears may be engaged by two or more motors to rotate the workpieces. In some embodiments, the plurality of workpieces are rotated at a same speed. In other embodiments, individual workpieces of the plurality of workpieces are rotated at two or more speeds. In some embodiments, portions of the plurality of workpieces are rotated independently at different speeds.

A workpiece may be rotated (e.g. by a motor) around the longitudinal axis at an individual rotational speed ranging from about 0.5 revolutions per minute (rpm) to about 10 rpm. In embodiments, a workpiece is rotated (e.g., by a motor) around the longitudinal axis at an individual rotational speed ranging from about 0.5 rpm to about 3 rpm, about 1 rpm to about 4 rpm, about 2 rpm to about 5 rpm, about 3 rpm to about 6 rpm, about 4 rpm to about 7 rpm, about 5 rpm to about 8 rpm, about 6 rpm to about 9 rpm, or about 7 rpm to about 10 rpm. In some embodiments, a workpiece is rotated around the longitudinal axis at an individual rotational speed ranging from about 0.5 rpm to about 1 rpm, about 1 rpm to about 2 rpm, about 2 rpm to about 3 rpm, about 3 rpm to about 4 rpm, about 4 rpm to about 5 rpm, about 5 rpm to about 6 rpm, about 6 rpm to about 7 rpm, about 7 rpm to about 8 rpm, about 8 rpm to about 9 rpm, or about 9 rpm to about 10 rpm.

In use, a motor may be submerged in an electrolyte solution in a processing tank. In such embodiments, a motor may be housed in a suitable housing. In some embodiments, a housing is fabricated from a polymeric material (e.g., composite, thermoplastic, or thermoset) that is sealed (i.e., water tight).

An apparatus described herein may further comprise a pulley system to translate the motion from the motor to rotate the plurality of workpieces. In some such embodiments, the pulley system allows the motor to be positioned outside of an electrolyte bath, as shown in FIG. 9A. In some embodiments, at least a portion of a pulley system is housed in a suitable housing 968. In some embodiments, such a housing is sealed.

A motor controller may be used to control a motor. In some embodiments, a motor controller is used to start or stop the motor, or to vary a speed as desired. In some embodiments, a motor or motor controller is a part of an apparatus of the disclosure. In other embodiments, a motor or motor controller is separate from an apparatus of the disclosure.

An apparatus described herein may further include a gear box. Such a gear box may be in a same housing as a motor, or in a second housing. A motor of the present disclosure may connect to a first end of a gear box. In embodiments, a gear box is a right-angle (or 90 degree) gear drive that translates linear motion from a linear motor into rotary motion. A second end of a gear box may be connected to a gear 220.

An alternate embodiment of the present disclosure is shown in FIG. 7A, the support structure of the present disclosure comprises one or more guides 702*a*, 702*b*, which are used to arrange the plurality of workpieces 706 around the rotational axis. Guides may be made of any suitable materials. In embodiments, the material is non-conductive and inert when contacted with an electrolyte solution. For example, guides may be formed from an acrylic, delrin, or the like.

In embodiments, a plurality of workpieces is arranged substantially parallel to each other. In some embodiments, the plurality of workpieces is arranged in a polygonal configuration. In some embodiments, the polygon formed has three sides. In some embodiments, the polygon formed has four sides. In some embodiments, the polygon formed has five sides. In some embodiments, the polygon formed has six sides. In embodiments, the plurality of workpieces is spaced such that the individual workpieces do not make physical contact. In embodiments, the plurality of workpieces are spaced such that the distance between the individual workpieces is at least about the same as the outer diameter of a workpiece.

Figure 10:
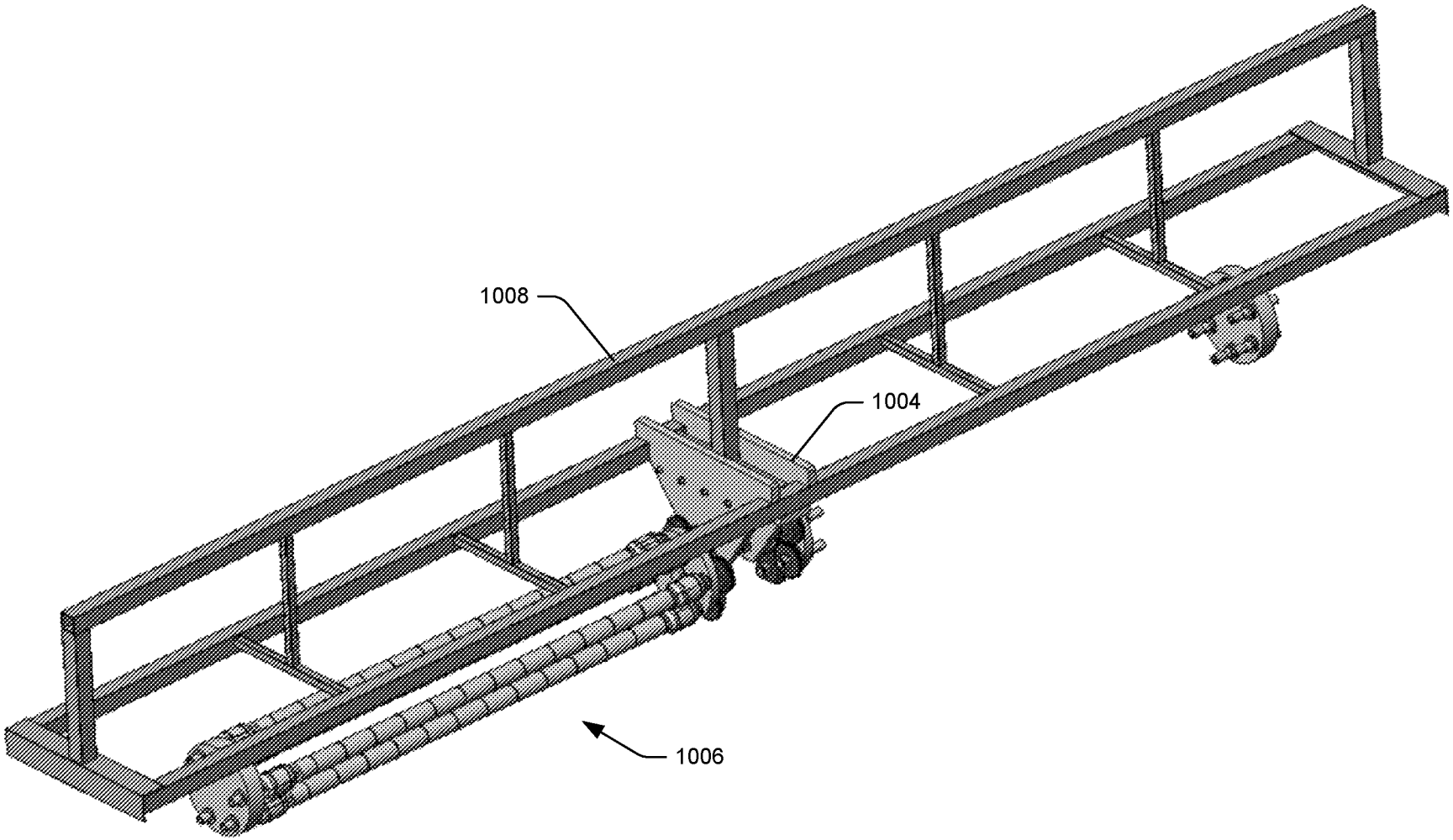
FIG. 10 is a view of an embodiment of an electrodeposition apparatus of the disclosure.

In some embodiments, the support structure 1004 supports a plurality of workpieces 1006 that are arranged in a planar configuration, as shown in FIG. 10. In other words, two of the workpieces are arranged next to each other in a line, such that first ends of the workpieces are aligned, second ends of the workpieces are aligned, and midpoints of the workpieces are aligned. In some such embodiments, the rotational axis may be a longitudinal axis of one of the workpieces.

In embodiments, the at least one support structure of the present disclosure comprises a support member 1004 that supports the plurality of workpieces 1006 during the electrodeposition process. In some embodiments, the support member(s) 1004 couple to a rack 1008. In some embodiments, the support member(s) 1004 are integrated with a rack.

Additionally, support members 804 and/or rack 808 may have attachments 862 that allow a support member 804 and/or rack 808 to be coupled to (e.g., suspended from) an overhead gantry or gantry system that allows the plurality of workpieces to be transported between processing tanks, holding areas, storage areas, and the like, as shown in FIG. 8. Alternatively, support members 804 and/or rack 808 may have attachments that allow a support member to be coupled to (e.g., supported by) a vehicle such as, a trolley or a tractor, in order to facilitate transport. In some embodiments, a gantry system or a vehicle is automated. In some embodiments, a gantry crane or vehicle is coupled to a rack during an electrodeposition process. In other embodiments, a gantry crane or a vehicle releases the support member(s) during an electrodeposition process. In further embodiments, a same gantry crane or vehicle re-couples with the support member(s) after completion. In other embodiments, a different gantry crane or vehicle may couple with the support member(s) after completion.

Returning to FIG. 7A, in some embodiments, an apparatus includes two or more support members that are not physically connected together. In embodiments, support member 704 is configurable to support workpieces 706 of various lengths. In some embodiments, support member 704 supports a workpieces 706 with a length ranging from about 0.1 meters (m) to 15 m. In further embodiments, support member 104 supports a workpieces 106 that has a length ranging from about 0.10 m to about 0.15 m; from about 0.10 m to about 0.5 m; from about 0.10 m to about 1.0 m; from about 0.10 m to about 0.4 m; from about 0.10 m to about 1.51 m; from about 0.10 m to about 10.7 m; from about 0.10 m to about 13.8 m; from about 0.15 m to about 0.4 m; from about 0.15 m to about 1.51 m; from about 0.15 m to about 10.7 m; from about 0.15 m to about 13.8 m; from about 0.3 m to about 0.7 m; from about 0.6 m to about 1.51 m; from about 1 m to about 2 m; from about 1 m to about 5 m; from about 1 m to about 14.5 m; from about 1.5 m to about 3.1 m; from about 1.5 m to about 6.1 m; from about 2 m to about 3 m; from about 3 m to about 4 m; from about 3 m to about 4.6 m; from about 4 m to about 5 m; from about 4.5 m to about 6.1 m; from about 5 m to about 6 m; from about 5 m to about 10 m; from about 5 m to about 14.5 m; from about 6 m to about 7 m; from about 6 m to about 7.7 m; from about 6 m to about 11 m; from about 7 m to about 8 m; from about 7.6 m to about 9.2 m; from about 8 m to about 9 m; from about 9 m to about 10 m; from about 9.1 m to about 10.7 m; from about 10 m to about 11 m; from about 10 m to about 14.5 m; from about 10.6 m to about 12.2 m; from about 10.6 m to about 13.8 m; from about 11 m to about 12 m; from about 12 m to about 13 m; from about 12.1 m to about 13.8 m; from about 13 m to about 13.5 m; from about 13.5 m to about 14 m; or from about 14 m to about 14.5 m.

In embodiments, the support structures are designed to support a plurality of workpieces where each of the workpieces has substantially the same length, substantially the same outer diameter, substantially the same inner diameter, or a combination thereof.

In other embodiments, support member 704 is configured to accommodate workpieces 706 with a fixed length ranging from about 0.1 m to 15 m. In embodiments, support member 704 support workpieces 706 with a length of about 0.15 m, about 0.3 m, about 0.4 m, about 0.6 m, about 0.7 m, about 1 m, about 1.5 m, about 2 m, about 3 m, about 4 m, about 5 m, about 6 m, about 7 m, about 8 m, about 9 m, about 10 m, about 11 m, about 12 m, about 13 m, about 14 m, or about 15 m.

In some embodiments, additional support members are added to the rack in order to provide additional support for the workpieces. In further embodiments, additional support members are generally added at or near a mid-point of the workpiece arrangements.

Support structures of the present disclosure may hold workpieces 706 such that a longitudinal axis 718*a*-718*f* of the workpieces (indicated by dashed lines) is substantially horizontal. In other embodiments, support structures hold workpieces such that the longitudinal axis is at an incline ranging from about 0.5 degrees to about 2.5 degrees relative to horizontal. In some embodiments, support structures hold a workpieces 706 such that a longitudinal axis is at an incline ranging from about 0.5 degrees to about 1 degree; from about 1 degree to about 1.5 degrees; from about 1.5 degrees to about 2 degrees; or from about 2 degrees to about 2.5 degrees.

Support structures of the present disclosure may hold workpieces 706 such that the rotational axis of the plurality of workpieces is substantially horizontal. In other embodiments, support structures hold the workpieces such that a rotational axis is at an incline ranging from about 0.5 degrees to about 2.5 degrees relative to horizontal. In some embodiments, support structures hold workpieces 706 such that the rotational axis is at an incline ranging from about 0.5 degrees to about 1 degree; from about 1 degree to about 1.5 degrees; from about 1.5 degrees to about 2 degrees; or from about 2 degrees to about 2.5 degrees.

In embodiments, support structures may further comprise one or more support rods. Such support rods may be coupled to other support structures, such as guides. In embodiments, such support rods are positioned in order to prevent flexing in the apparatus. In some embodiments, at least two support rods are present. In some embodiments, at least three support rods are present. In some embodiments, at least four support rods are present. In some embodiments, at least five support rods are present. Such support rods are generally centered around the rotational axis 714 (indicated by the dotted line).

Support structures may be fabricated from a non-conductive material such as, polyvinylchloride (PVC), polyethylene (e.g. high density polyethylene (HDPE), acrylonitrile butadiene styrene (ABS), polypropylene (PP), or any combination thereof. In some embodiments, a support structure is made of a conductive material. In some embodiments, a support structure is made of a conductive material or a non-conductive material may be coated with a non-conductive coating such as, PVC, polyethylene, polycarbonate, polyurethane, synthetic rubber, acrylic, or any combination thereof.

An apparatus of the present disclosure further comprises a drive assembly that rotates the plurality of workpieces 706 around the rotational axis 714. Accordingly, in embodiments, an apparatus of the present disclosure comprises at least one support structure configured to support a plurality of workpieces around a rotational axis, each workpiece of the plurality of workpieces having a substantially cylindrical shape with an outer surface and a longitudinal axis; and a drive assembly configured to rotate the plurality of workpieces around the rotational axis.

In embodiments, a drive assembly comprises a central rod that is aligned along the rotational axis 714. In embodiments, a central rod is made of a suitable non-conductive material (e.g., a plastic or a polymeric material, such as a composite material). In embodiments, a central rod is made of a conductive (or a non-conductive) material that is coated with a suitable non-conductive coating (e.g., a plastic or a polymeric material, such as a composite material) using methods known in the art, such as via shrink wrapping, dip coating, painting, and the like. Suitable non-conductive materials or coatings are chosen based on the chemistry of the electrolyte bath, such that the material or coating does not contaminate an electrolyte solution. In other embodiments, a central rod is made of a suitable conductive material.

Figure 7B:
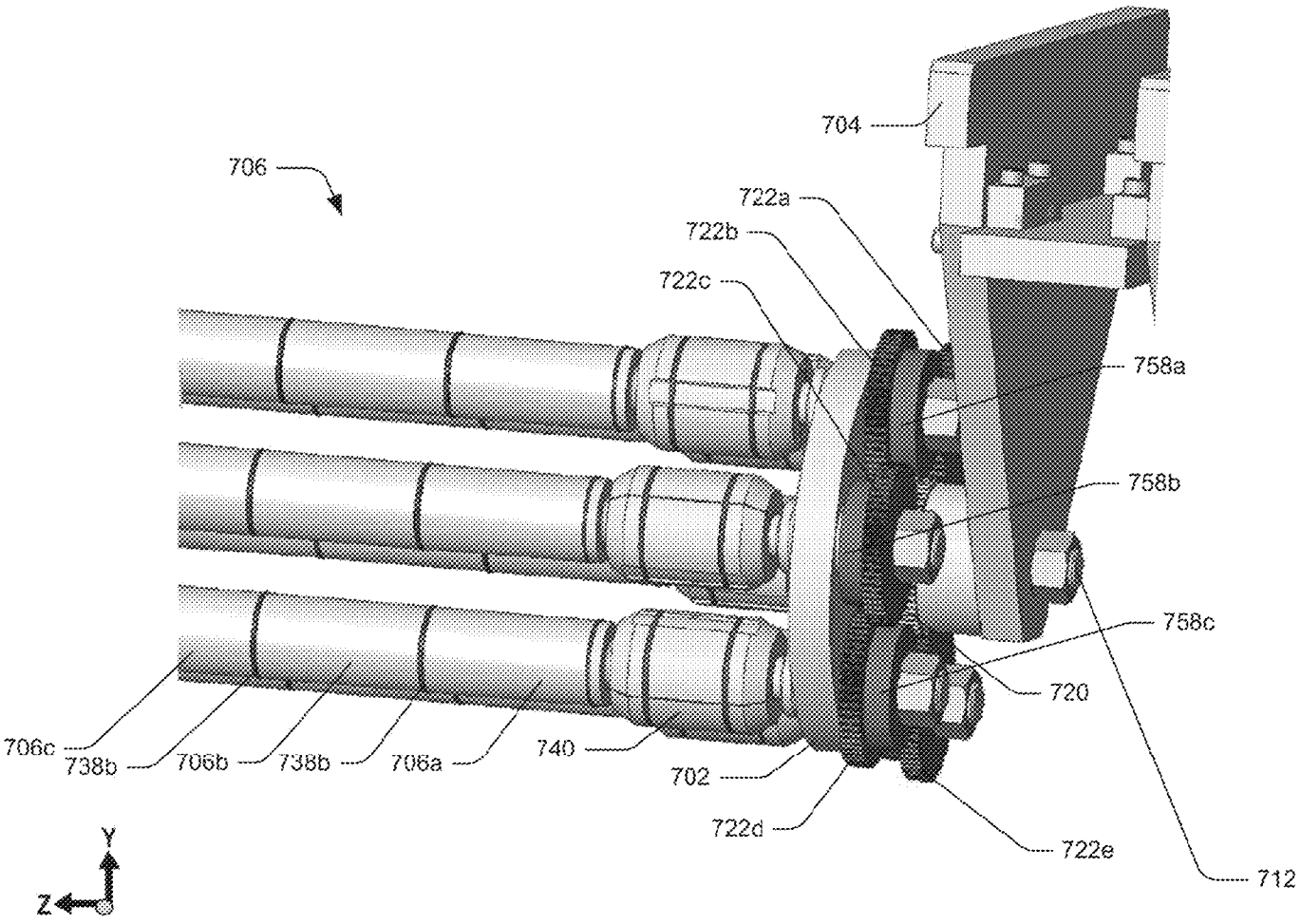

In embodiments, a central rod does not span the distance between two support structures, or between two guides. For example, as shown in FIG. 7B, central rod 712 extends through an opening in support member 704, but does not reach a second support member. In some embodiments, a central rod 712 is attached to a guide 702.

In embodiments, a drive assembly comprises one or more central gears 720, as shown in FIG. 7B. In some embodiments, a central rod 712 is integrated with a guide 702. In some embodiments, a central rod 712 is attached to a central gear 720. In some embodiments, a central rod 712 is integrated with a central gear 720. Although not necessary, central gears 720 may be arranged near (e.g., adjacent to) a guide 702. In some embodiments, a central gear 720 is attached to a guide 702. In other embodiments, a central gear 720 is integrated with a guide 702.

In some embodiments, a central gear 720 is engaged by a motor to rotate a plurality of workpieces around a rotational axis. In use, a motor may be submerged in an electrolyte solution in a processing tank. In such embodiments, a motor may be housed in a suitable housing. In some embodiments, a housing is fabricated from a polymeric material (e.g., composite, thermoplastic, or thermoset) that is sealed (i.e., water tight).

In other embodiments, a motor 964 may, in use, be maintained outside of the electrolyte solution, as shown in FIG. 9. In such embodiments, a pulley system 966 may be arranged to translate the motion (e.g., linear motion) from the motor to the drive assembly. In embodiments, a pulley maybe implemented in the form of a gear and a chain.

A motor controller may be used to control a motor. In some embodiments, a motor controller is used to start or stop the motor, or to vary a speed as desired. In some embodiments, a motor or motor controller is a part of an apparatus of the disclosure. In other embodiments, a motor or motor controller is separate from an apparatus of the disclosure.

A plurality of workpieces may be rotated (e.g. by a motor) around the rotational axis at a rotational speed ranging from about 0.5 revolutions per minute (rpm) to about 10 rpm. In embodiments, a plurality of workpieces is rotated (e.g., by a motor) around the rotational axis at a rotational speed ranging from about 0.5 rpm to about 3 rpm, about 1 rpm to about 4 rpm, about 2 rpm to about 5 rpm, about 3 rpm to about 6 rpm, about 4 rpm to about 7 rpm, about 5 rpm to about 8 rpm, about 6 rpm to about 9 rpm, or about 7 rpm to about 10 rpm. In some embodiments, a plurality of workpieces is rotated (e.g., by a motor) around the rotational axis at a rotational speed ranging from about 0.5 rpm to about 1 rpm, about 1 rpm to about 2 rpm, about 2 rpm to about 3 rpm, about 3 rpm to about 4 rpm, about 4 rpm to about 5 rpm, about 5 rpm to about 6 rpm, about 6 rpm to about 7 rpm, about 7 rpm to about 8 rpm, about 8 rpm to about 9 rpm, or about 9 rpm to about 10 rpm.

An apparatus described herein may further include a gear box. Such a gear box may be in a same housing as a motor, or in a second housing. A motor of the present disclosure may connect to a first end of a gear box. In embodiments, a gear box is a right-angle (or 90 degree) gear drive that translates linear motion from a linear motor into rotary motion. A second end of a gear box may be connected to a central gear 720.

Additionally, an apparatus of the present disclosure may further include one or more bearings that rotate as the plurality of workpieces rotate around the rotational axis. Such bearings may support the plurality of workpieces at any suitable position, such as at a coupler, at the central rod, or the like.

In embodiments, a rack further includes a contact point assembly that, enables electrical contact with a workpiece. In various embodiments, the contact point assembly rotates each workpiece around the respective longitudinal axis of the tubular workpiece or around an axis substantially parallel to the respective longitudinal axis.

Figure 7C:
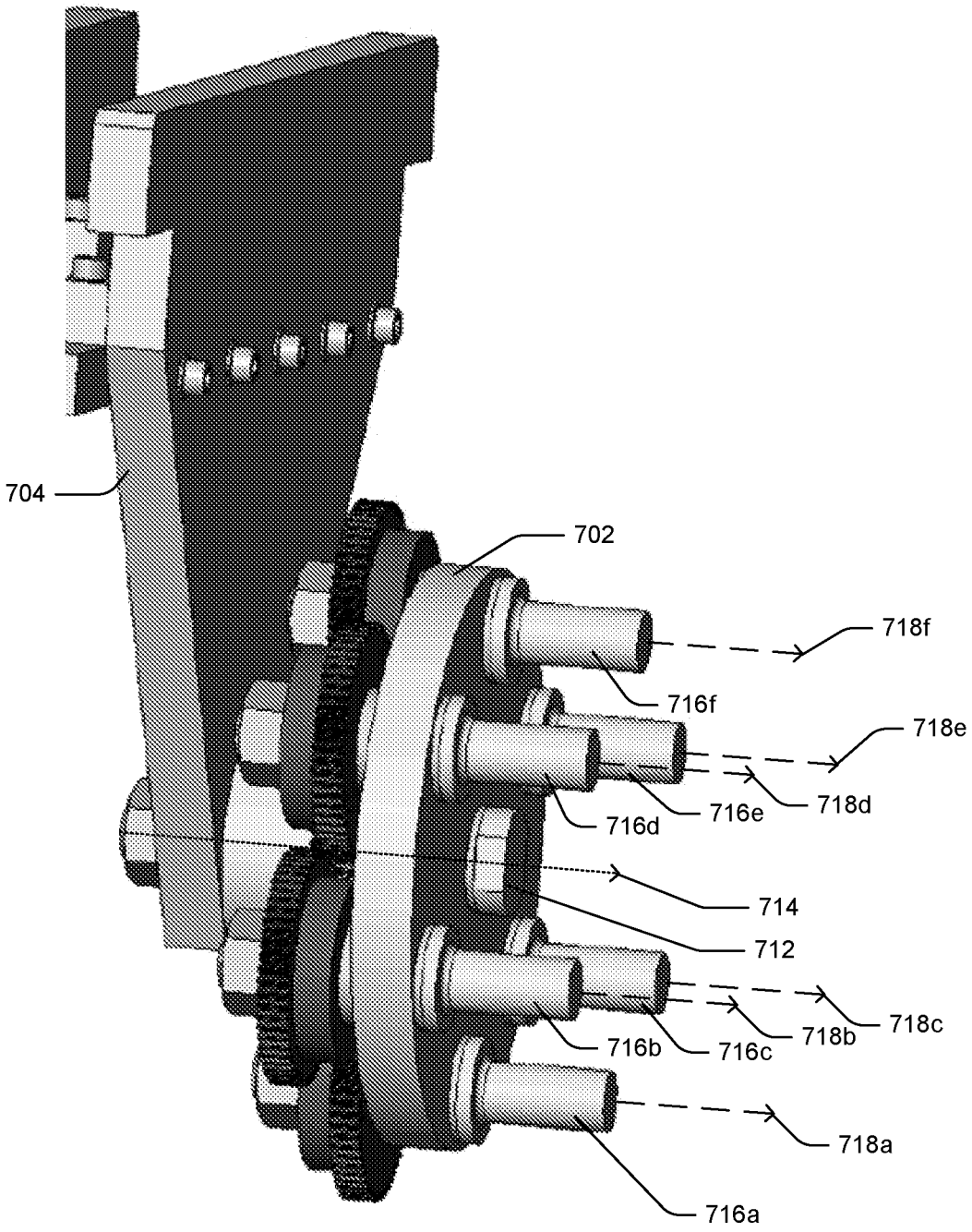
Figure 7D:
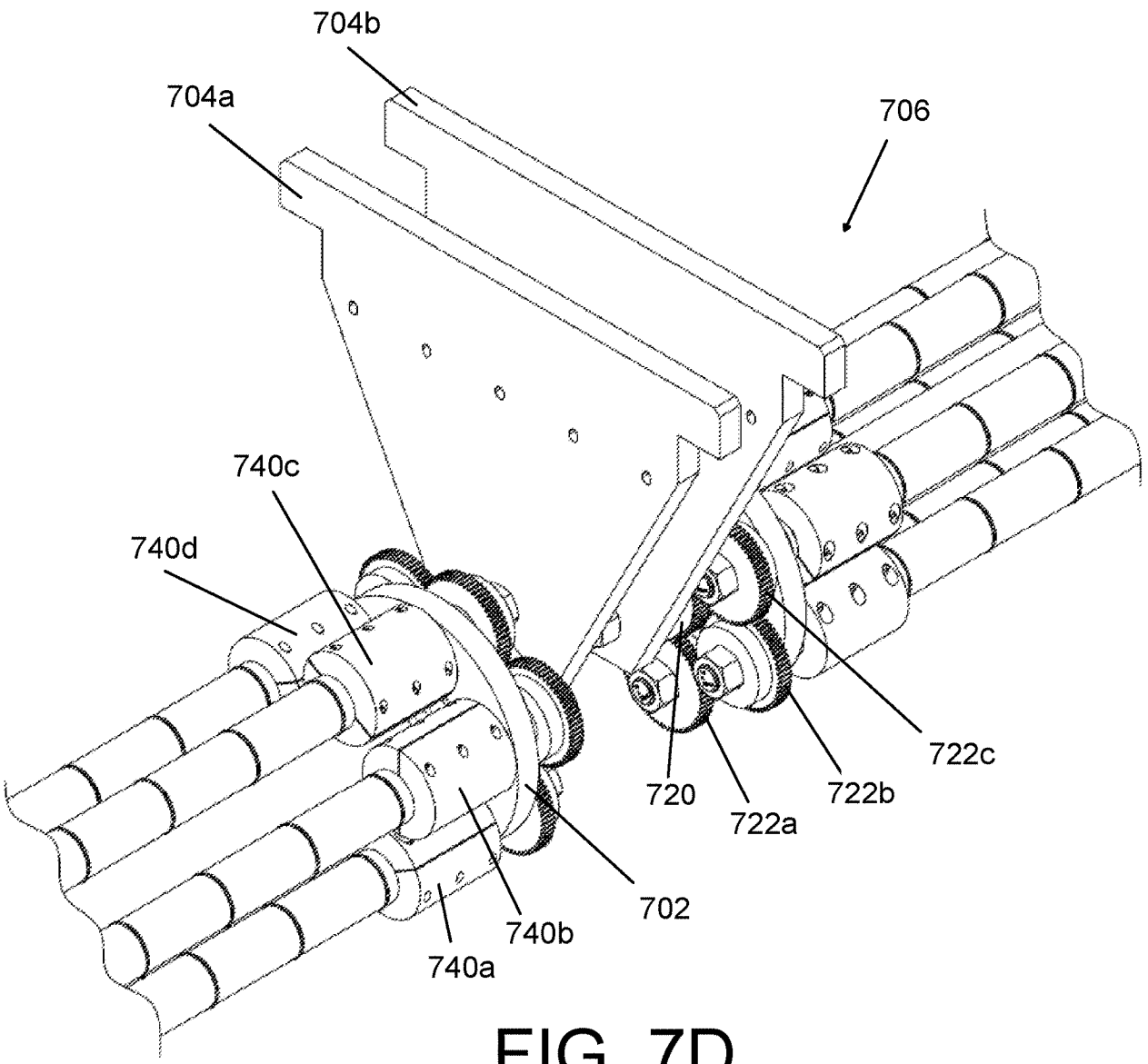

In some embodiments, the contact point assembly comprises two or more peripheral rods 716*a*-716*f* that are positioned around the rotational axis 714. In some embodiments, the two or more peripheral rods 716*a*-716*f* are positioned substantially along the longitudinal axis 718*a*-718*f*, or an axis substantially parallel to the longitudinal axis within the hollow cavity of one or more workpieces. In embodiments, a peripheral rod does not extend between two support structures, or between two guides. For example, as shown in FIG. 7C, peripheral rods 716*a*-716*f* extend through an opening in guide 702. In such embodiments, peripheral rod 716 may extend partially though a coupler 740, but not extend through the entire length of a coupler 740. In some embodiments, peripheral rod 716 extends partially though a workpiece 706, but does not extend through the entire length of a workpiece 706. In some embodiments, a peripheral rod 716 is attached to a guide 702. In some embodiments, a peripheral rod 716 is integrated with a guide 702. In some embodiments, a peripheral rod 716 is attached to a central gear 720. In some embodiments, a peripheral rod 716 is integrated with a central gear 720.

In embodiments, outer surfaces of the workpieces 706 are coated. In embodiments, inner surfaces of the workpieces are also coated. In some embodiments, the inner surfaces are coated at a separate time from (i.e., before or after) the outer surfaces. In some such embodiments, the peripheral rods have substantially the same diameter as the inner diameter of the workpiece(s) arranged on the respective peripheral rod. In some embodiments, an inner surface of the workpiece is not coated.

In embodiments, at least a portion of the plurality of workpieces 706 (including individual workpieces 706*a*, 706*b*, 706*c* in FIG. 7B) are arranged in series, as shown, e.g., in FIG. 7A and FIG. 7B. In embodiments, a first end of a first workpiece 706*a* is coupled to a first end of a second workpiece 706*b*, a second end of the second workpiece is coupled to a first end of a third workpiece 706*c*, and the like. In some such embodiments, at least three workpieces are serially coupled. In some embodiments, at least four workpieces are serially coupled. In some embodiments, at least five workpieces are serially coupled. In some embodiments, at least 10 workpieces are serially coupled. In some embodiments, at least 15 workpieces are serially coupled. In some embodiments, all of the plurality of workpieces are serially coupled.

In various embodiments, ends of respective workpieces are coupled by one or more couplers (including individual couplers 738*a*, 738*b*). Couplers generally are cylindrical (e.g., tubular) structures. In embodiments, each coupler includes a first and second portion that are separated by a third portion that has a wider diameter than the first and second portion, such that a first workpiece can be arranged over the first portion of the coupler and a second workpiece can be arranged over the second portion of the coupler. By way of example, a coupler may be substantially shaped as a barb coupling and a workpiece may be shaped as a slip fitting.

In other embodiments, each coupler includes a first threaded portion and a second threaded portion that correspond to threaded portions of workpieces, such that a threaded portion of coupler may be joined to a threaded portion of a workpiece. In other embodiments, a coupler is joined to a workpiece in a manner other than corresponding threading. For example, a coupler may be welded, bonded, or fastened to the workpiece.

In further embodiments, a coupler is joined to a workpiece by applying pressure such that the workpiece causes the coupler to deform, either plastically or elastically. In some such embodiments, the coupler is deformed to show, at least temporarily, an impression of the side profile of the workpiece. Thus, a seal is formed between a coupler and a workpiece. In such embodiments, the seal formed may be water tight, such that electrolyte solution is not able to reach the interior cavity of a tubular workpiece. In some embodiments, a coupler includes one or more gaskets that deform when pressure is applied to join a workpiece and a coupler.

In some embodiments, a variety of couplers (i.e., two or more types) is used. For example, a first type of coupler 738*a*-738*c* may be used between individual workpieces that are joined in serial, and a second type of coupler 740 may be used at ends of the series of workpieces.

In various embodiments, couplers may be made of conductive or non-conductive material, with or without a conductive or non-conductive coating. In embodiments, a coupler experiences wear during an electrodeposition process, and therefore is sacrificial.

In embodiments, coupler 738 is made of a conductive material and includes a gasket of non-conductive material. Any suitable non-conductive material may be used to form such a gasket. For example, a suitable material is a synthetic rubber. In embodiments, a fluoropolymer elastomer (e.g., Viton), a thermoplastic vulcanizate (e.g., Santoprene™), or the like is used.

In some embodiments, coupler 740 is made of a conductive material housed in a non-conductive material. In some embodiments, coupler 740 contacts a peripheral rod 716 and/or is coupled to a peripheral rod. In some embodiments, a coupler 740 is integrated with a peripheral rod 716. In some embodiments, coupler 740 acts as a housing to peripheral rod 716. In some embodiments, coupler 740 acts as shielding to the conductive material of peripheral rod 716. A non-conductive portion of a coupler 740 may be of any suitable material (e.g., acrylic, delrin). In embodiments, the material is non-conductive and inert when contacted with an electrolyte solution.

In some embodiments, coupler 740 includes a spring loaded mechanism, similar to a mechanism in a spring tension rod, which allows workpieces 706 and couplers 738 to be maintained in a configuration due to tension. In other words, coupler 740 may include a mechanism that can be compressed to allow positioning of the series of workpieces, and, once released, can maintain the configuration by tension.

In some embodiments where coupler 738 and coupler 740 are not threaded, there is no need to use silicon grease. As silicon grease contributes to build-up in a processing tank causing the tanks to need cleaning more frequently, this represents a further improvement.

In some embodiments, workpieces coupled in a series each have a length ranging from about 0.1 m to about 1 m. In particular embodiments, workpieces coupled in a series each have a length ranging from about 0.1 m to about 0.5 m.

In some embodiments, the contact point assembly comprises one or more peripheral gears 722*a*-722*e*. As shown in FIG. 7B, teeth of peripheral gears 722*a*-722*e* mesh with teeth of central gear 720. In some embodiments, individual peripheral gears are offset from at least one other peripheral gear such that the teeth of adjacent gears do not mesh, as shown in FIG. 7B. In some embodiments, such an offset is achieved with spacers 758*a*-758*c*. In other embodiments, teeth of peripheral gears 722*a*-722*e* are engaged with other peripheral gears.

A peripheral gear may include a threaded portion. A threaded portion may be internally threaded or externally threaded. In some embodiments, a threaded portion of the peripheral gear corresponds to a threaded portion of a workpiece, such that a threaded portion of a peripheral gear and a threaded portion of a workpiece may be joined together. In embodiments, a peripheral gear is not joined to a workpiece or coupler.

In further embodiments, a threaded portion of the peripheral gear corresponds to a threaded portion of a coupler.

In other embodiments, a peripheral gear is joined to a workpiece or coupler in a manner other than corresponding threading. For example, a peripheral gear may be welded, bonded, or fastened to a workpiece or coupler.

In some embodiments, a second peripheral gear is coupled to the opposite end of a workpiece or to the opposite end of a series of workpieces. A first and second peripheral gear may be coupled to a workpiece, or to a series of workpieces using a same manner (e.g., corresponding threading, welding, bonding, fastening, etc.) or a different manner.

In embodiments, central gear 720 and peripheral gears 722*a*-722*e* are driven. In some embodiments, a peripheral gear 722*a*-722*e* or central gear 720 is engaged by a motor (not shown) to rotate a workpiece. A peripheral gear of the present disclosure may be directly engaged by a motor to rotate a workpiece. In other embodiments, a central gear is directly engaged by a motor, the central gear then engaging with the peripheral gears, in order to rotate the plurality of workpieces. Spacers 758, central gears 720, peripheral gears 722, or a combination thereof may be of any suitable material. In embodiments, the material is non-conductive (e.g., acrylic, delrin). In some embodiments, the material is inert when contacted with an electrolyte solution.

In various embodiments, a contact point assembly comprises a plurality of peripheral gears. In embodiments, a peripheral gear is coupled to a peripheral rod. In some embodiments, the plurality of peripheral gears are coupled to the plurality of workpieces, respectively. In such embodiments, the plurality of peripheral gears may be engaged by a single motor to rotate the workpieces. In other embodiments, the plurality of peripheral gears may be engaged by two or more motors to rotate the workpieces. In some embodiments, the plurality of workpieces are rotated at a same speed. In other embodiments, individual workpieces of the plurality of workpieces are rotated at two or more speeds. In some embodiments, portions of the plurality of workpieces are rotated independently at different speeds.

A workpiece may be rotated (e.g. by a motor) around the longitudinal axis at an individual rotational speed ranging from about 0.5 revolutions per minute (rpm) to about 10 rpm. In embodiments, a workpiece is rotated (e.g., by a motor) around the longitudinal axis at an individual rotational speed ranging from about 0.5 rpm to about 3 rpm, about 1 rpm to about 4 rpm, about 2 rpm to about 5 rpm, about 3 rpm to about 6 rpm, about 4 rpm to about 7 rpm, about 5 rpm to about 8 rpm, about 6 rpm to about 9 rpm, or about 7 rpm to about 10 rpm. In some embodiments, a workpiece is rotated around the longitudinal axis at an individual rotational speed ranging from about 0.5 rpm to about 1 rpm, about 1 rpm to about 2 rpm, about 2 rpm to about 3 rpm, about 3 rpm to about 4 rpm, about 4 rpm to about 5 rpm, about 5 rpm to about 6 rpm, about 6 rpm to about 7 rpm, about 7 rpm to about 8 rpm, about 8 rpm to about 9 rpm, or about 9 rpm to about 10 rpm.

In use, a motor may be submerged in an electrolyte solution in a processing tank. In embodiments, a motor may be housed in a suitable housing. In some embodiments, a housing is fabricated from a polymeric material (e.g., composite, thermoplastic, or thermoset) that is sealed (i.e., water tight).

An apparatus described herein may further comprise a pulley system to translate the motion from the motor to rotate the plurality of workpieces, as shown in FIG. 9A. In some such embodiments, the pulley system 966 allows the motor to be positioned outside of an electrolyte bath, as shown in FIG. 9A. In some such embodiments, at least a portion of the pulley system is housed in a suitable housing 968. In some embodiments, such a housing is sealed.

An apparatus described herein may further include a gear box. Such a gear box may be in a same housing as a motor, or in a second housing. A motor of the present disclosure may connect to a first end of a gear box. In embodiments, a gear box is a right-angle (or 90 degree) gear drive that translates linear motion from a linear motor into rotary motion. A second end of a gear box may be connected to a gear.

Figure 9B:
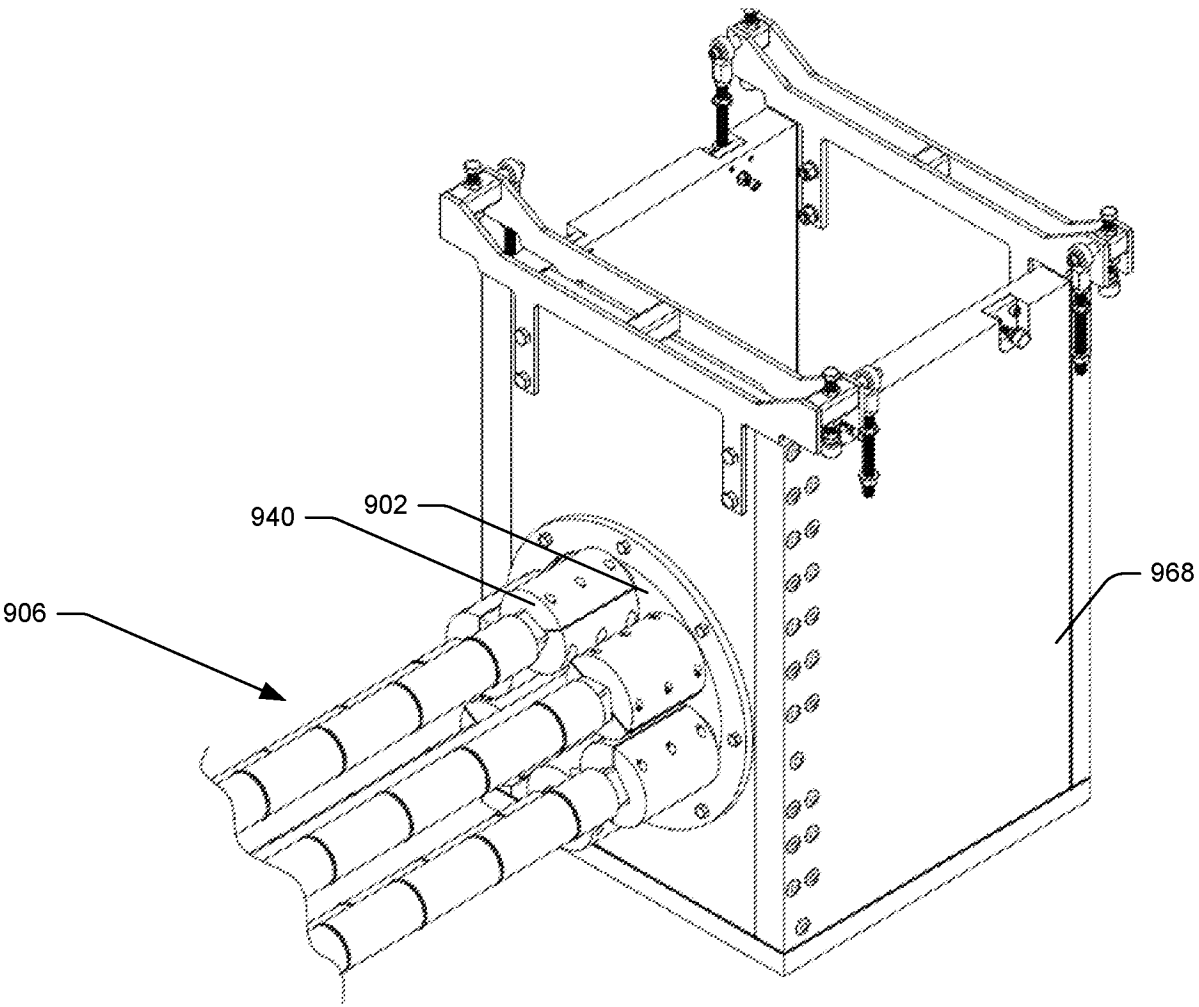

As shown in FIG. 9B, guide 902 may be coupled to housing 968. In such embodiments, guide 902 is rotatably coupled to housing 968. In some embodiments, a bearing assembly allows guide 902 to rotate relative to housing 968. In some embodiments, couplers 940 are coupled to housing 968.

Figure 4A:
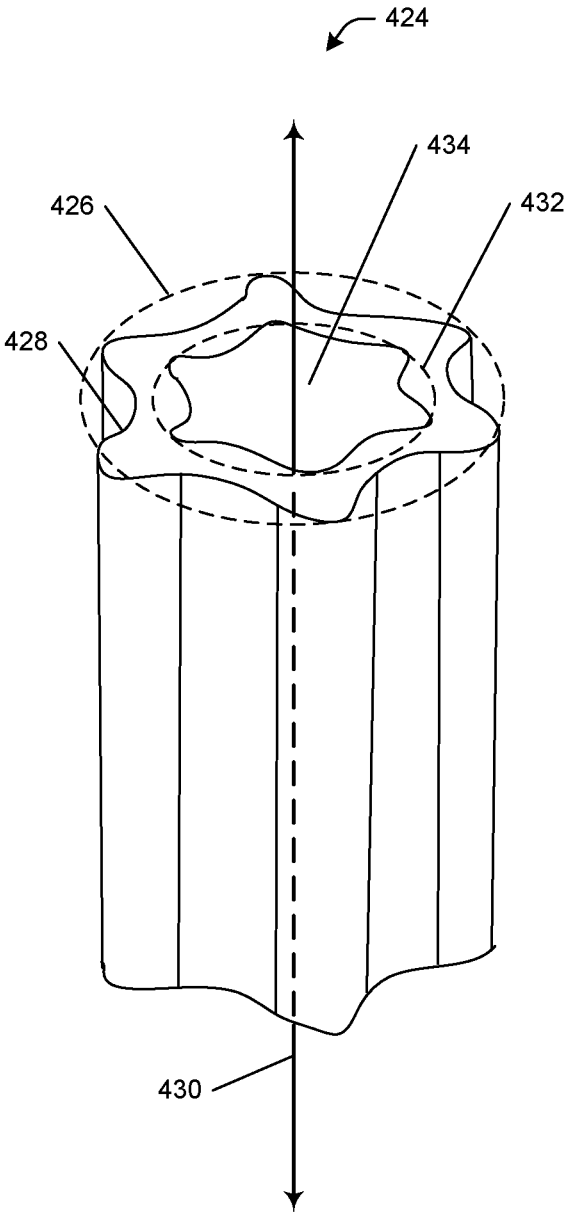
FIGS. 4A-4C are illustrative embodiments of anodes of the present disclosure.
Figure 4B:
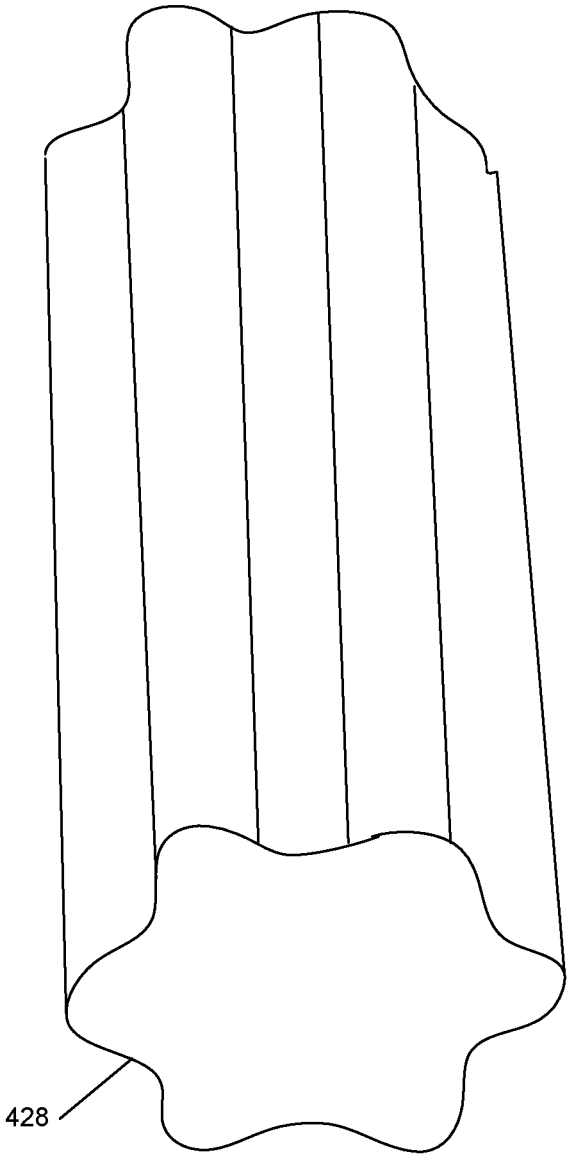
Figure 4C:
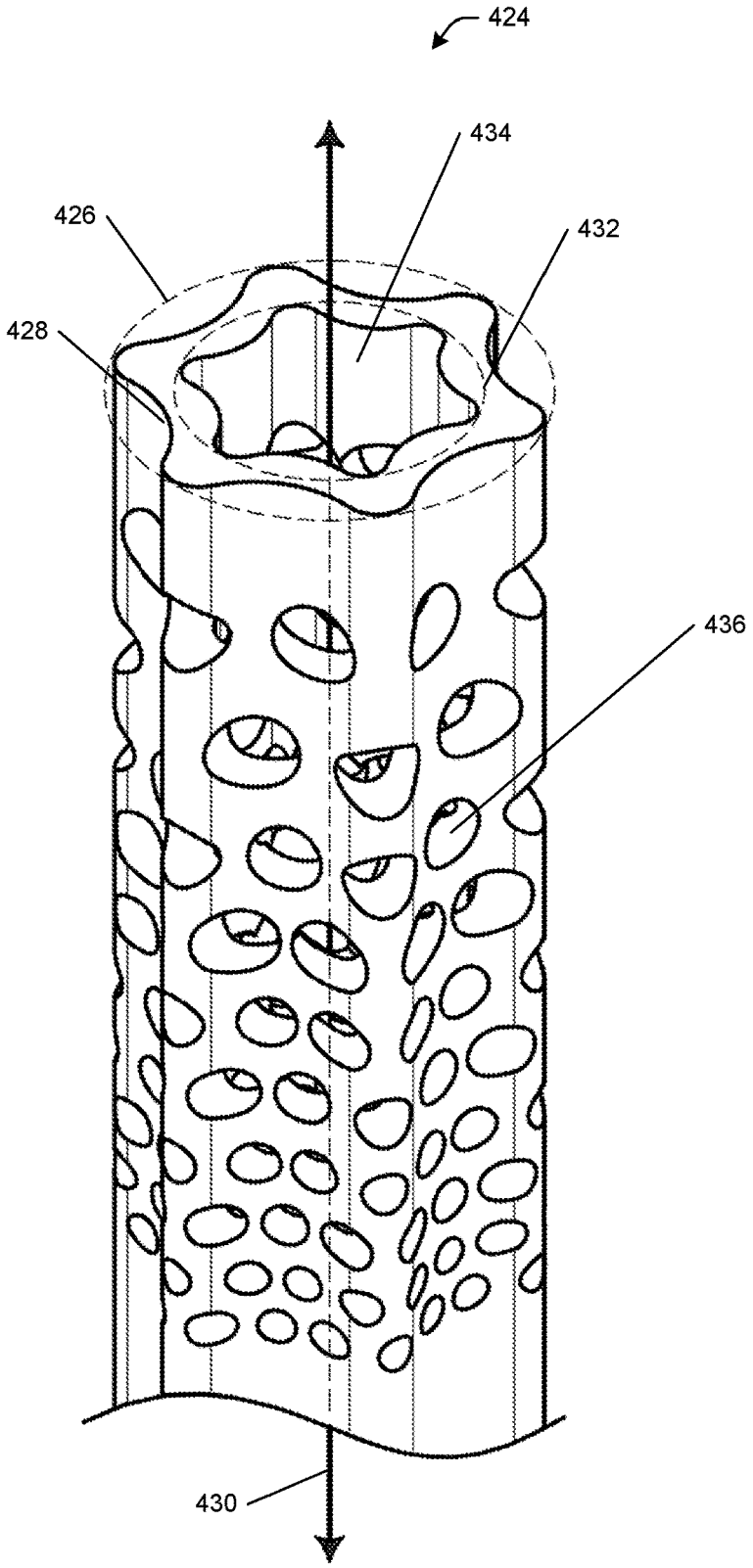

A motor controller may be used to control a motor. In some embodiments, a motor controller is used to start or stop the motor, or to vary a speed as desired. In some embodiments, a motor or motor controller is a part of an apparatus of the disclosure. In other embodiments, a motor or motor controller is separate from an apparatus of the disclosure. Any of the apparatuses of the present disclosure may further include an interior anode 424, examples of which are shown in FIGS. 4A-4C. Anodes of the present disclosure are substantially cylindrical, and generally made of a metal. An anode is an "interior" anode if it is positioned at least partially within a hollow cavity of a tubular workpiece. An interior anode generally is positioned substantially parallel to a longitudinal axis of a tubular workpiece such that an exterior surface of an interior anode 424 is positioned a predetermined distance from an inner surface of a tubular workpiece.

A distance between an exterior surface of an interior anode 424 and an inner surface of a tubular workpiece 424 is generally substantially uniform. An apparatus of the present disclosure may include one or more braces coupled to a support structure that maintains an interior anode in position when in use. A brace may be fabricated from any suitable non-conductive material, such as a non-conductive thermoplastic material (e.g., chlorinated polyvinyl chloride (CPVC)).

In some embodiments, an interior anode is columnar or tubular. In embodiments, an interior anode has a diameter that is smaller than an inner diameter of the tubular workpiece. Referring to FIG. 4A, an exterior surface of the interior anode 424 may be, for example, substantially cylindrical 426 or may have a surface area feature that increases a surface area of the anode. In some embodiments, a surface area feature is corrugation 428. As used herein, "corrugation" or "corrugated" refers to a surface that has regularly alternating ridges and grooves (i.e., a series of continuous alternating convex and concave portions). In some embodiments where an interior anode 424 is tubular, an interior anode also has a hollow cavity centered on a longitudinal axis 430 that is circular 432 or that has a corrugated shape 434, as shown in FIG. 4B. In further embodiments, a surface area feature is a polygonal or sawtooth tube configuration, such that an exterior surface comprises a number of interconnected sides. In embodiments, an interior anode has three, four, five, six, or more interconnected sides. In further embodiments, a number of interconnected sides varies over a length of an interior anode.

In embodiments, an interior anode 424 has a plurality of holes 436 that extend laterally through at least one wall of the interior anode, as shown in FIG. 4C. In some embodiments, ones of a plurality of holes 436 extend through an interior anode 424. In some embodiments where an interior anode 424 has a hollow cavity, holes extend through a wall of an interior anode, but do not align with a corresponding hole in an opposite wall. A concentration of a subset of a plurality of holes 436 may differ over a length of an interior anode 424, as shown in FIG. 4C. In other words, a number of holes found in a predetermined area of an interior anode 424 may vary along a length of an interior anode. Similarly, a diameter of a subset of a plurality of holes 424 may differ over a length of an interior anode 424, as also shown in FIG. 4C. Thus, a size of holes found in a predetermined area of an interior anode 424 may vary along a length of an interior anode.

A plurality of holes in an interior anode may be in any suitable shape, such as, for example, circles, squares, rectangles, ovals, triangles, diamonds, hexagons, and the like. In some embodiments, a plurality of holes is one shape. In further embodiments, a plurality of holes in an interior anode includes holes of more than one shape.

An interior anode may be made of any suitable materials, such as a metal or an alloy, such as Zn, Ni, Sn, a precious metal (e.g., gold, silver, platinum, palladium, etc.), or any alloy thereof. In certain embodiments, an interior anode is made of a Zn—Sn alloy or a Ni—Co alloy. In embodiments, an interior anode is sacrificial, and therefore is replaced during or after the electrodeposition process.

In embodiments, an interior anode is surrounded, or partially surrounded by shielding. "Shielding" or "shields" refers to shaped pieces of plastic (e.g., acrylics) or polymeric materials that are positioned in order to lower a current density that reaches certain areas of a workpiece. By varying a thickness or creating cutouts, such as holes, shielding can be customized in order to distribute a current density as desired. Shielding may be shaped in any suitable form, such as, substantially circular, semi-circular, rectangular, cylindrical, semi-cylindrical, cuboidal, spherical, conical, pyramidal, and the like. Shielding may be made of any suitable material, such as an acrylic. In some embodiments, shielding is made by 3D printing methods using materials suitable for such methods. In certain embodiments, shielding is made from poly(methyl methacrylate) (PMMA). Shielding may be static (i.e., in a fixed position) or dynamic (i.e., in motion) when an apparatus of the present disclosure is in use.

In embodiments, an interior anode has a substantially constant material thickness ranging from about 0.25 mm to about 0.60 mm, from about 0.50 mm to about 0.80 mm, from about 0.75 mm to about 1.1 mm, from about 1.0 mm to about 1.3 mm, from about 1.2 mm to about 1.6 mm, from about 1.5 mm to about 1.8 mm, from about 1.7 mm to about 2.1 mm, from about 2.0 mm to about 2.3 mm, from about 2.2 mm to about 2.6 mm, from about 2.5 mm to about 3.9 mm, from about 3.8 mm to about 5.1 mm, or from about 5.0 mm to about 6.4 mm. In some embodiments, an interior anode is substantially solid. In further embodiments, an interior anode is made of a material that is substantially non-porous. In some embodiments, an interior anode has a plurality of holes or a hollow cavity, such that, in use, an interior anode to distributes or causes mixing of an electrolyte solution adjacent the interior anode.

In embodiments, an interior anode is porous. In such embodiments, the interior anode has a "percentage open area" which is a measure of the "empty" space in the anode. In other words, a percentage open area is the fraction of the volume of the pores (i.e., void spaces) over the total volume of the anode. In some embodiments, an interior anode has a percentage open area ranging from about 45% to about 50%, from about 50% to about 55%, from about 55% to about 60%, from about 60% to about 65%, from about 65% to about 70%, from about 70% to about 75%, from about 75% to about 80%, from about 80% to about 85%, from about 85% to about 90%, from about 90% to about 95%, or from about 95% to about 99%. In some embodiments, an interior anode is positioned within a fabric material. Suitable fabric materials include polypropylene, napped poly, cotton, synel, canton flannel, mono-filament polypropylene, nylon, polypropylene microfilet, cotton duck, felt, and polyester.

In certain embodiments, an apparatus of the present disclosure comprises at least one support structure configured to support a plurality of workpieces around a rotational axis, each workpiece of the plurality of workpieces having a substantially cylindrical shape with an outer surface and a longitudinal axis; and a drive assembly configured to rotate the plurality of workpieces around the rotational axis. In particular embodiments, an apparatus of the present disclosure further comprises a contact point assembly is further configured to enable electrical contact with the plurality of workpieces. In some embodiments, the contact point assembly is configured to rotate each workpiece of the plurality of workpieces rotate around its respective longitudinal axis.

One or more electrical contact bars are generally positioned at one or both ends of the interior anode. Electrical contact bar(s) may serve as electrical contact points for an interior anode during an electrodeposition process.

An apparatus of the present disclosure may further include a conductive bus. While in use, a conductive bus remains in electrical contact with the plurality of workpieces without interfering with rotation of the plurality of workpieces around the rotational axis. In some embodiments, a conductive bus is in electrical contact with a portion of the plurality of workpieces via a gear. In related embodiments, a conductive bus is in electrical contact with a portion of the plurality of workpieces via a gear and a coupler.

In embodiments, a conductive bus is configured to maintain electrical contact with an inner surface of a workpiece. In other embodiments, a conductive bus is configured to maintain electrical contact with an outer surface of a workpiece. In some embodiments, a conductive bus is configured to be in electrical contact with an exterior surface of a workpiece in at least two places. In some embodiments, a conductive bus is configured to be in electrical contact with an exterior surface of a workpiece in at least three places.

Any appropriate conductive material may be used for a conductive bus. For example, a conductive bus may be made of copper, etc.

A conductive bus 860 may be a bus bar, as shown in FIG. 8. In some embodiments, a conductive bus 860 is coupled to a rack 808. In further embodiments, while in use, a bus bar is positioned substantially parallel to a rotational axis of a workpiece. In some embodiments, a bus bar is attached at one or both ends to one or more support structures. In certain embodiments, a bus bar is a copper bar.

While in use, a conductive bus remains in electrical contact with a workpiece without interfering with the rotation of the workpiece. A contact point assembly may further include one or more conductive articles 854. In embodiments, conductive articles 354 are in physical contact with a gear (e.g., a peripheral gear 322), a coupler, a peripheral rod 316, or a workpiece 306 during rotation, as shown in FIGS. 3A-3C. In some embodiments, a conductive bus, while in use, is in electrical contact with a workpiece via a conductive article 354. In some embodiments, a conductive article is in physical contact with the peripheral rod 316. In some embodiments, a conductive article is in physical contact with a gear 322 or a coupler 338, 340. In some embodiments, a conductive article is integrated with or housed in a coupler, for example, as shown in FIG. 7B.

In some embodiments, two or more conductive articles are positioned such that a gear, coupler, peripheral rod, or workpiece is sandwiched between the conductive articles. Similarly, two or more conductive articles may be positioned such that a conductive bus is sandwiched between the conductive articles. A conductive article for use in an apparatus of the present disclosure may be made of conductive material (e.g., copper) or have a conductive coating.

In embodiments, a conductive article for use in an apparatus of the present disclosure is a flexible sheet, a brush, a rod, a bar, or a wire.

In other embodiments, a conductive article includes two or more threaded portions. In further embodiments, a conductive article for use in an apparatus of the present disclosure is a coupler made of conductive material (e.g., copper) or have a conductive coating.

In further embodiments, a conductive article for use in an apparatus of the present disclosure includes one or more linkages. A "linkage" is made of two or more conductive portions that are joined by a flexible, conductive connection point. A conductive portion or conductive connection point may be formed of, or coated in, a conductive material. A conductive portion may be flexible or inflexible. A flexible, conductive connection point may be any appropriate connection, such as an articulation, a hinge, a swivel, a bracket, or a flexible portion. In embodiments, a linkage is a single, continuous structure. In other embodiments, a linkage is made up of discrete portions. In some embodiments, a conductive article includes two or more linkages. In such embodiments, a conductive article may be capable of pivoting in two or more directions.

As a conductive article may be in physical contact with a gear, a coupler, a peripheral rod, or a workpiece, a conductive article may cause resistance to rotation of one or more workpiece(s). However, any resistance caused does not prevent the workpiece from rotating.

As an example, a bus bar may maintain electrical contact with a gear, a coupler, a peripheral rod, or a workpiece via one or more conductive bars. In further embodiments, one or more conductive bars are positioned substantially perpendicular to a bus bar. At one end, a conductive bar contacts a bus bar, and, at an opposite end, a conductive bar contacts a gear, a coupler, a peripheral rod, or a workpiece.

An apparatus of the present disclosure may further include shielding or thieving positioned adjacent to a workpiece. "Thieving" or "thieves" refers to a conductive material (e.g., conductive wires) that are used as auxiliary cathodes in order to draw current away from high current density areas. By varying a distance from a workpiece and a position of conductive wires in relation to a workpiece and anode(s), a current density that reaches a workpiece can be customized as desired.

In some embodiments where a workpiece includes one or more threaded portions, at least a portion of a shielding or thieving is positioned adjacent to a threaded portion(s) of a workpiece. In further embodiments, at least a portion of a shielding or thieving is positioned between a workpiece and an interior or an exterior anode.

An apparatus of the present disclosure may also include one or more bearing assemblies that may be attached to a first or second end of a rod (e.g., a central rod or a peripheral rod), such that the rod can rotate. In some embodiments, a bearing assembly is in electrical contact with a rod. Accordingly, a rod is able to maintain electrical contact with a bearing assembly, which is able to maintain electrical contact with a conductive bus, while rotating.

The one or more bearing assemblies may include a bearing block including one or more spherical roller bearings. In embodiments, such a bearing block or a spherical roller bearing is made of one or more non-conductive materials, such as a plastic (e.g., a thermoplastic or a polyethylene-based plastic) or a polymeric material. In some embodiments, bearings are electrically isolated.

Figure 5:
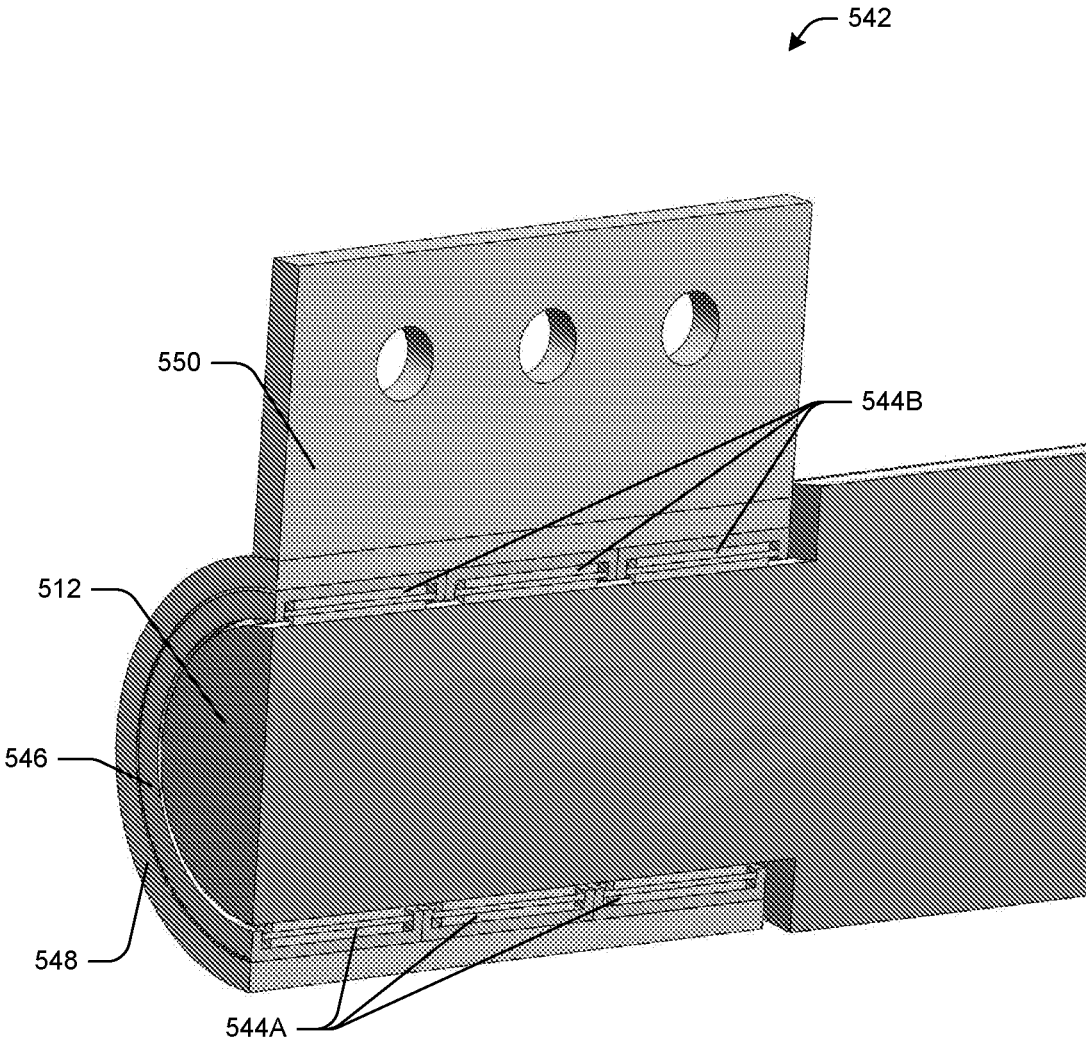
FIG. 5 is a view of an illustrative embodiment of a needle roller bearing.

In embodiments, a bearing assembly used in an apparatus of the present disclosure is a needle roller bearing assembly. An illustrative embodiment of a needle roller bearing assembly is shown in FIG. 5. In embodiments, a rod may be in electrical contact with a conductive bus. A needle roller bearing assembly may be coupled to a first or second end of a rod, such that the rod can rotate. A portion of one or both ends of a rod may taper in order to fit into a needle roller bearing. In one embodiment, the rod is notched or keyed to receive a needle roller bearing assembly 542.

In embodiments, a needle roller bearing assembly 542 has a plurality of cylindrical rollers 544A and 544B in electrical contact with a rod (e.g., central rod 512). Such cylindrical rollers 544A and 544B allow the needle roller bearing 546, bearing housing 548, and bearing tab 550 to remain stationary while a rod rotates. Additionally, a rod is able to maintain electrical contact with a needle roller bearing assembly 542, which is able to maintain electrical contact with a conductive bus, while rotating.

A needle roller bearing assembly 542 of the present disclosure may be sheathed in a bearing housing 548. In embodiments, a conductive bus is joined to a bearing housing 548 via a conductive article. A bearing housing 548 may further comprise a bearing tab 550 joined with one or more conductive articles. In some embodiments a connection between a bearing tab 550 and one or more conductive articles is a flexible connection. Additionally or alternatively, in some embodiments, one or more conductive articles are connected to a conductive bus via a flexible connection. A flexible connection acts to prevent a system from binding.

In some embodiments, two or more conductive articles are positioned such that a bearing, conductive roller, or workpiece is sandwiched between the two or more conductive articles. Similarly, two or more conductive articles may be positioned such that a conductive bus is sandwiched between the two or more conductive articles. A conductive article for use in an apparatus of the present disclosure may be made of conductive material (e.g., copper) or have a conductive coating.

In embodiments, a conductive article includes two or more threaded portions. In further embodiments, a conductive article for use in an apparatus of the present disclosure is a coupler made of conductive material (e.g., copper) or have a conductive coating.

As a conductive article may be in physical contact with a bearing, a conductive roller, or a workpiece, a conductive article may cause resistance to rotation of a workpiece. However, any resistance caused does not prevent rotation of a workpiece.

An apparatus of the present disclosure may further include shielding or thieving positioned adjacent to a workpiece. In some embodiments where a workpiece includes one or more threaded portions, at least a portion of the shielding or thieving is positioned adjacent to a threaded portion of a workpiece. In some such embodiments, at least a portion of the shielding or thieving is positioned between a workpiece and an interior or exterior anode.

Systems for Electrodepositing Nanolaminate Coatings

Systems for electrodepositing nanolaminate coatings comprise an apparatus as described above and a plurality of workpieces. Accordingly, embodiments of the present disclosure include a system comprising: a plurality of workpieces around a rotational axis, each workpiece of the plurality of workpieces having a substantially cylindrical shape with an outer surface and a longitudinal axis; and an apparatus as described herein.

Figure 6A:
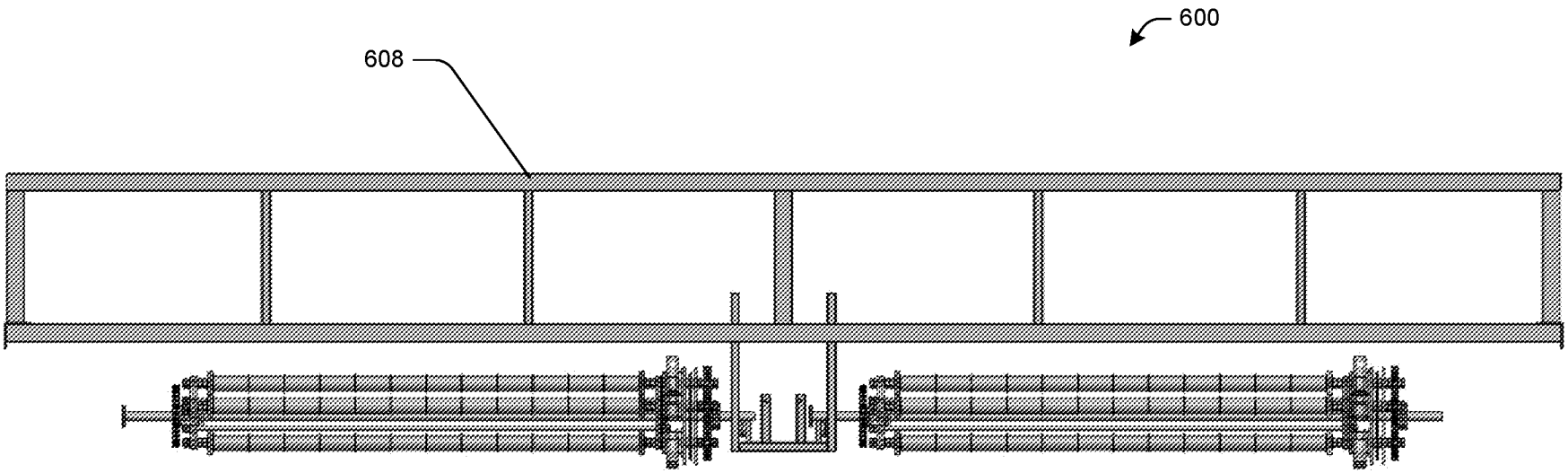
FIGS. 6A-6C are several views of an illustrative example of a system of the disclosure.
Figure 6B:
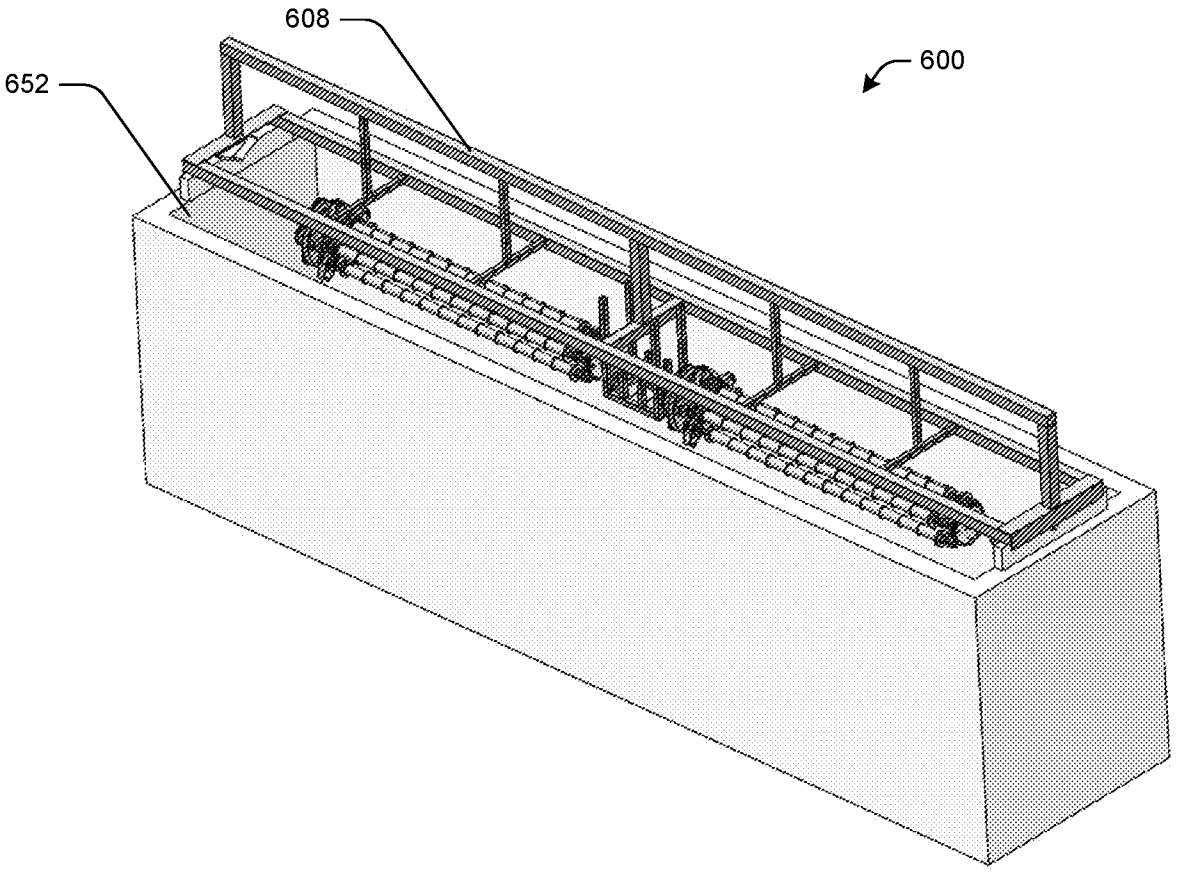
Figure 6C:
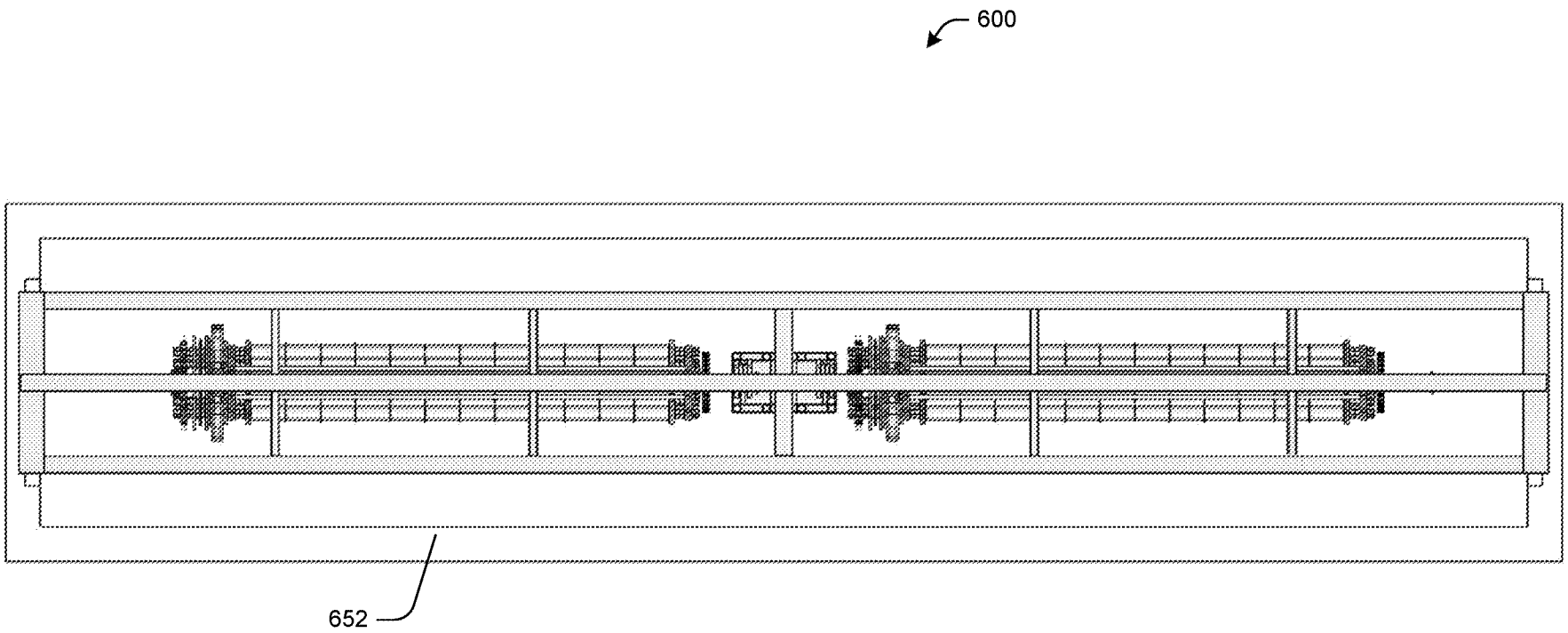

Several views of an illustrative example of a system 600 of FIGS. 1A-1C are shown in FIGS. 6A-6C.

In such embodiments, a system 600 of the present disclosure further includes an electrolyte bath. An electrolyte bath includes an electrolyte solution comprising a liquid and at least one electrodepositable species. In some embodiments, the liquid is an ionic liquid. In some embodiments, an electrodepositable species includes a metal salt, from which a metal may be electroplated onto a workpiece. In embodiments, two or more electrodepositable species are in an electrolyte solution. Electrodepositable species that may be used in an electrolyte solution of the present disclosure include, for example, Ag, Al, Au, B, Be, C (e.g., graphite), Co, Cr, Cu, Fe, Hg, In, Ir, Mg, Mn, Mo, Nb, Nd, Ni, P, Pd, Pt, Re, Rh, Sb, Sn, Pb, Ta, Ti, W, V, Zn, and Zr. In some embodiments, an electrolyte solution includes one or more additives. Examples of additives include brightening agents, leveling agents, surfactants, and the like.

In some embodiments where two or more metal salts are present in an electrolyte solution, an alloy of two or more metals is deposited onto a workpiece. In some embodiments, a composition of an alloy electrodeposited onto a workpiece is varied based on a current or a voltage applied. In some embodiments, more than two (e.g., three, four, five, six, seven, eight, or more) metal salts are present in an electrolyte solution.

In further embodiments, multilayer nanolaminate coatings with layers having alloys of varying composition are deposited onto a workpiece by varying a current or a voltage applied. Such multilayer nanolaminate coatings may be produced by applying an oscillating current density to a workpiece. In some embodiments, at least two cycles of an oscillating current density is applied, resulting in a compositionally (e.g., concentration of metals in an alloy, etc.) or structurally (e.g., layer thickness, layer density, etc.) modulated nanolaminate coating on a workpiece.

In some embodiments, a rack 608 and an electrolyte bath are housed in a process tank 652.

In embodiments, a system 600 of the present disclosure further includes a flow control unit to distribute an electrolyte solution through a process tank. In some embodiments, a flow control unit distributes an electrolyte solution over an exterior surface of a workpiece. In various embodiments, an electrolyte solution is circulated, in part, by an electrolyte distribution tube.

In embodiments, a flow control unit causes the electrolyte solution to flow over a surface of a workpiece. In some embodiments, a flow control unit introduces electrolyte solution into a hollow cavity of a tubular workpiece. In some embodiments, an electrolyte distribution tube is positioned adjacent to an interior anode within a hollow cavity of a tubular workpiece. An electrolyte distribution tube may include a plurality of holes that extend laterally though an electrolyte distribution tube. In embodiments, the holes extend through a wall of an electrolyte distribution tube, but do not align with a corresponding hole in an opposite wall. A concentration of a subset of a plurality of holes may differ over a length of an electrolyte distribution tube. In other words, a number of holes found in a predetermined area of an electrolyte distribution tube may vary along a length of an electrolyte distribution tube. Similarly, a diameter of a subset of a plurality of holes may differ over a length of an electrolyte distribution tube. Thus, a size of holes found in a predetermined area of an electrolyte distribution tube may vary along a length of an electrolyte distribution tube.

In further embodiments, a flow control unit distributes an electrolyte solution into a hollow cavity of a tubular workpiece through a hollow cavity in an interior anode, through a plurality of holes in an interior anode, or both.

A flow control unit may include a pump that, when in use, circulates electrolyte solution over an exterior surface of a workpiece or through a hollow cavity of a workpiece. In embodiments, a pump circulates electrolyte solution over an exterior surface of a workpiece via an electrolyte distribution tube. In additional embodiments, a pump circulates electrolyte solution through a hollow cavity of a workpiece via an interior anode or an electrolyte distribution tube. An electrolyte solution may be circulated through a hollow cavity of a workpiece at a flow rate ranging from about 0.005 cubic meters per hour ($m^3/h$) to about 24.0 $m^3/h$. In some embodiments, an electrolyte solution is circulated at a flow rate ranging from about 0.005 $m^3/h$ to about 0.5 $m^3/h$, from about 0.005 $m^3/h$ to about 12.0 $m^3/h$; from about 0.5 $m^3/h$ to about 1.0 $m^3/h$, from about 1.0 $m^3/h$ to about 2.0 $m^3/h$, from about 1.0 $m^3/h$ to about 6.0 $m^3/h$; from about 1.0 $m^3/h$ to about 12.0 $m^3/h$; from about 1.0 $m^3/h$ to about 18.0 $m^3/h$; from about 1.0 $m^3/h$ to about 24.0 $m^3/h$; from about 2.0 $m^3/h$ to about 3.0 $m^3/h$, from about 3.0 $m^3/h$ to about 6.0 $m^3/h$; from about 3.0 $m^3/h$ to about 12.0 $m^3/h$; from about 3.0 $m^3/h$ to about 18.0 $m^3/h$; from about 3.0 $m^3/h$ to about 24.0 $m^3/h$; from about 4.0 $m^3/h$ to about 5.0 $m^3/h$, from about 5.0 $m^3/h$ to about 6.0 $m^3/h$; from about 6.0 $m^3/h$ to about 12.0 $m^3/h$; from about 6.0 $m^3/h$ to about 18.0 $m^3/h$; from about 6.0 $m^3/h$ to about 24.0 $m^3/h$; from about 12.0 $m^3/h$ to about 18.0 $m^3/h$; from about 12.0 $m^3/h$ to about 24.0 $m^3/h$; from about 18.0

$m^3/h$ to about 24.0 $m^3/h$; from about 20.0 $m^3/h$ to about 24.0 $m^3/h$; or from about 22.0 $m^3/h$ to about 24.0 $m^3/h$.

In embodiments, systems of the present disclosure further include one or more exterior anodes. An exterior anode may have a length that is less than or equal to a length of a workpiece. In embodiments, an exterior anode has a length that is less than or equal to a combined length of two or more workpieces in series. When in use, an exterior anode is positioned adjacent to a workpiece. An exterior anode is positioned a predetermined distance away from an exterior surface of a workpiece. Additionally, an exterior anode may be positioned substantially parallel to a longitudinal axis of a workpiece at a substantially uniform distance from an exterior surface of a workpiece.

A system of the present disclosure may further include shielding or thieving positioned adjacent to a workpiece. In some embodiments where a workpiece includes one or more threaded portions, at least a portion of the shielding or thieving is positioned adjacent to a threaded portion of a workpiece. In some such embodiments, at least a portion of the shielding or thieving is positioned between a workpiece and an interior or exterior anode.

A system of the present disclosure may further include a power supply. In embodiments, a power supply is electrically coupled to an interior anode. In some embodiments where more than one anode is present, a power supply is electrically coupled to each anode. In embodiments, a single power supply is present. In other embodiments, two or more power supplies are present.

In certain embodiments, a first power supply controller distributes power to one or more exterior anodes and a second power supply controller distributes power to an interior anode. In some embodiments, two or more power supply controllers distribute power to exterior anode(s).

In embodiments, a power supply is in electrical contact with a conductive bus. In some embodiments where a gear or a coupler is joined to a workpiece at one or both ends, a gear or a coupler acts as a fixed contact between a workpiece and a power supply. In some embodiments, a peripheral rod acts as a fixed contact between a workpiece and one or more power supplies.

In some embodiments, a conductive article is in physical contact with the gear, the rod, or the coupler.

In some embodiments, two or more conductive articles are positioned such that a gear, coupler, rod, or workpiece is sandwiched between the conductive articles. Similarly, two or more conductive articles may be positioned such that a conductive bus is sandwiched between the conductive articles. A conductive article for use in a system of the present disclosure may be made of conductive material (e.g., copper) or have a conductive coating.

In embodiments, a conductive article includes two or more threaded portions. In further embodiments, a conductive article for use in a system of the present disclosure is a coupler made of conductive material (e.g., copper) or have a conductive coating.

In other embodiments, a conductive article for use in a system of the present disclosure is a flexible sheet, a brush, a rod, or a wire. In other embodiments, a conductive article for use in a system of the present disclosure is a bar.

In further embodiments, a conductive article for use in a system of the present disclosure includes one or more linkages. In some embodiments, a conductive article includes two or more linkages. In such embodiments, a conductive article may be capable of pivoting in two or more directions.

A power supply may further be connected to an interior anode. In some embodiments, a power supply is connected to an anode via an electrical control bar positioned at one or both ends of an interior anode.

Further, a power supply controller may be included in a system of the present disclosure. In some embodiments where a single power supply is present, a power supply controller, when in use, distributes power from a power supply to a conductive bus. Similarly, in embodiments where more than one power supply is present, a power supply controller, when in use, distributes power from one or more power supplies to a conductive bus. A power supply controller may distribute power to one or more locations on a conductive bus. In further embodiments, a power supply controller distributes power to two or more locations on a conductive bus.

A power supply controller may, when in operation, control a current or a voltage applied to a workpiece. In various embodiments, a power supply controller, when in operation, varies a current or a voltage over time. Similarly, a power supply controller may, when in operation, vary a current density applied to the workpiece over time.

In embodiments, a motor is present. A motor may produce linear or rotary motion. In some embodiments, a motor, in use, rotates a gear, rod, etc. in order to rotate the plurality of workpieces.

A motor may be housed in a suitable housing. In some embodiments, a housing is fabricated from a polymeric material (e.g., composite, thermoplastic, or thermoset) that is sealed (i.e., water tight).

In some embodiments, a motor is located outside of the processing tank, and a pulley system is used to translate motion from the motor to rotational motion of the plurality of workpieces, as shown in FIG. 9A.

A system described herein may further include a gear box. Such a gear box may be in a same housing as a motor, or in a second housing. A motor of the present disclosure may connect to a first end of a gear box. In embodiments, a gear box is a right-angle (or 90 degree) gear drive that translates linear motion from a linear motor into rotary motion. A second end of a gear box may be connected to a driven roller.

Several views of a particular embodiment of the disclosure are shown in FIGS. 11A-11G. A support structure comprises one or more guides 1102*a*, 1102*b*, 1102*c*, which are used to arrange the plurality of workpieces 1106 around the rotational axis.

The plurality of workpieces 1106 is arranged in a polygonal configuration such that the workpieces are substantially parallel to each other and spaced apart from each other such that individual workpieces do not make physical contact.

The at least one support structure also comprises support members 1104*a*, 1104*b* that couple to a rack 1108, which has attachments 1162 that allow rack 1108 to be coupled to (e.g., suspended from) an overhead gantry or gantry system that allows the plurality of workpieces to be transported between processing tanks, holding areas, storage areas, and the like.

When fully assembled, portions of the plurality of workpieces 1106 (e.g., individual workpieces 1106*a*-1106*d*) are arranged in series. Ends of respective workpieces are coupled together by couplers 1138 (including individual couplers 1138*a*, 1138*b*, 1138*c*). The couplers 1138*a*-1138*c* are generally are cylindrical structures that fit inside the hollow cavity of the workpieces. The couplers include a conductive portion, which fits at least partially in the inner hollow cavity of the workpieces, and a non-conductive gasket that is arranged between ends of respective workpieces.

Two workpieces are joined using a coupler by applying pressure such that the workpiece causes the gasket of the coupler to deform, and forms a seal between the gasket of the coupler and the workpiece. The seal formed is water tight, such that electrolyte solution is not able to reach the interior cavity of a tubular workpiece.

A second type of coupler 1140 is used at ends of the series of workpieces. Coupler 1140 is made of a conductive material housed (e.g., a peripheral rod 1116) in a non-conductive material. Coupler 1140 may also at least partially house a peripheral rod 1116. Thus, coupler 1140 acts as shielding to the conductive material of peripheral rod 1116.

Coupler 1140 includes a spring loaded mechanism, similar to a mechanism in a spring tension rod, which allows workpieces 1106 and couplers 1138 to be maintained in the illustrated configuration due to tension.

A pulley system 1166 is arranged to translate the motion (e.g., linear motion) from the motor 1164*b* to the drive assembly to rotate the plurality of workpieces around a rotational axis. Motors 1164*a*, 1164*b* are maintained outside of the electrolyte solution prolonging the life of the hardware.

Figure 11A:
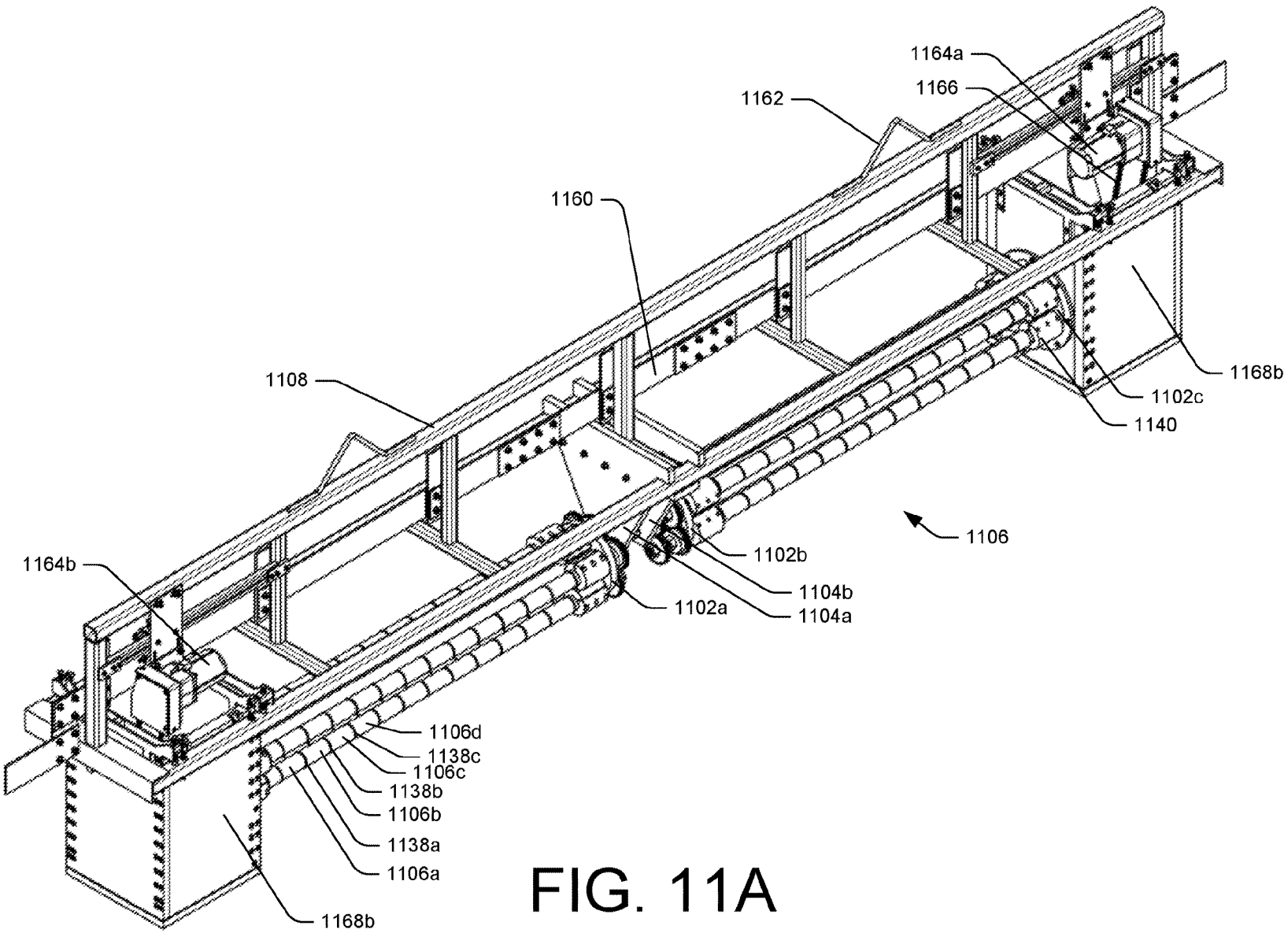
FIGS. 11A-11G are several views of an embodiment of a system and apparatus of the disclosure.
Figure 11B:
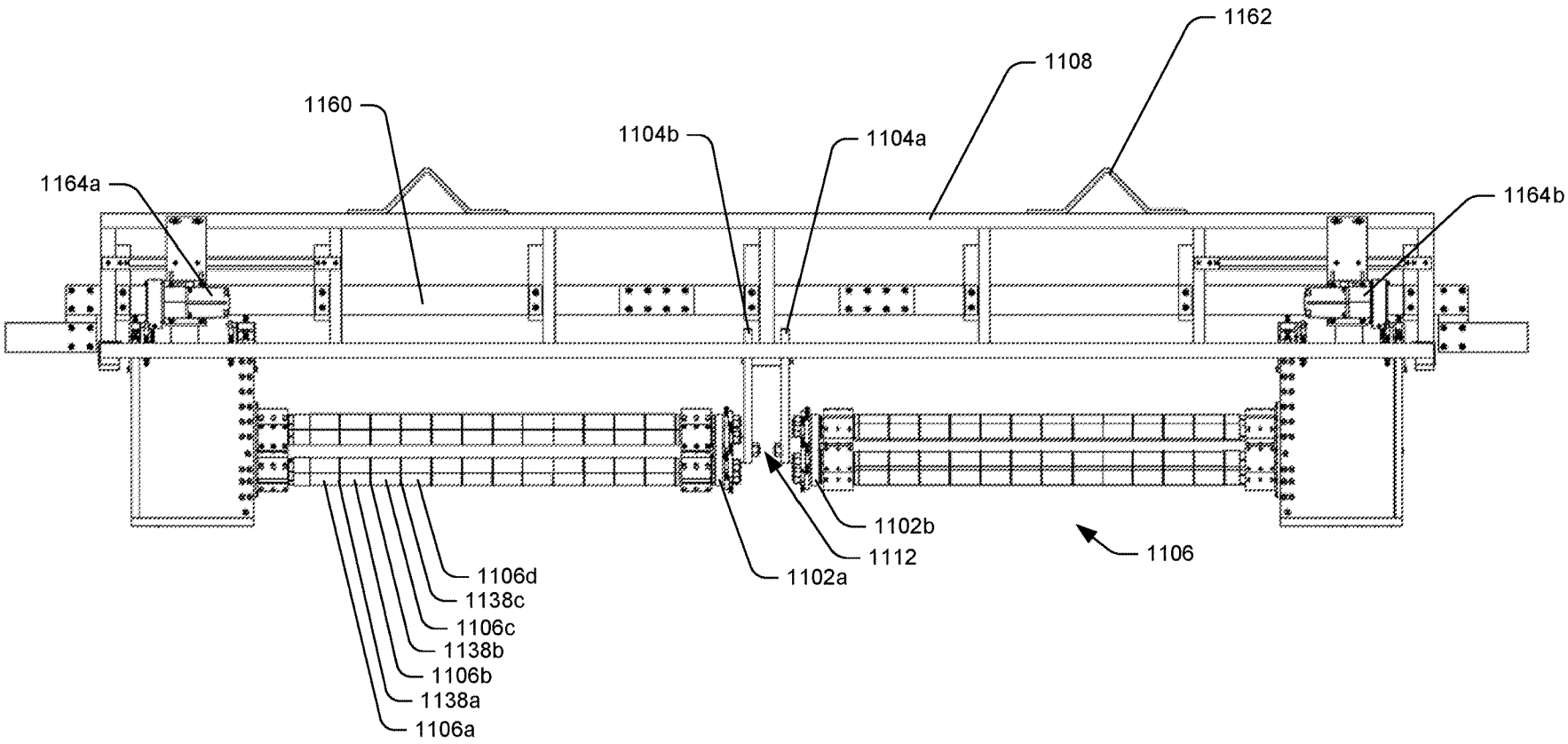
Figure 11C:
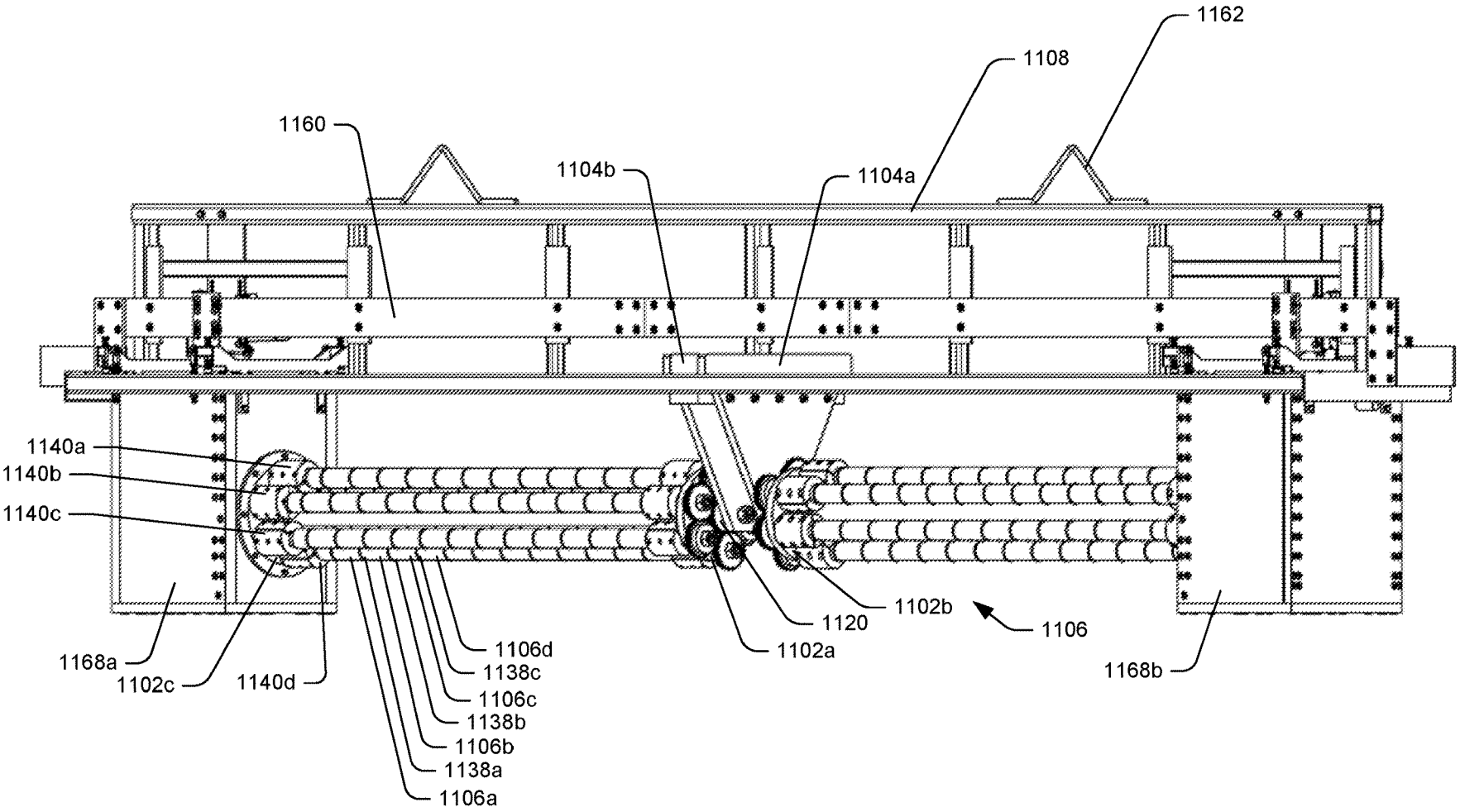
Figure 11D:
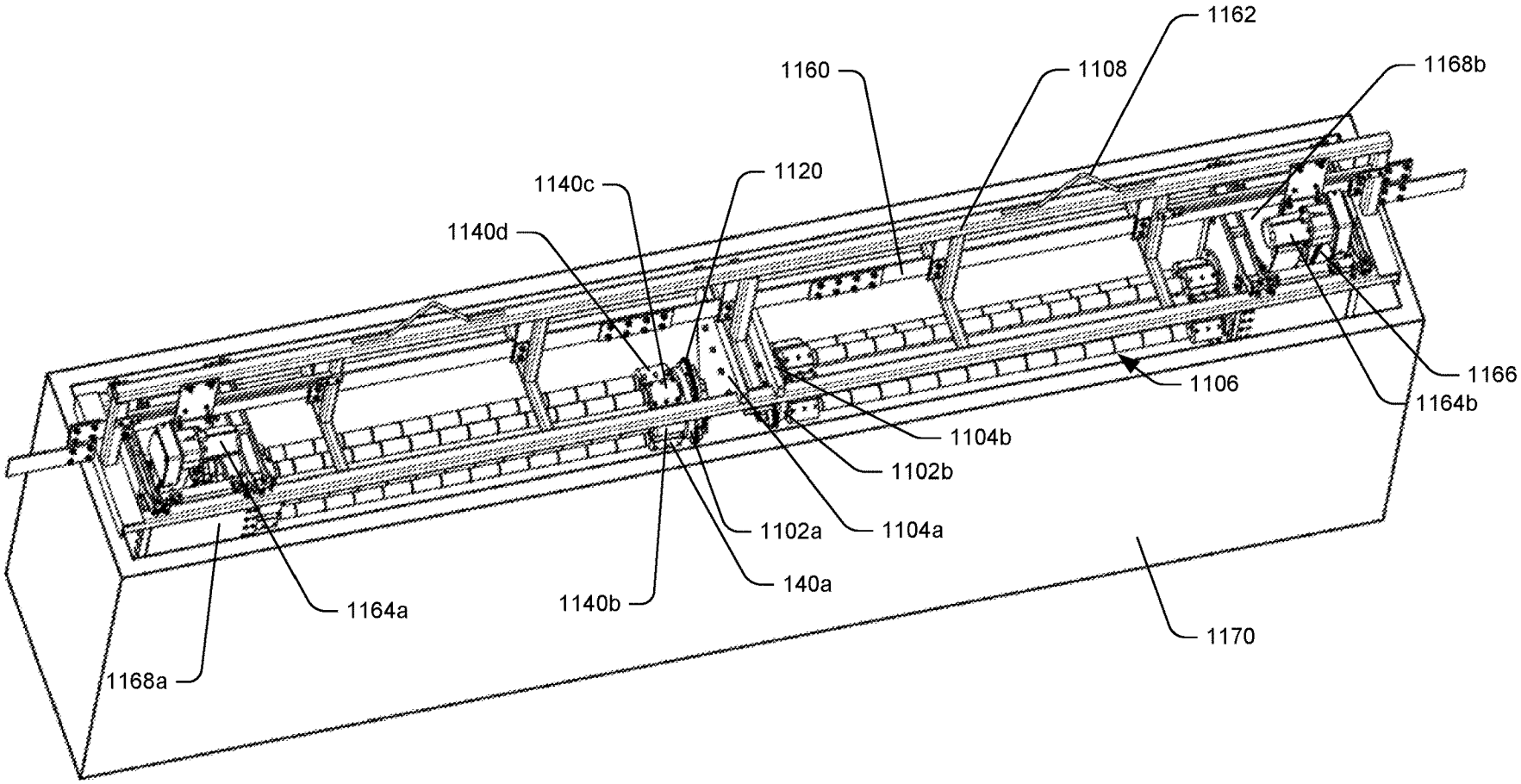
Figure 11E:
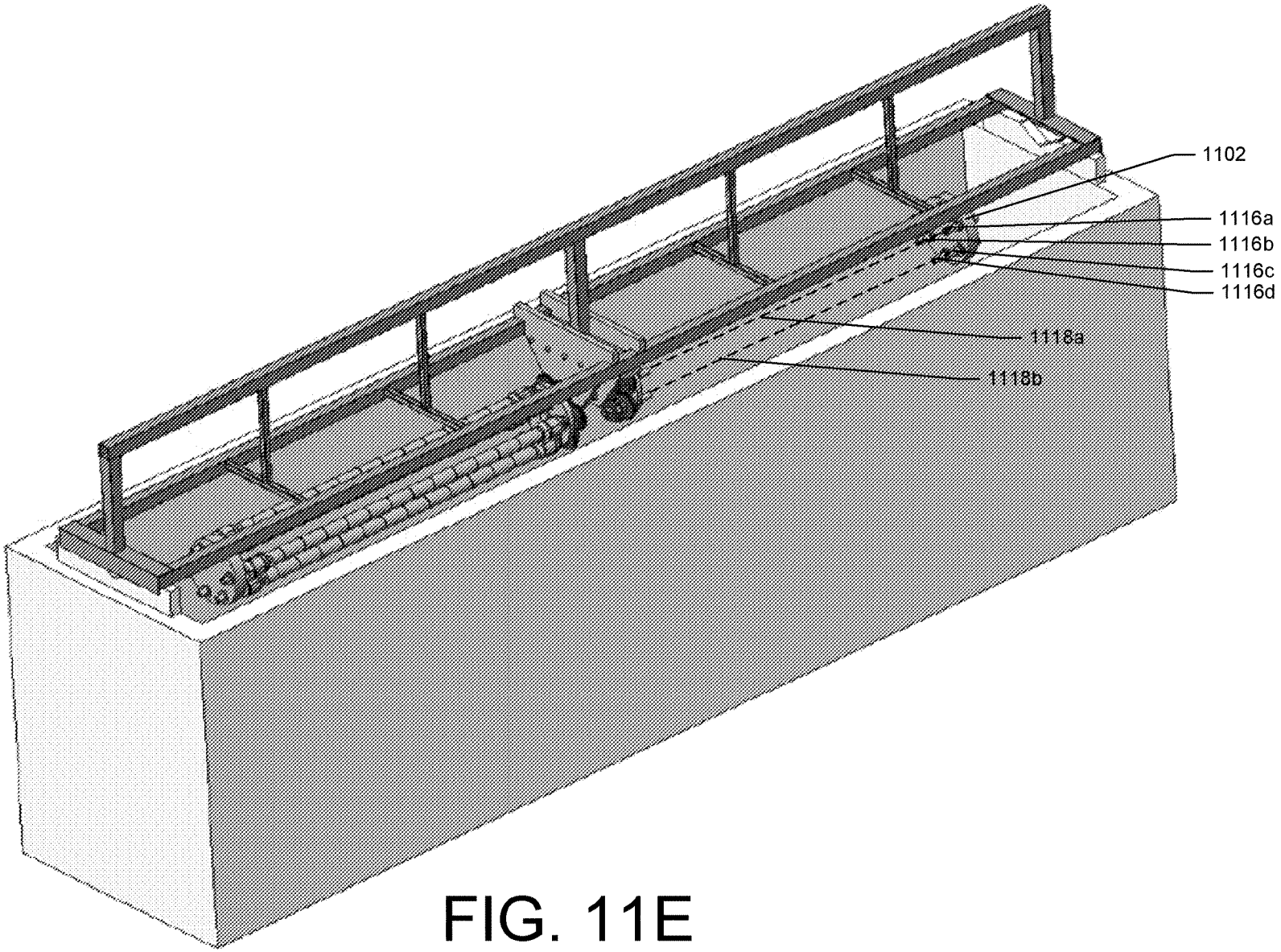
Figure 11F:
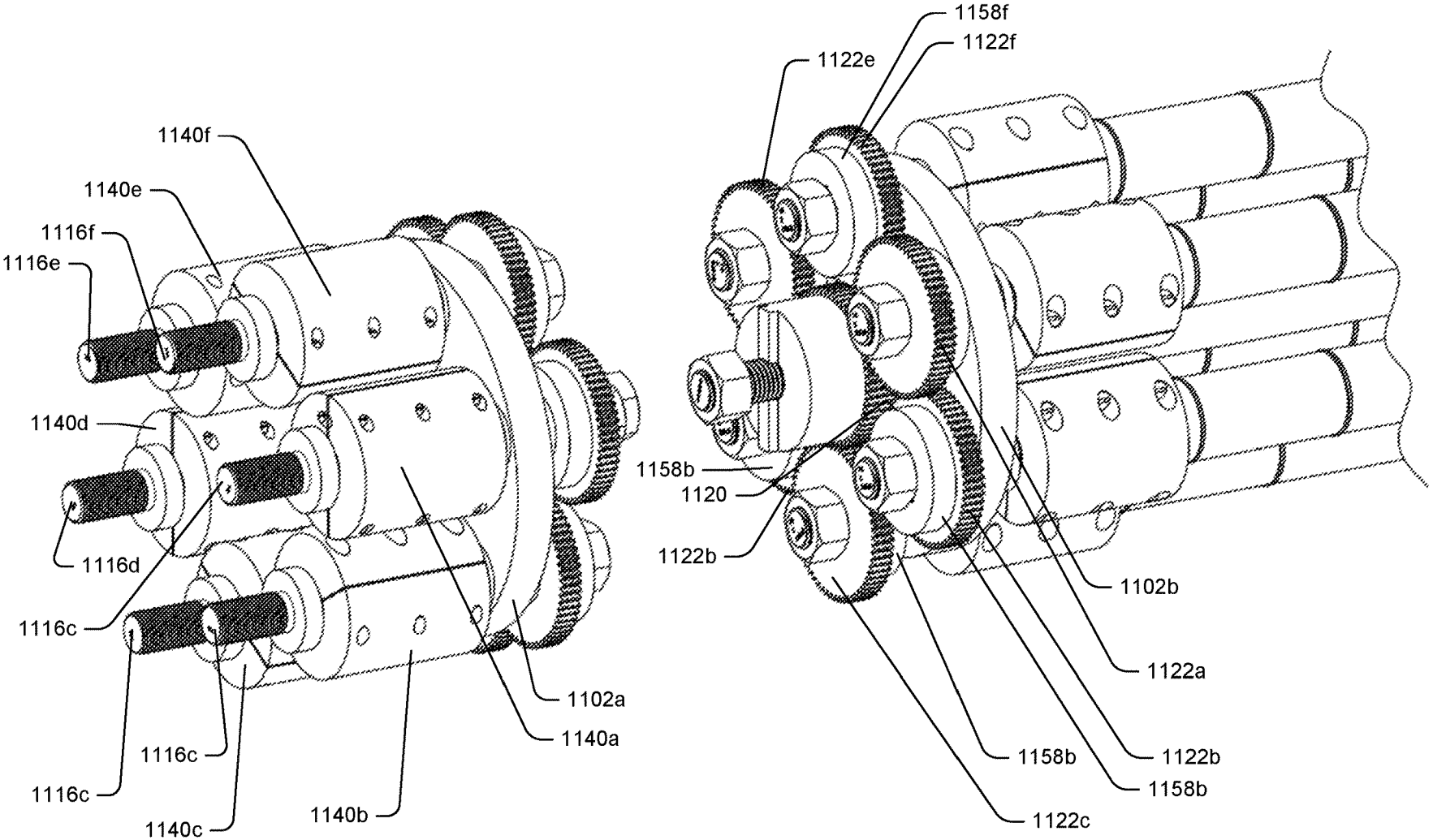

As shown in FIG. 11E, which shows the system with some components removed for ease of understanding, the contact point assembly comprises peripheral rods 1116*a*-1116*d* that are positioned around the rotational axis. The peripheral rods 1116*a*-1116*d* are positioned substantially along the longitudinal axis 1118*a*, 1118*b*, or an axis substantially parallel to the longitudinal axis within the hollow cavity of the workpieces. As shown in FIG. 11F, peripheral rods 1116*a*-1116*d* extend through openings in guide 1102. Peripheral rods 1116*a*-1116*d*, when in use, extend partially though a workpiece, but not through the entire length of a workpiece.

The contact point assembly also includes peripheral gears 1122*a*-1122*e*. As shown in FIG. 11F, teeth of peripheral gears 1122*a*-1122*e* mesh with teeth of central gear 1120. Individual peripheral gears are offset from the adjacent peripheral gears such that the teeth of adjacent gears do not mesh. This offset is achieved with spacers 1158*a*-1158*f*.

Figure 11G:
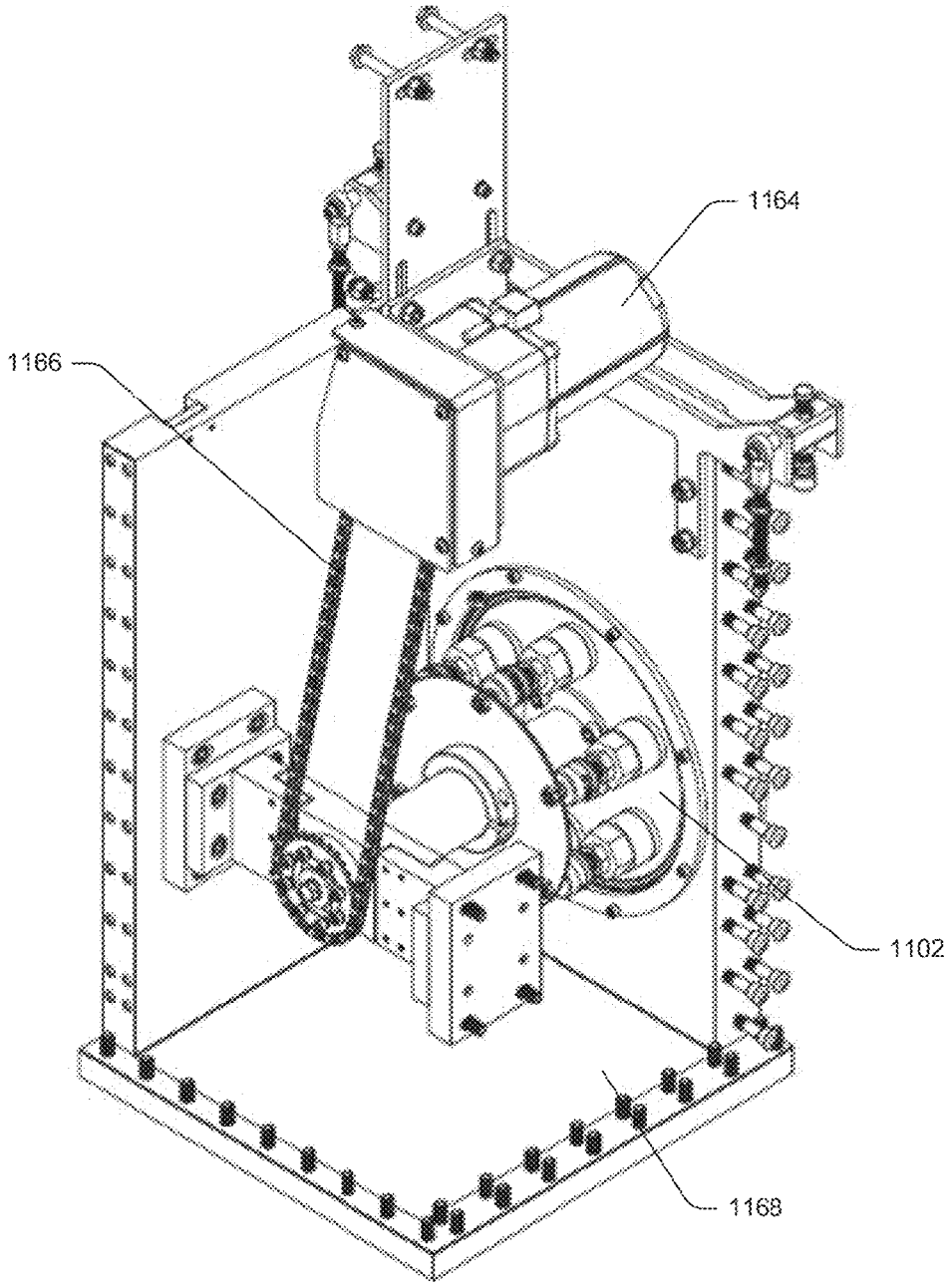

As shown in FIG. 11G, pulley system 1166 translates the motion from the motor to rotate the plurality of workpieces and allows the motor to be positioned outside of an electrolyte bath, as shown in FIG. 11B. At least a portion of a pulley system is housed in a housing 1168, which is sealed.

As shown in FIG. 11G, guide 1102 may be coupled to housing 1168. In such embodiments, guide 1102 is rotatably coupled to housing 1168. In some embodiments, a bearing assembly allows guide 1102 to rotate relative to housing 1168. In some embodiments, couplers are coupled to guide 1102.

A motor controller is used to control a motor. In some embodiments, a motor controller is used to start or stop the motor, or to vary a speed as desired. In some embodiments, a motor or motor controller is a part of an apparatus of the disclosure. In other embodiments, a motor or motor controller is separate from an apparatus of the disclosure.

The apparatus further comprises a conductive bus bar 1160 coupled to rack 1108. While in use, a conductive bus remains in electrical contact with the plurality of workpieces without interfering with rotation of the plurality of workpieces around the rotational axis. The conductive bus is configured to maintain electrical contact with an inner surface of a workpiece. The contact point assembly may further includes conductive articles housed in couplers 1140.

In use, this apparatus is positioned in a processing tank 1170.

Methods for Electrodepositing Nanolaminate Coatings

Methods for electrodepositing nanolaminate coatings onto workpieces using apparatuses or systems of the present disclosure are provided herein.

Generally, methods of the present disclosure include introducing a plurality of workpieces to a system of the disclosure, rotating the workpieces, and electrodepositing at least one electrodepositable species onto an outer surface of the workpieces. In embodiments, a coating on an inner surface and a coating on an outer surface may have substantially a same thickness. In other embodiments, a coating on an inner surface may be thicker than a coating on an outer surface. In still other embodiments, a coating on an inner surface may be thinner than a coating on an outer surface.

Accordingly, methods of the present disclosure include a method for producing a nanolaminate coating on a tubular workpiece comprising: introducing the plurality of workpieces, each workpiece being substantially cylindrical, having a longitudinal axis, and having an outer surface, to a system as described herein; rotating the plurality of workpieces around a rotational axis at a rotational speed; and electrodepositing an electrodepositable species onto the plurality of workpieces as a first nanolaminate coating on at least a portion of the outer surface of each of the plurality of workpieces In embodiments, introducing a plurality of workpieces to a system of the present disclosure comprises positioning one or more interior anodes along a longitudinal axis of at least a portion of the plurality of workpieces or an axis substantially parallel to a longitudinal axis within a hollow cavity of a portion of the plurality of workpieces such that an exterior surface of an interior anode is positioned a predetermined distance from an inner surface of a workpiece.

Interior anodes suitable for use in the present disclosure are described herein. For example, an interior anode used in a method of the disclosure may have a corrugated surface.

In methods of the present disclosure, a plurality of workpieces is rotated in a system as described above.

In embodiments, in order to prevent a marked-off portion of a workpiece, a coupler or gear is in physical contact with a first end of a workpiece for at least a portion of an electrodeposition process. In further embodiments, after a portion of an electrodeposition process of sufficient length such that a first end (e.g., a threaded portion of a first end) has been coated, a first end of a workpiece is uncoupled from a coupler or gear, which is then be coupled to a second end of a workpiece. In such methods, no marked-off portions of an article are created.

In embodiments, a plurality of workpieces is rotated at a constant speed during an electrodeposition process. In other embodiments, a rotational speed is varied over time. In further embodiments, a varied rotational speed results in a change in a composition or a structure of a nanolaminate coating on a surface a plurality of workpieces.

Varying a rotational speed of a plurality of workpieces may comprise changing a rotational speed from a first rotational speed to a second rotational speed for a period of time, and changing a second rotational speed to a first rotational speed for a period of time. In some embodiments, a first or a second rotational speed is changed to a third rotational speed for a period of time, and a third rotational speed is changed to a first rotational speed, a second rotational speed, or a fourth rotational speed.

Suitable rotational speeds may be between 0.5 rpm and 10 rpm. In some embodiments, speeds of less than 0.5 rpm, or more than 6 rpm are used. In embodiments, a rotational speed ranges from about 0.5 rpm to about 3 rpm, about 1 rpm to about 4 rpm, about 2 rpm to about 5 rpm, about 3 rpm to about 6 rpm, about 4 rpm to about 7 rpm, about 5 rpm to about 8 rpm, about 6 rpm to about 9 rpm, or about 7 rpm to about 10 rpm. In other embodiments, a rotational speed ranges from about 0.5 rpm to about 1 rpm, about 1 rpm to about 2 rpm, about 2 rpm to about 3 rpm, about 3 rpm to about 4 rpm, about 4 rpm to about 5 rpm, about 5 rpm to about 6 rpm, about 6 rpm to about 7 rpm, about 7 rpm to about 8 rpm, about 8 rpm to about 9 rpm, or about 9 rpm to about 10 rpm.

Electrodepositing at least one electrodepositable species onto a plurality of workpieces may comprise contacting a plurality of workpieces with an electrolyte solution by submerging a plurality of workpieces in an electrolyte bath, partially submerging a plurality of workpieces in an electrolyte bath, or applying an electrolyte solution using other suitable means.

An electrolyte solution includes a liquid and one or more electrodepositable species, such as Ag, Al, Au, B, Be, C, Co, Cr, Cu, Fe, Hg, In, Ir, Mg, Mn, Mo, Nb, Nd, Ni, P, Pd, Pt, Re, Rh, Sb, Si, Sn, Pb, Ta, Ti, W, V, Zn, and Zr. In some embodiments, the liquid is an ionic liquid. In some embodiments, an electrolyte solution includes one or more additives. Examples of additives include brightening agents, leveling agents, surfactants, and the like.

In embodiments, electrodepositing at least one electrodepositable species onto a plurality of workpieces comprises distributing a portion of an electrolyte solution into a hollow cavity of a plurality of workpieces. Electrolyte solution may be distributed into a hollow cavity of a plurality of workpieces via an interior anode. In some embodiments, an electrolyte solution is distributed through a hollow cavity of an interior anode, or through a plurality of holes that extend laterally though an interior anode.

In further embodiments, electrolyte solution is distributed into a hollow cavity of a plurality of workpieces via an electrolyte distribution tube. In some embodiments, an electrolyte solution is distributed through plurality of holes in an electrolyte distribution tube.

In some embodiments, methods of the present disclosure comprise positioning an exterior anode adjacent to a plurality of workpieces.

In some embodiments where a workpiece has one or more threaded portions, a third coating (i.e., nanolaminate thread coating) is electrodeposited over a threaded portion. In further embodiments, a nanolaminate coating over a threaded portion is thinner than a nanolaminate coating over an inner surface and a nanolaminate coating over an outer surface.

A current density applied to a threaded portion of a workpiece may be reduced in order to achieve a nanolaminate coating that is thinner than a nanolaminate coating over other portions of a workpiece. A current density may be reduced by positioning shielding or thieving adjacent to a threaded portion of a plurality of workpieces. If a plurality of workpieces has more than one threaded portion, a similar method may be utilized in order to deposit a nanolaminate coating that is thinner than a nanolaminate coating on other portions of a plurality of workpieces.

In order to electrodeposit an electrodepositable species onto a plurality of workpieces, a voltage or a current is applied to a plurality of workpieces or a conductive article that is in contact with a plurality of workpieces. In some embodiments, a voltage or current applied varies over time. Varying a voltage or current applied to a plurality of workpieces may comprise changing a voltage or current from a first voltage or current to a voltage or current for a period of time, and changing a second voltage or current to a first voltage or current for a period of time. In some embodiments, a first or a second voltage or current is changed to a third voltage or current for a period of time, and a third voltage or current is changed to a first voltage or current, a second voltage or current, or a fourth voltage or current.

Methods of the present disclosure generally produce a plurality of cylindrical articles as described herein. A cylindrical article of the present disclosure includes a cylindrical workpiece, which has an exterior surface, and a first nanolaminate coating on the exterior surface.

In embodiments where the cylindrical workpiece is a tubular workpiece, an inner nanolaminate coating is thicker than an outer nanolaminate coating. In other embodiments, the outer nanolaminate coating has a thickness that is greater than a thickness of the inner nanolaminate coating. In other embodiments, an inner nanolaminate coating and an outer nanolaminate coating are substantially the same thickness.

In some embodiments, a tubular workpiece is single-walled. In other embodiments, a tubular workpiece has two walls, an inner wall and an outer wall.

A plurality of workpieces employed in embodiments of the present disclosure may be any suitable workpieces. In embodiments, a workpiece is made of a metal or metal alloy. In some embodiments, a workpiece is made of a steel alloy. In certain embodiments, a steel alloy includes: C and Fe; C, Fe, and Mo; or C, Fe, Mo, and Co.

In other embodiments, a workpiece is made of a plastic or polymeric material. In some embodiments, a plastic or polymeric material includes arylamides, acrylamides, polybenzimidazole (PBI), polyetherimide, polyetherketoneketone (PEKK), polyether ether ketone (PEEK), polyamide, polyimide, polyamide-imides, polyphenylene oxide (PPO), polystyrene (PS), polyphenylene oxide (PPO) and polystyrene (PS), polyphthalamide (PPA), polyvinyl alcohol (PVA), acrylonitrile butadiene styrene (ABS), polycarbonate (PC), polylactic acid (PLA), PC/ABS, cellulose fiber, polyphenylsulfone (PPSU), thermosets, PBI-PEEK, urea, epoxies, cyanate esters, polyurethanes, or any combination thereof.

In various embodiments, a plastic or polymeric material includes an additive, such as carbon black (e.g., from about 1% to about 5% (w/w)), graphene (e.g., PLA-Graphene printing filament), graphite, carbon nanotubes, carbon nanofibers, or graphite fibers. Additionally, in some embodiments, a plastic or polymeric material of the present disclosure further includes a metal additive (e.g., Ag, Al, Au, B, Be, Co, Cr, Cu, Fe, Hg, In, Ir, Mg, Mn, Mo, Nb, Nd, Ni, Pd, Pt, Re, Rh, Sb, Sn, Pb, Ta, Ti, W, V, Zn, Zr, or alloys thereof). In further embodiments, a metal additive is included in a concentration ranging from about 1% to about 50% (w/w).

Generally, in order to apply a nanolaminate coating onto a workpiece made of plastic or polymeric material, a strike layer is first coated onto the plastic or polymeric material of the workpiece. A strike layer is a very thin conductive layer that is deposited on a workpiece using a high current density and an electrolyte solution with a low ion concentration. In embodiments, a conductive material used for a strike layer comprises Ag, Al, Au, B, Be, C, Co, Cr, Cu, Fe, Hg, In, Ir, Mg, Mn, Mo, Nb, Nd, Ni, P, Pd, Pt, Re, Rh, Sb, Si, Sn, Pb, Ta, Ti, W, V, Zn, Zr, or alloys thereof. In some embodiments, a strike layer comprises Ni, Cu, or both.

A workpiece employed in the methods of the disclosure may have a length ranging from about 0.1 meters (m) to 15 m. In further embodiments, a workpiece has a length ranging from about 0.10 m to about 0.15 m; from about 0.10 m to about 0.5 m; from about 0.10 m to about 1.0 m; from about 0.10 m to about 0.4 m; from about 0.10 m to about 1.51 m; from about 0.10 m to about 10.7 m; from about 0.10 m to about 13.8 m; from about 0.15 m to about 0.4 m; from about 0.15 m to about 1.51 m; from about 0.15 m to about 10.7 m; from about 0.15 m to about 13.8 m; from about 0.3 m to about 0.7 m; from about 0.6 m to about 1.51 m; from about 1 m to about 2 m; from about 1 m to about 5 m; from about 1 m to about 14.5 m; from about 1.5 m to about 3.1 m; from about 1.5 m to about 6.1 m; from about 2 m to about 3 m; from about 3 m to about 4 m; from about 3 m to about 4.6 m; from about 4 m to about 5 m; from about 4.5 m to about 6.1 m; from about 5 m to about 6 m; from about 5 m to about 10 m; from about 5 m to about 14.5 m; from about 6 m to about 7 m; from about 6 m to about 7.7 m; from about 6 m to about 11 m; from about 7 m to about 8 m; from about 7.6 m to about 9.2 m; from about 8 m to about 9 m; from about 9 m to about 10 m; from about 9.1 m to about 10.7 m; from about 10 m to about 11 m; from about 10 m to about 14.5 m; from about 10.6 m to about 12.2 m; from about 10.6 m to about 13.8 m; from about 11 m to about 12 m; from about 12 m to about 13 m; from about 12.1 m to about 13.8 m; from about 13 m to about 13.5 m; from about 13.5 m to about 14 m; or from about 14 m to about 14.5 m. In some embodiments, a workpiece has a length ranging from about 0.10 m to about 0.15 m.

In embodiments, a workpiece includes a threaded portion at one or both ends. A threaded portion may be on the interior of a tubular workpiece or on the exterior of a workpiece. A workpiece may also include a threaded portion at some position between the two ends.

In some embodiments where a workpiece includes a threaded portion, a nanolaminate thread coating covers the threaded portion. In some embodiments, a nanolaminate thread coating is thinner than an interior nanolaminate coating. Embodiments of the present disclosure include a tubular article, comprising: a tubular workpiece having an interior surface and an exterior surface, the tubular workpiece comprising an interior threaded portion; an interior nanolaminate coating on the interior surface; an exterior nanolaminate coating on the exterior surface; and a nanolaminate thread coating on the threaded portion, the nanolaminate thread coating having a thickness that is less than a thickness of the interior nanolaminate coating and a thickness of the exterior nanolaminate coating. In some embodiments where a workpiece has more than one threaded portion, a nanolaminate thread coating is on each of the threaded portions.

In some certain embodiments where a threaded portion is on the interior of a tubular workpiece, a nanolaminate coating applied to a corresponding portion of the exterior of the tubular workpiece is a different thickness than a thickness of an inner nanolaminate coating, a thickness of an outer nanolaminate coating, or a thickness of a nanolaminate thread coating. Similarly, in some embodiments where a threaded portion is on the exterior of a tubular workpiece, a nanolaminate coating applied to a corresponding portion of the interior of the tubular workpiece is a different thickness that a thickness of an inner nanolaminate coating, a thickness of an outer nanolaminate coating, or a thickness of a nanolaminate thread coating.

A workpiece may undergo pre-processing steps. For example, a workpiece may be washed, etched, etc. before receiving an electrodeposited coating. Such pre-processing steps may improve adhesion of a nanolaminate coating, among other benefits.

Nanolaminate coatings of the present disclosure include a plurality of layers that repeat in a pattern. In some embodiments, a plurality of layers is made up of two layers that alternate. In further embodiments, nanolaminate coatings include a plurality of alternating first and second layers. Alternatively, one or more additional layers may be present in a coating between any first and second layer. In other embodiments, a plurality of layers is made up of more than two layers that repeat in any suitable pattern (e.g., A-B-C-A-B-C-A-B-C or A-B-C-B-A-B-C). In addition, the thickness of each of the plurality of layers may repeat in any suitable pattern.

In some embodiments, the inner nanolaminate coating, the outer nanolaminate coating, or both comprises a plurality of layers in a repeating pattern (e.g., [A-B-C]-[A-B-C]-[A-B-C], [A-B-C-D-E-F-G]-[A-B-C-D-E-F-G]-[A-B-C-D-E-F-G], or [A-B-C-D-B-D-B-A-B-C]-[A-B-C-D-B-D-B-A-B-C]-[A-B-C-D-B-D-B-A-B-C]). In various embodiments, the pattern comprises a series of at least three layers that repeat in a pattern. In embodiments, the pattern comprises a series of at least four layers that repeat in a pattern. In some embodiments, the pattern comprises a series of at least five layers that repeat in a pattern. In some embodiments, the pattern comprises a series of at least six layers that repeat in a pattern. In embodiments, the pattern comprises a series of at least 10 layers that repeat in a pattern. In specific embodiments, the pattern comprises a series of at least 12 layers that repeat in a pattern.

Each layer of a nanolaminate coating may comprise a metal, a metal alloy, or a ceramic. In embodiments, each layer of a nanolaminate coating includes at least one electrodepositable species independently selected from silver (Ag), aluminum (Al), gold (Au), boron (B), beryllium (Be), carbon (C), cobalt (Co), chromium (Cr), copper (Cu), iron (Fe), mercury (Hg), indium (In), iridium (Ir), magnesium (Mg), manganese (Mn), molybdenum (Mo), niobium (Nb), neodymium (Nd), nickel (Ni), phosphorous (P), palladium (Pd), platinum (Pt), rhenium (Re), rhodium (Rh), antimony (Sb), silicon (Si), tin (Sn), lead (Pb), tantalum (Ta), titanium (Ti), tungsten (W), vanadium (V), zinc (Zn), and zirconium (Zr). In some embodiments, each layer of a nanolaminate coating includes at least 0.01% (w/w) of Ag, Al, Au, B, Be, C, Co, Cr, Cu, Fe, Hg, In, Ir, Mg, Mn, Mo, Nb, Nd, Ni, P, Pd, Pt, Re, Rh, Sb, Si, Sn, Pb, Ta, Ti, W, V, Zn, or Zr. Each electrodepositable species may be present in a layer of a nanolaminate coating in a concentration of at least about 10% (w/w). In embodiments, each electrodepositable species may be present in a layer of a nanolaminate coating in a concentration of at least about 5% (w/w). In embodiments, each electrodepositable species may be present in a layer of a nanolaminate coating in a concentration of at least about 1% (w/w). In embodiments, each electrodepositable species may be present in a layer of a nanolaminate coating in a concentration of at least about 0.1% (w/w). In embodiments, each electrodepositable species may be present in a layer of a nanolaminate coating in a concentration of at least about 0.05% (w/w). In embodiments, each electrodepositable species may be present in a layer of a nanolaminate coating in a concentration of at least about 0.01% (w/w). In embodiments, each electrodepositable species may be present in a layer of a nanolaminate coating in a concentration of at least about 0.005% (w/w). In embodiments, each electrodepositable species may be present in a layer of a nanolaminate coating in a concentration of at least about 0.001% (w/w).

In certain embodiments, a layer of a nanolaminate coating comprises monocrystalline Co. In some embodiments, a layer of a nanolaminate coating comprises aluminum. In further embodiments, a layer of a nanolaminate coating comprises Ni or Cr. In particular embodiments, a layer of a nanolaminate coating comprises Ni, Fe, and Cr. In some embodiments, a layer of a nanolaminate coating comprises Ni, Fe, Cr, and Mo.

In some embodiments, each layer of a nanolaminate coating comprises two or more, three or more, four or more, or five or more different electrodepositable species. In some embodiments, each layer comprises an alloy of at least two metals. In some embodiments, each layer comprises an alloy of at least three metals.

In embodiments, a first layer and a second layer of a nanolaminate coating comprise a first alloy and a second alloy, respectively, which comprise the same first and second metals. In some embodiments, a difference between a concentration of a first metal in a first alloy and a first metal in a second alloy is less than about 50% (w/w). In some embodiments, a difference between a concentration of a first metal in a first alloy and a first metal in a second alloy may be no more than about 30% (w/w). In such embodiments, a difference between a concentration of a first metal in a first alloy and a first metal in a second alloy may be no more than about 20% (w/w). In such embodiments, a difference between a concentration of a first metal in a first alloy and a first metal in a second alloy may be no more than about 10% (w/w). In further embodiments, a difference between a concentration of a first metal in a first alloy and a first metal in a second alloy is more than about 1% (w/w). In some embodiments, a difference between a concentration of a first metal in a first alloy and a first metal in a second alloy is at least than about 2% (w/w). In some embodiments, a difference between a concentration of a first metal in a first alloy and a first metal in a second alloy is at least than about 5% (w/w). In some embodiments, a difference between a concentration of a first metal in a first alloy and a first metal in a second alloy is at least than about 10% (w/w).

Illustrative alloys that may be used in a layer of a nanolaminate coating comprise Zn and Fe; Zn and Ni; Co and Ni; Ni, Co, and Mo; Ni and Fe; Ni and Cr; Cu and Zn; Cu and Sn; Ni, Co, and P; Ni, Co, W, and P; Ni, Co, and W; Ni and W; Ni, W, and P; Ni, Co, and B; Ni, Co, W, and B; or Ni, W, and B. In specific embodiments, an alloy used in a layer of a nanolaminate coating includes Ni and Fe; or Ni and Co. In still further embodiments, a layer of a nanolaminate coating comprises three or more, four or more, or five or more of Co, Cr, Mo, W, Fe, Si, Mn, and Ni.

In embodiments, each layer comprises Ni and W. In embodiments, each layer comprises Ni and Mo. In embodiments, each layer comprises Ni, Mo, and W. In embodiments, each layer comprises Ni and Cr.

In embodiments, each of layer comprises NiCr, NiFe, NiCo, NiCrCo, NiAl, NiCrAl, NiFeAl, NiCoAl, NiCrCoAl, NiMo, NiCrMo, NiFeMo, NiCoMo, NiCrCoMo, NiW, NiCrW, NiFeW, NiCoW, NiCrCoW, NiMoW, NiNb, NiCrNb, NiFeNb, NiCoNb, NiCrCoNb, NiTi, NiCrTi, NiFeTi, NiCoTi, NiCrCoTi, NiCrP, NiCrAl, NiCoP, NiCoAl, NiFeP, NiFeAl, NiCrSi, NiCrB, NiCoSi, NoCoB, NiFeSi, NiFeB, ZnCr, ZnFe, ZnCo, ZnNi, ZnCrP, ZnCrAl, ZnFeP, ZnFeAl, ZnCoP, ZnCoAl, ZnNiP, ZnNiAl, ZnCrSi, ZnCrB, ZnFeSi, ZnFeB, ZnCoSi, ZnCoB, ZnNiSi, ZnNiB, CoCr, CoFe, CoCrP, CoFeP, CoCrAl, CoFeAl, CoCrSi, CoFeSi, CoCrB, CoFeB, CoAl, CoW, CoCrW, CoFeW, CoTi, CoCrTi, CoFeTi, CoTa, CoCrTa, CoFeTa, CoC, CoCrC, CoFeC, FeCr, FeCrP, FeCrAl, FeCrSi, or FeCrB. In some embodiments, each layer comprises NiCr, NiCo, NiW, or NiCoP.

In some embodiments, a layer (e.g., a first layer and/or a second layer) of a nanolaminate coating includes Ni in a concentration greater than about 50% (w/w). In some embodiments, a layer of a nanolaminate coating includes Ni in a concentration greater than about 55% (w/w). In some embodiments, a layer of a nanolaminate coating includes Ni in a concentration greater than about 60% (w/w). In some embodiments, a layer of a nanolaminate coating includes Ni in a concentration greater than about 65% (w/w), In some embodiments, a layer of a nanolaminate coating includes Ni in a concentration greater than about 70% (w/w). In some embodiments, a layer of a nanolaminate coating includes Ni in a concentration greater than about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w). In some embodiments, a layer of a nanolaminate coating includes Ni in a concentration less than about 99% (w/w). In some embodiments, a layer of a nanolaminate coating includes Ni in a concentration less than about 98% (w/w). In some embodiments, a layer of a nanolaminate coating includes Ni in a concentration less than about 97% (w/w). In some embodiments, a layer of a nanolaminate coating includes Ni in a concentration less than about 96% (w/w). In some embodiments, a layer of a nanolaminate coating includes Ni in a concentration less than about 70% (w/w). In some embodiments, a layer of a nanolaminate coating includes Ni in a concentration less than about 50% (w/w), about 55% (w/w), about 60% (w/w), about 65% (w/w), about 75% (w/w), about 80% (w/w), about 85% (w/w), about 90% (w/w), about 92% (w/w), about 93% (w/w), about 94% (w/w), or about 95% (w/w). In particular embodiments, a layer of a nanolaminate coating includes Ni in a concentration ranging from about 50% (w/w) to about 99% (w/w).

In certain embodiments, a layer of a nanolaminate coating includes Co in a concentration ranging from about 5% (w/w) to about 35% (w/w). In further embodiments, the second layer includes Co in a concentration ranging from about 5% (w/w) to about 10% (w/w), from about 10% (w/w) to about 15% (w/w), from about 15% (w/w) to about 20% (w/w), from about 20% (w/w) to about 25% (w/w), from about 25% (w/w) to about 30% (w/w), or from about 30% (w/w) to about 35% (w/w).

In embodiments, a layer of a nanolaminate coating comprises Cr in a concentration ranging from about 5% (w/w) to about 99% (w/w). In some embodiments, a layer of a nanolaminate coating includes Cr in a concentration greater than about 5% (w/w), about 10% (w/w), about 15% (w/w), about 20% (w/w), about 25% (w/w), about 30% (w/w), about 35% (w/w), about 40% (w/w), about 45% (w/w), about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w). In some embodiments, a layer of a nanolaminate coating includes Cr in a concentration less than about 5% (w/w), about 10% (w/w), about 15% (w/w), about 20% (w/w), about 25% (w/w), about 30% (w/w), about 35% (w/w), about 40% (w/w), about 45% (w/w), about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

In embodiments, a layer of nanolaminate coating comprises Cr in a concentration ranging from about 5% (w/w) to about 35% (w/w), a layer of nanolaminate coating comprises Ni in a concentration of greater than about 90% (w/w), or both. In further embodiments, a layer of nanolaminate coating comprises Ni in a concentration ranging from about 20% (w/w) to about 50% (w/w), Cr in a concentration ranging from about 20% (w/w) to about 35% (w/w), and Mo in a concentration great than about 1.5% (w/w). In some embodiments, a layer of a nanolaminate coating comprises Cr in a concentration greater than about 7% (w/w), Mo in a concentration ranging from about 5% (w/w) to about 30% (w/w), W in a concentration less than about 3% (w/w), Fe in a concentration ranging from about 1.5% (w/w) to about 15% (w/w), Si in a concentration less than 1% (w/w), Mn in a concentration less than 3% (w/w), and a balance of Ni.

In embodiments, a layer of a coating comprises Ni in a concentration ranging from about 40% (w/w) to about 70% (w/w) and W in a concentration ranging from about 20% (w/w) to about 60% (w/w). In some such embodiments, the layer of the coating may also comprise Mo in a concentration of up to about 40% (w/w).

In embodiments, a layer of a coating comprises Ni in a concentration ranging from about 50% (w/w) to about 70% (w/w) and W in a concentration ranging from about 30% (w/w) to about 50% (w/w). In some such embodiments, the layer of the coating may also comprise Mo in a concentration of up to about 30% (w/w).

In embodiments, a layer of a coating comprises Ni in a concentration of at least about 50% (w/w), and W and Mo in a collective concentration of up to about 50% (w/w). In embodiments, a layer of a coating comprises Ni in a concentration of at least about 60% (w/w), and W and Mo in a collective concentration of up to about 40% (w/w). In particular embodiments, a layer of a coating comprises Ni in a concentration of about 60% (w/w), and W and Mo in a collective concentration of about 40% (w/w). In particular embodiments, a layer of a coating comprises Ni in a concentration of about 60% (w/w), and W in a concentration of about 40% (w/w).

Each layer has a thickness in a range selected independently from about 5 nm to about 250 nm. Individual layers deposited may have a thickness in a range selected independently from about 5 nm to about 200 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, or from about 200 to about 250 nm.

In embodiments, each layer has a thickness in a range selected independently from about 5 nm to about 100 nm, from about 50 nm to about 150 nm, from about 100 nm to about 200 nm, or from about 150 nm to about 250 nm. In further embodiments, each layer has a thickness in a range selected independently from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, from about 200 nm to about 225 nm, from about 200 nm to about 250 nm, from about 220 nm to about 250 nm, or from about 150 nm to about 250 nm.

In embodiments, each layer has a thickness in a range selected independently from about 2 nm to about 750 nm. In embodiments, each layer has a thickness in a range selected independently from about 2 nm to about 500 nm. In embodiments, each layer has a thickness in a range selected independently from about 2 nm to about 250 nm. In embodiments, each layer has a thickness in a range selected independently from about 2 nm to about 200 nm.

An interface between individual layers may be discrete or diffuse. An interface between the neighboring layers is considered to be "discrete" if the composition shifts between a first layer and a second layer over a distance that is less than about 20% of a thickness of the thinner of the two layers. In embodiments, an interface between neighboring layers is considered to be discrete if the composition shifts between a first layer and a second layer over a distance that is less than about 15% of a thickness of the thinner of the layers. In embodiments, an interface between neighboring layers is considered to be discrete if the composition shifts between a first layer and a second layer over a distance that is less than about 10% of a thickness of the thinner of the layers. In embodiments, an interface between neighboring layers is considered to be discrete if the composition shifts between a first layer and a second layer over a distance that is less than about 8% of a thickness of the thinner of the layers. In embodiments, an interface between neighboring layers is considered to be discrete if the composition shifts between a first layer and a second layer over a distance that is less than about 5% of a thickness of the thinner of the layers. In embodiments, an interface between neighboring layers is considered to be discrete if the composition shifts between a first layer and a second layer over a distance that is less than about 4% of a thickness of the thinner of the layers. In embodiments, an interface between neighboring layers is considered to be discrete if the composition shifts between a first layer and a second layer over a distance that is less than about 2% of a thickness of the thinner of the layers.

In embodiments, an interface is "diffuse" if the composition shifts between a first layer and a second layer over a more than about 20% of the thickness of a thinner of the two layers. In embodiments, an interface between neighboring layers is considered to be diffuse if the composition shifts between a first layer and a second layer over a distance that is more than about 15% of a thickness of the thinner of the layers. In embodiments, an interface between neighboring layers is considered to be diffuse if the composition shifts between a first layer and a second layer over a distance that is more than about 10% of a thickness of the thinner of the layers. In embodiments, an interface between neighboring layers is considered to be diffuse if the composition shifts between a first layer and a second layer over a distance that is more than about 8% of a thickness of the thinner of the layers. In embodiments, an interface between neighboring layers is considered to be diffuse if the composition shifts between a first layer and a second layer over a distance that is more than about 5% of a thickness of the thinner of the layers. In embodiments, an interface between neighboring layers is considered to be diffuse if the composition shifts between a first layer and a second layer over a distance that is more than about 4% of a thickness of the thinner of the layers. In embodiments, an interface between neighboring layers is considered to be diffuse if the composition shifts between a first layer and a second layer over a distance that is more than or about 2% of a thickness of the thinner of the layers.

In embodiments, a diffuse interface has a composition shift between a first layer and a second layer over a thickness in a range of about 0.5 nm to about 5 nm. In some embodiments, a diffuse interface has a thickness in a range of about 0.5 nm to about 3 nm, about 1 nm to about 4 nm, or about 2 nm to about 5 nm. In further embodiments, a diffuse interface has a thickness in a range of about 0.5 nm to about 1 nm, about 1 nm to about 2 nm, about 2 nm to 3 nm, from about 3 nm to about 4 nm, or from about 4 nm to about 5 nm.

An overall thickness of each nanolaminate coating present on different portions of a workpiece (e.g., an inner nanolaminate coating, an outer nanolaminate coating, and a nanolaminate thread coating) may vary widely depending on an application of the coatings. In embodiments, a coating is substantially continuous over the entire workpiece. In embodiments, a coating is continuous over the entire workpiece. In some embodiments, a coating that is present on a particular portion of the workpiece is uniform or substantially uniform in thickness. In embodiments, a nanolaminate coating (e.g., an inner nanolaminate coating, an outer nanolaminate coating, etc.) has substantially the same thickness at two or more locations. In embodiments, a nanolaminate coating of the present disclosure has substantially the same thickness at three or more locations. In embodiments, a nanolaminate coating of the present disclosure has substantially the same thickness at four or more locations. In embodiments, a nanolaminate coating of the present disclosure has substantially the same thickness at five or more locations. In certain embodiments, a coating has two or more thicknesses across a length of a portion of the workpiece.

In embodiments, a coating has a thickness ranging from about 5 nm to about 5 cm. In some embodiments, each coating has a thickness in a range selected independently from about 5 nm to about 200 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, from about 200 to about 250 nm, from about 1 μm to about 5 centimeters (cm), from about 1 μm to about 50 μm, from about 50 μm to about 100 μm, from about 100 μm to about 200 μm, from about 200 μm to about 500 μm, from about 500 μm to about 800 μm, from about 800 μm to about 1.2 millimeters (mm), from about 500 μm to about 1 mm, from about 1 mm to about 1.5 mm, from about 1.2 mm to about 2 mm, from about 1.8 mm to about 2.5 mm, from about 2 mm to about 3 mm, from about 2.5 mm to about 5 mm, from about 1 mm to about 5 mm, from about 5 mm to about 1 cm, from about 1 cm to about 2 cm, or from about 2 cm to about 5 cm.

In particular embodiments, each coating independently has a thickness ranging from about 5 μm to about 3,500 μm. In further embodiments, a coating has a thickness in a range selected independently from about 25 μm to about 2,250 μm, from about 125 μm to about 2,050 μm, from about 125 μm to about 1,750 μm, from about 200 μm to about 1,500 μm, from about 250 μm to about 1,250 μm, from about 250 μm to about 1,000 μm, from about 250 μm to about 750 μm, from about 500 μm to about 1,000 μm. In yet further embodiments, the coatings have a thickness in a range selected independently from about 25 μm to about 125 μm, from about 50 μm to about 150 μm, about 125 μm to about 250 μm, about 250 μm to about 375 μm, about 375 μm to about 500 μm, about 500 μm to about 750 μm, about 750 μm to about 1,000 μm, about 1,000 μm to about 1,250 μm, about 1,250 μm to about 1,500 μm, about 1,500 μm to about 1,750 μm, about 1,750 μm to about 2,000 μm, about 2,000 μm to about 2,250 μm, about 2,250 μm to about 2,500 μm, about 2,500 μm to about 2,750 μm, and about 2,750 μm to about 3,000 μm.

In embodiments, a thickness of a nanolaminate thread coating does not prevent threading from being joined with a second item having corresponding threading. In further embodiments, a nanolaminate thread coating is not compromised by the joining of a threaded portion of an article with the corresponding threading of a second item. In certain embodiments, a thickness of a nanolaminate thread coating ranges from about 50 μm to about 150 μm.

Nanolaminate coatings as described herein may include a large number of layers. Coatings may include at least two layers, at least three layers, at least four layers, at least six layers, at least eight layers, at least ten layers, at least 20 layers, at least 30 layers, at least 50 layers, at least 100 layers, at least 200 layers, at least 500 layers, at least 1,000 layers, at least 1,500 layers, at least 2,000 layers, at least 2,500 layers, at least 3,000 layers, at least 3,500 layers, at least 4,000 layers, at least 5,000 layers, at least 6,000 layers, at least 7,000 layers, or at least 8,000 layers. In embodiments, a number of layers in a coating is in a range from about 50 layers to about 8,000 layers. In some embodiments, the number of layers in a coating is in the range of about 100 layers to about 8,000 layers. In further embodiments, the number of layers in a coating is in the range of about 50 layers to about 100 layers, from about 100 layers to about 1,000 layers, from about 1,000 layers to about 2,000 layers, from about 2,000 layers to about 4,000 layers, from about 4,000 layers to about 8,000 layers, or greater than about 8,000 layers. Each nanolaminate coating present on different portions of a workpiece may have a different number of layers applied. In other embodiments, each nanolaminate coating present on different portions of a workpiece has the same number of layers applied.

Specific properties conferred by nanolaminate coatings of the present disclosure provide for improved corrosion, wear, and heat resistance properties in an article. Accordingly, in embodiments, a workpiece is chosen to be coated in order to be used in highly corrosive service environments. In embodiments, an article is an oil country tubular good (OCTG), a line pipe, or a connector for joining two OCTGs. In particular embodiments, an article is a down-hole tubular. In some embodiments, a down-hole tubular is an expandable tubular. In particular embodiments, an article is a connector.

In some embodiments, a tubular article is resistant to $H_2S$-induced sulfide stress cracking under sour service environments having a $H_2S$ partial pressure greater than 0.05 psi (0.3 kPa). In further embodiments, a nanolaminate coating does not lose more than 25% of its mass when subjected to National Association of Corrosion Engineers (NACE) TM0193-2016 standardized testing with 15% HCl at 75 degrees Celsius for 6 hours. In additional embodiments an article is resistant to cracking of the nanolaminate coating when exposed to autoclave environments per NACE standard TM0175 or American Society for Testing and Materials (ASTM) E399 standardized testing for high sour gas conditions. In still further embodiments, an article is resistance to pitting wherein individual pits are not deeper than 10% of the nanolaminate coating when tested according to ASTM G48 testing standards. In yet further embodiments, an article is resistance to pitting wherein individual pits are not deeper than 10% of the nanolaminate coating in a service environment with a pH ranging from about 3 to about 7. In additional embodiments, an article is resistance to pitting wherein individual pits are not deeper than 10% of the nanolaminate coating in a service environment with a pH ranging from about 7 to about 6.5, about 6.5 to about 6, about 6 to about 5.5, about 5.5 to about 5, about 5 to about 4.5, about 4.5 to about 4, about 4 to about 3.5, or about 3.5 to about 3.

In embodiments, an article is resistant to cracking when subjected to tensile load of 80% of the yield strength of the article in sulfide stress cracking environment for 720 hours according to NACE TM0177 standardized testing in a service environment with a pH ranging from about 3 to about 7. In certain embodiments, an article is resistant to cracking when subjected to tensile load of 80% of the yield strength of the article in sulfide stress cracking environment for 720 hours according to NACE TM0177 standardized testing in a service environment with a pH ranging from about 7 to about 6.5, about 6.5 to about 6, about 6 to about 5.5, about 5.5 to about 5, about 5 to about 4.5, about 4.5 to about 4, about 4 to about 3.5, or about 3.5 to about 3. Articles of the present disclosure include those produced by any method described herein. Additionally, articles of the present disclosure include an oil country tubular good (OCTG) produced by any method described herein.

EMBODIMENTS

The following embodiments are included within the scope of this disclosure.

1. An apparatus comprising:

at least one support structure configured to support a plurality of workpieces around a rotational axis, each workpiece of the plurality of workpieces having a substantially cylindrical shape with an outer surface and a longitudinal axis; and a drive assembly configured to rotate the plurality of workpieces around the rotational axis.

2. The apparatus of Embodiment 1, further comprising a contact point assembly configured to enable electrical contact with the plurality of workpieces.

3. The apparatus of Embodiment 2, wherein the contact point assembly is configured to rotate each workpiece of the plurality of workpieces around its respective longitudinal axis.

4. The apparatus of any one of Embodiments 2-3, wherein the contact point assembly is configured to rotate the plurality of workpieces around the rotational axis in a first direction and to rotate individual workpieces of the plurality of workpieces around its respective longitudinal axis in a second direction.

5. The apparatus of any one of Embodiments 1-4, wherein the drive assembly comprises a central rod aligned along the rotational axis.

6. The apparatus of any one of Embodiments 1-5, further comprising a motor coupled to the drive assembly and configured to provide rotational motion to the drive assembly.

7. The apparatus of Embodiment 6, wherein the drive assembly further comprises a gear configured to transfer motion from the motor to rotate the plurality of workpieces around the rotational axis.

8. The apparatus of Embodiment 7, wherein the contact point assembly comprises a series of gears configured to transfer motion from the motor to rotate each of the plurality of workpieces.

9. The apparatus of any one of Embodiments 1-8, wherein each workpiece of the plurality of workpieces has a hollow cavity defined by an inner surface.

10. The apparatus of any one of Embodiments 2-9, further comprising a conductive bus supported by the rack, the conductive bus configured to be in electrical contact with the plurality of workpieces via the contact point assembly, such that the plurality of workpieces are free to rotate around the rotational axis while maintaining electrical contact with the conductive bus.

11. The apparatus of any one of Embodiments 2-10, wherein the contact point assembly comprises a plurality of contacts.

12. The apparatus of Embodiment 11, wherein at least a first contact of the plurality of contacts is configured to be in electrical contact with at least a first portion of the plurality of workpieces.

13. The apparatus of Embodiment 12, wherein the first contact comprises a threaded portion.

14. The apparatus of any one of Embodiments 11-13, wherein each of the contacts of the plurality of contacts comprises a threaded portion configured to couple to a threaded portion of an individual workpiece of the plurality of workpieces.

15. The apparatus of any one of Embodiments 11-14, wherein the plurality of contacts comprises a series of peripheral rods, wherein an individual peripheral rod of the series of peripheral rods is configured to be positioned within the hollow cavity of at least one workpiece of the plurality of workpieces substantially along the longitudinal axis of the at least one workpiece of the plurality of workpieces or an axis substantially parallel to the longitudinal axis of the at least one workpiece of the plurality of workpieces.

16. The apparatus of any one of Embodiments 5-15, further comprising a first bearing assembly positioned at a first end of the central rod.

17. The apparatus of Embodiment 16, wherein the first bearing assembly comprises a needle roller bearing having a plurality of cylindrical rollers.

18. The apparatus of Embodiment 17, wherein the first needle roller bearing is sheathed in a bearing housing.

19. The apparatus of any of Embodiments 10-18, wherein the conductive bus is configured to maintain electrical contact with the outer surface of an individual workpiece of the plurality of workpieces.

20. The apparatus of any of Embodiments 10-18, wherein the conductive bus is configured to maintain electrical contact with the inner surface of an individual workpiece of the plurality of workpieces.

21. The apparatus of any one of Embodiments 2-20, wherein the contact point assembly comprises a first conductive article.

22. The apparatus of Embodiment 21, wherein the first conductive article is configured to maintain physical contact with the inner surface of an individual workpiece of the plurality of workpieces.

23. The apparatus of any one of Embodiments 2-22, wherein the contact point assembly comprises a plurality of conductive articles.

24. The apparatus of Embodiment 23, wherein the plurality of conductive articles comprises one or more of a flexible sheet, a brush, a rod, or a wire.

25. The apparatus of any one of Embodiments 23 or 24, wherein the plurality of conductive articles comprises two or more linkages.

26. The apparatus of any one of Embodiments 23-25, wherein the conductive bus is configured to be in electrical contact with the workpiece via the plurality of conductive articles.

27. The apparatus of Embodiment 26, wherein at least one conductive article of the plurality of conductive articles is configured to maintain physical contact with a peripheral rod of the plurality of peripheral rods during rotation of the plurality of workpieces.

28. The apparatus of any one of Embodiments 10-27, wherein the conductive bus is a bus bar that is positioned substantially parallel to the rotational axis.

29. The apparatus of any one of Embodiments 1-28, further comprising shielding or thieving positioned adjacent to an individual workpiece of the plurality of workpieces.

30. The apparatus of Embodiment 29, wherein at least the portion of the shielding is substantially circular, semi-circular, or rectangular.

31. The apparatus of Embodiment 29 or 30, wherein at least the portion of the shielding is substantially cuboidal, substantially cylindrical, or substantially semi-cylindrical.

32. The apparatus of any one of Embodiments 29-31, wherein the shielding comprises acrylic.

33. The apparatus of any one of Embodiments 1-32, wherein the rotational axis is positioned at an incline ranging from about 0.5 degrees to about 2.5 degrees relative to horizontal.

34. The apparatus of Embodiment 33, wherein the rotational axis is positioned at an incline ranging from about 0.5 degrees to about 1 degree.

35. The apparatus of Embodiment 33, wherein the rotational axis is positioned at an incline ranging from about 1 degree to about 1.5 degrees.

36. The apparatus of Embodiment 33, wherein the rotational axis is positioned at an incline ranging from about 1.5 degrees to about 2 degrees.

37. The apparatus of Embodiment 33, wherein the rotational axis is positioned at an incline ranging from about 2 degrees to about 2.5 degrees.

38. The apparatus of any one of Embodiments 1-37, wherein each workpiece of the plurality of workpieces has a length ranging from about 0.1 meters (m) to 15 m.

39. The apparatus of Embodiment 35, wherein each workpiece of the plurality of workpieces has a length ranging from about 0.10 m to about 0.15 m; from about 0.10 m to about 0.4 m; from about 0.10 m to about 1.51 m; from about 0.10 m to about 10.7 m; from about 0.10 m to about 13.8 m; from about 0.15 m to about 0.4 m; from about 0.15 m to about 1.51 m; from about 0.15 m to about 10.7 m; from about 0.15 m to about 13.8 m; from about 0.3 m to about 0.7 m; from about 0.6 m to about 1.51 m; from about 1 m to about 2 m; from about 1 m to about 5 m; from about 1 m to about 14.5 m; from about 1.5 m to about 3.1 m; from about 1.5 m to about 6.1 m; from about 2 m to about 3 m; from about 3 m to about 4 m; from about 3 m to about 4.6 m; from about 4 m to about 5 m; from about 4.5 m to about 6.1 m; from about 5 m to about 6 m; from about 5 m to about 10 m; from about 5 m to about 14.5 m; from about 6 m to about 7 m; from about 6 m to about 7.7 m; from about 6 m to about 11 m; from about 7 m to about 8 m; from about 7.6 m to about 9.2 m; from about 8 m to about 9 m; from about 9 m to about 10 m; from about 9.1 m to about 10.7 m; from about 10 m to about 11 m; from about 10 m to about 14.5 m; from about 10.6 m to about 12.2 m; from about 10.6 m to about 13.8 m; from about 11 m to about 12 m; from about 12 m to about 13 m; from about 12.1 m to about 13.8 m; from about 13 m to about 13.5 m; from about 13.5 m to about 14 m; or from about 14 m to about 14.5 m.

40. A system comprising:

a plurality of workpieces around a rotational axis, each workpiece of the plurality of workpieces having a substantially cylindrical shape with an outer surface and a longitudinal axis; and an apparatus of any one of Embodiments 1-39.

41. The system of Embodiment 40, further comprising a plurality of couplers.

42. The system of Embodiment 41, wherein individual workpieces of the plurality of workpieces are coupled in series with individual couplers of the plurality of couplers arranged between the individual workpieces.

43. The system of any one of Embodiments 40-42, further comprising a process tank that, in operation, houses at least a portion of the apparatus.

44. The system of Embodiment 43, further comprising an electrolyte bath in the process tank.

45. The system of any one of Embodiments 40-44, wherein each workpiece of the plurality of workpieces comprises an inner surface and a hollow cavity defined by the inner surface, and wherein the system further comprises an interior anode positioned within the hollow cavity.

46. The system of Embodiment 45, further comprising an electrolyte distribution tube positioned adjacent to the interior anode within the hollow cavity.

47. The system of Embodiment 46, wherein the electrolyte distribution tube comprises a plurality of holes that extend laterally through the electrolyte distribution tube.

48. The system of Embodiment 47, wherein a number of a subset of the plurality of holes that is in a predetermined area of the electrolyte distribution tube varies along a length of the electrolyte distribution tube.

49. The system of Embodiment 47 or 48, wherein diameters of individual holes of the plurality holes vary along a length of the electrolyte distribution tube.

50. The system of any one of Embodiments 43-49, further comprising a flow control unit to distribute at least a portion of the electrolyte bath through the process tank.

51. The system of Embodiment 50, wherein the flow control unit, in operation, introduces at least a portion of the electrolyte bath into the hollow cavity of the workpiece.

52. The system of Embodiment 50 or 51, wherein the flow control unit, in operation, transmits at least a portion of the electrolyte bath through the plurality of holes in the electrolyte distribution tube.

53. The system of any one of Embodiments 45-52, wherein the flow control unit, in operation, transmits at least a portion of the electrolyte bath through a plurality of holes in the interior anode.

54. The system of any one of Embodiments 45-53, further comprising:

a power supply electrically coupled to the interior anode; and a power supply controller that, in operation, controls at least one of a current and a voltage applied to the plurality of workpieces.

55. The system of Embodiment 54, wherein the power supply controller, in operation, controls a current density applied to the workpiece, wherein the current density varies over time.

56. The system of Embodiment 54 or 55, further comprising an exterior anode electrically coupled to the power supply, wherein the power supply controller, in operation, controls at least one of a current and a voltage applied to the workpiece.

57. The system of Embodiment 56, wherein the exterior anode has a length that is less than or equal to a length of an individual workpiece of the plurality of workpieces.

58. The system of Embodiment 56 or 57, wherein the exterior anode is positioned substantially parallel to the rotational axis at a substantially uniform distance from the rotational axis.

59. The system of any one of Embodiments 54-58, wherein the power supply is a single power supply and wherein the power supply controller, in operation, distributes power supplied by the power supply to the conductive bus.

60. The system of any one of Embodiments 54-58, wherein the power supply comprises two or more power supply devices; and the power supply controller, in operation, distributes power supplied by the two or more power supply devices to the conductive bus.

61. The system of any one of Embodiments 54-60, wherein the power supply controller, in operation, distributes power supplied by the power supply to at least one location on the conductive bus.

62. The system of any one of Embodiments 54-61, wherein the power supply controller, in operation, distributes power supplied by the power supply to at least two locations, at least three locations, at least four locations, or at least five locations on the conductive bus.

63. The system of any one of Embodiments 54-62, further comprising a second power supply controller.

64. A method for producing a nanolaminate coating on a plurality of workpieces, the method comprising:

introducing the plurality of workpieces, each workpiece being substantially cylindrical, having a longitudinal axis, and having an outer surface, to a system of any one of Embodiments 40-63;

rotating the plurality of workpieces around a rotational axis at a rotational speed; and electrodepositing an electrodepositable species onto the plurality of workpieces as a first nanolaminate coating on at least a portion of the outer surface of each of the plurality of workpieces.

65. The method of Embodiment 64, further comprising rotating each workpiece around the respective longitudinal axis at an individual rotational speed.

66. The method of Embodiment 64 or 65, wherein the electrodepositing comprises applying a voltage or a current to a conductive article, a contact, or a coupler in contact with at least a portion of the plurality of workpieces.

67. The method of Embodiment 66, wherein the contact is a rod.

68. The method of Embodiment 66 or 67, wherein the electrodepositing comprises varying the voltage or the current over time.

69. The method of any one of Embodiments 64-68, wherein the rotating the plurality of workpieces around the rotational axis comprises varying the rotational speed over time.

70. The method of any one of Embodiments 65-69, wherein the rotating each workpiece around the respective longitudinal axis comprises varying the individual rotational speed over time.

71. The method of any one of Embodiments 64-70, wherein introducing the plurality of workpieces comprises coupling individual workpieces of the plurality of workpieces together in series.

72. The method of Embodiment 71, wherein introducing the plurality of workpieces comprises coupling couplers between individual workpieces of the plurality of workpieces.

73. The method of Embodiment 71 or 72, wherein introducing the plurality of workpieces comprises inserting a rod through an interior hollow cavity of a portion of the plurality of workpieces.

74. The method of Embodiment 73, further comprising coupling the rod to a conductive bus.

75. The method of any one of Embodiments 64-74, wherein introducing the plurality of workpieces to the system comprises positioning an interior anode along the longitudinal axis of a portion of the plurality of workpieces or an axis substantially parallel to the longitudinal axis within the hollow cavity of a portion of the plurality of workpieces such that an exterior surface of the interior anode is positioned a predetermined distance from the inner surface of the portion of the plurality of workpieces.

76. The method of Embodiment 75, wherein the electrodepositing the electrodepositable species comprises distributing a portion of the electrolyte bath into the hollow cavity of the workpiece via a hollow cavity of the interior anode or a plurality of holes that extend laterally through the interior anode.

77. The method of Embodiment 75 or 76, wherein the electrodepositing the electrodepositable species comprises distributing a portion of the electrolyte bath into the hollow cavity via an electrolyte distribution tube positioned in the hollow cavity of the workpiece.

78. The method of Embodiment 77, wherein the electrodepositing the electrodepositable species comprises distributing a portion of the electrolyte bath into the hollow cavity via a plurality of holes in an electrolyte distribution tube positioned in the hollow cavity of the workpiece.

79. The method of any one of Embodiments 64-78, further comprising positioning an exterior anode adjacent to the workpiece.

80. The method of any one of Embodiments 75-79, further comprising electrodepositing the electrodepositable species onto the plurality of workpieces as a second nanolaminate coating on at least a portion of the inner surface of each of the plurality of workpieces.

81. The method of any one of Embodiments 64-80, wherein the plurality of workpieces comprise a steel alloy.

82. The method of Embodiment 81, wherein the steel alloy comprises:

(A) carbon (C) and iron (Fe);

(B) C, Fe, and molybdenum (Mo); or (C) C, Fe, Mo, and cobalt (Co).

83. The method of any one of Embodiments 64-82, wherein each workpiece of the plurality of workpieces comprises a plastic, and further comprise a strike layer on the plastic.

84. The method of Embodiment 83, wherein the plastic comprises an arylamide, an acrylamide, a polybenzimidazole (PBI), a polyetherimide, a polyetherketoneketone (PEKK), a polyether ether ketone (PEEK), a polyamide, a polyimide, a polyamide-imide, a polyphenylene oxide (PPO), a polystyrene (PS), a polyphenylene oxide (PPO), a polystyrene (PS), a polyphthalamide (PPA), a polyvinyl alcohol (PVA), an acrylonitrile butadiene styrene (ABS), a polycarbonate (PC), a polylactic acid (PLA), a PC/ABS, a cellulose fiber, a polyphenylsulfone (PPSU), a thermoset, a PBI-PEEK, a urea, an epoxy, a cyanate ester, a polyurethane, or any combination thereof.

85. The method of Embodiment 83 or 84, wherein the strike layer comprises silver (Ag), aluminum (Al), gold (Au), boron (B), beryllium (Be), carbon (C), cobalt (Co), chromium (Cr), copper (Cu), iron (Fe), mercury (Hg), indium (In), iridium (Ir), magnesium (Mg), manganese (Mn), molybdenum (Mo), niobium (Nb), neodymium (Nd), nickel (Ni), phosphorous (P), palladium (Pd), platinum (Pt), rhenium (Re), rhodium (Rh), antimony (Sb), silicon (Si), tin (Sn), lead (Pb), tantalum (Ta), titanium (Ti), tungsten (W), vanadium (V), zinc (Zn), zirconium (Zr), or alloys thereof.

86. The method of any one of Embodiments 64-85, wherein each workpiece of the plurality of workpieces is a connector for joining two oil country tubular goods (OCTG).

87. The method of any one of Embodiments 80-86, wherein the first nanolaminate coating, the second nanolaminate coating, or both each comprise at least two layers.

88. The method of any one of Embodiments 80-87, wherein the first nanolaminate coating is substantially the same thickness at two or more, three or more, four or more, or five or more locations;

wherein the second nanolaminate coating is substantially the same thickness at two or more, three or more, four or more, or five or more locations; or both.

89. The method of embodiment 88, wherein the first nanolaminate coating, the second nanolaminate coating or both comprises a series of layers in a pattern that repeats.

90. The method of Embodiment 89, wherein the series of layers comprises at least three layers that repeat.

91. The method of Embodiment 89, wherein the series of layers comprises at least four layers that repeat.

92. The method of Embodiment 89, wherein the series of layers comprises at least five layers that repeat.

93. The method of Embodiment 89, wherein the series of layers comprises at least ten layers that repeat.

94. The method of any one of Embodiments 89-93, wherein each layer of the series of layers independently comprises at least one electrodepositable species independently selected from Ag, Al, Au, B, Be, C, Co, (Cr, Cu, Fe, Hg, In, Ir, Mg, Mn, Mo, Nb, Nd, Ni, P, Pd, Pt, Re, Rh, Sb, Si, Sn, Pb, Ta, Ti, W, V, Zn, and Zr.

95. The method of Embodiment 94, wherein each electrodepositable species of the at least one electrodepositable species is present in a concentration of at least 0.01% (w/w).

96. The method of any one of Embodiments 89-95, wherein each layer of the series of layers independently comprises Ni in a concentration at least about 10% (w/w).

97. The method of any one of Embodiments 89-96, wherein each layer of the series of layers independently comprises Ni in a concentration at least about 15% (w/w).

98. The method of Embodiment 97, wherein at least one layer of the series of layers comprises Ni in a concentration ranging from about 50% (w/w) to about 99% (w/w).

99. The method of any one of Embodiments 96-98, wherein at least one layer of the series of layers comprises Ni in a concentration greater than about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

100. The method of any one of Embodiments 96-99, wherein at least one layer of the series of layers comprises Co in a concentration ranging from about 5% (w/w) to about 35% (w/w).

101. The method of any one of Embodiments 96-100, wherein at least one layer of the series of layers comprises Co in a concentration ranging from about 5% (w/w) to about 10% (w/w), about 10% (w/w) to about 15% (w/w), about 15% (w/w) to about 20% (w/w), about 20% (w/w) to about 25% (w/w), about 25% (w/w) to about 30% (w/w), or about 30% (w/w) to about 35% (w/w).

102. The method of any one of Embodiments 96-101, wherein at least one layer of the series of layers comprises Cr in a concentration ranging from about 5% (w/w) to about 99% (w/w).

103. The method of any one of Embodiments 96-102, wherein the at least one layer of the series of layers comprises Cr in a concentration greater than: about 5% (w/w), about 10% (w/w), about 15% (w/w), about 20% (w/w), about 25% (w/w), about 30% (w/w), about 35% (w/w), about 40% (w/w), about 45% (w/w), about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

104. The method of any one of Embodiments 96-103, wherein at least one layer of the series of layers comprises Cr in a concentration less than: about 5% (w/w), about 10% (w/w), about 15% (w/w), about 20% (w/w), about 25% (w/w), about 30% (w/w), about 35% (w/w), about 40% (w/w), about 45% (w/w), about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

105. The method of any of Embodiments 96-104, wherein each layer of the series of layers comprise Ni and W.

106. The method of Embodiment 105, wherein each layer of the series of layers further comprises Mo.

107. The method of Embodiment 105 or 106, wherein at least one layer of the series of layers comprise Ni in a concentration ranging from about 40% (w/w) to about 70% (w/w);

wherein at least one layer of the series of layers comprise W in a concentration ranging from about 30% (w/w) to about 50% (w/w); or both.

108. The method of Embodiment 107, wherein at least one layer of the series of layers comprises Mo in a concentration of up to about 40% (w/w).

109. The method of any one of Embodiments 96-108, wherein at least one layer of the series of layers comprises Ni in a concentration of about 60% (w/w), and W in a concentration of about 40% (w/w).

110. The method of any one of Embodiments 89-109, wherein each layer of the series of layers has a thickness independently selected from about 5 nanometers (nm) to about 250 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, or from about 200 to about 250 nm.

111. The method of Embodiment 110, wherein the first nanolaminate coating and the second nanolaminate coating each comprise a series of alternating layers.

112. The method of Embodiment 111, wherein the series of alternating layers comprises alternating first layers and second layers, each first layer comprising at least one electrodepositable species independently selected from Ag, Al, Au, B, Be, C, Co, (Cr, Cu, Fe, Hg, In, Ir, Mg, Mn, Mo, Nb, Nd, Ni, P, Pd, Pt, Re, Rh, Sb, Si, Sn, Pb, Ta, Ti, W, V, Zn, and Zr; and each second layer comprising at least one electrodepositable species independently selected from Ag, Al, Au, B, Be, C, Co, Cr, Cu, Fe, Hg, In, Ir, Mg, Mn, Mo, Nb, Nd, Ni, P, Pd, Pt, Re, Rh, Sb, Si, Sn, Pb, Ta, Ti, W, V, Zn, and Zr.

113. The method of Embodiment 112, wherein:

the first layers comprises each electrodepositable species of the at least one electrodepositable species in a concentration of at least 0.01% (w/w); and the second layers comprises each electrodepositable species of the at least one electrodepositable species in a concentration of at least 0.01% (w/w).

114. The method of Embodiment 112 or 113, wherein the first layers or the second layers comprises Ni in a concentration ranging from about 50% (w/w) to about 99% (w/w).

115. The method of any one of Embodiments 112-114, wherein the first layers or the second layers comprises Ni in a concentration greater than about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

116. The method of any one of Embodiments 112-115, wherein the first layers or the second layers comprises Co in a concentration ranging from about 5% (w/w) to about 35% (w/w).

117. The method of any one of Embodiments 112-116, wherein the first layers or the second layers comprises Co in a concentration ranging from about 5% (w/w) to about 10% (w/w), about 10% (w/w) to about 15% (w/w), about 15% (w/w) to about 20% (w/w), about 20% (w/w) to about 25% (w/w), about 25% (w/w) to about 30% (w/w), or about 30% (w/w) to about 35% (w/w).

118. The method of any one of Embodiments 112-117, wherein the first layer or the second layer comprises Cr in a concentration ranging from about 5% (w/w) to about 99% (w/w).

119. The method of any one of Embodiments 112-118, wherein the first layers or the second layers comprises Cr in a concentration greater than: about 5% (w/w), about 10% (w/w), about 15% (w/w), about 20% (w/w), about 25% (w/w), about 30% (w/w), about 35% (w/w), about 40% (w/w), about 45% (w/w), about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

120. The method of any one of Embodiments 112-119, wherein the first layers or the second layers comprises Cr in a concentration less than: about 5% (w/w), about 10% (w/w), about 15% (w/w), about 20% (w/w), about 25% (w/w), about 30% (w/w), about 35% (w/w), about 40% (w/w), about 45% (w/w), about 50% (w/w), about 55% (w/w), about 60% (w/w), about 65% (w/w), about 70% (w/w), about 75% (w/w), about 80% (w/w), about 85% (w/w), about 90% (w/w), about 92% (w/w), about 93% (w/w), about 94% (w/w), about 95% (w/w), about 96% (w/w), about 97% (w/w), about 98% (w/w), or about 99% (w/w).

121. The method of any of Embodiments 112-120, wherein each of the first layers and the second layers comprise Ni and W.

122. The method of Embodiment 121, wherein each of the first layers and the second layers further comprise Mo.

123. The method of Embodiment 121 or 122, wherein the first layer, the second, layer, or both, independently comprise Ni in a concentration ranging from about 40% (w/w) to about 70% (w/w);

wherein the first layer, the second layer, or both, independently comprise W in a concentration ranging from about 30% (w/w) to about 50% (w/w); or both.

124. The method of Embodiment 123, wherein the first layer, the second layer, or both, independently comprise Mo in a concentration of up to about 40% (w/w).

125. The method of any one of Embodiments 121-124, wherein the first layer, the second layer, or both, independently comprise Ni in a concentration of about 60% (w/w), and W in a concentration of about 40% (w/w).

126. The method of any one of Embodiments 89-125, wherein each of the layers in the series of layers has a thickness independently selected from about 5 nanometers (nm) to about 250 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, or from about 200 to about 250 nm.

127. The method of any one of Embodiments 80-126, wherein the number of layers in the first nanolaminate coating and the second nanolaminate coating comprise a same number of layers.

128. The method of Embodiment 127, wherein the same number of layers ranges from about 50 layers to about 8,000 layers.

129. The method of Embodiment 127 or 128, wherein the same number of layers ranges from about 50 layers to about 100 layers; from about 100 layers to about 1,000 layers, from about 1,000 layers to about 2,000 layers, from about 2,000 layers to about 4,000 layers, or from about 4,000 layers to about 8,000 layers.

130. The method of any one of Embodiments 80-129, wherein the first nanolaminate coating, the second nanolaminate coating, or both independently have a thickness ranging from about 5 nm to about 200 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, from about 200 to about 250 nm, from about 1 μm to about 5 centimeters (cm), from about 1 μm to about 50 μm, from about 50 μm to about 100 μm, from about 100 μm to about 200 μm, from about 200 μm to about 500 μm, from about 500 μm to about 800 μm, from about 800 μm to about 1.2 millimeters (mm), from about 500 μm to about 1 mm, from about 1 mm to about 1.5 mm, from about 1.2 mm to about 2 mm, from about 1.8 mm to about 2.5 mm, from about 2 mm to about 3 mm, from about 2.5 mm to about 5 mm, from about 1 mm to about 5 mm, from about 5 mm to about 1 cm, from about 1 cm to about 2 cm, or from about 2 cm to about 5 cm.

131. The method of any one of Embodiments 64-130, wherein the plurality of workpieces each has a length ranging from about 0.1 meters (m) to 15 m.

132. The method of any one of Embodiments 64-131, wherein the plurality of workpieces each have a length ranging from about 0.10 m to about 0.15 m; from about 0.10 m to about 0.5 m; from about 0.10 m to about 1.0 m; from about 0.10 m to about 0.4 m; from about 0.10 m to about 1.51 m; from about 0.10 m to about 10.7 m; from about 0.10 m to about 13.8 m; from about 0.15 m to about 0.4 m; from about 0.15 m to about 1.51 m; from about 0.15 m to about 10.7 m; from about 0.15 m to about 13.8 m; from about 0.3 m to about 0.7 m; from about 0.6 m to about 1.51 m; from about 1 m to about 2 m; from about 1 m to about 5 m; from about 1 m to about 14.5 m; from about 1.5 m to about 3.1 m; from about 1.5 m to about 6.1 m; from about 2 m to about 3 m; from about 3 m to about 4 m; from about 3 m to about 4.6 m; from about 4 m to about 5 m; from about 4.5 m to about 6.1 m; from about 5 m to about 6 m; from about 5 m to about 10 m; from about 5 m to about 14.5 m; from about 6 m to about 7 m; from about 6 m to about 7.7 m; from about 6 m to about 11 m; from about 7 m to about 8 m; from about 7.6 m to about 9.2 m; from about 8 m to about 9 m; from about 9 m to about 10 m; from about 9.1 m to about 10.7 m; from about 10 m to about 11 m; from about 10 m to about 14.5 m; from about 10.6 m to about 12.2 m; from about 10.6 m to about 13.8 m; from about 11 m to about 12 m; from about 12 m to about 13 m; from about 12.1 m to about 13.8 m; from about 13 m to about 13.5 m; from about 13.5 m to about 14 m; or from about 14 m to about 14.5 m.

The particulars described herein are by way of example and are only for purposes of illustrative discussion of embodiments of the present disclosure. The use of any and all examples, or exemplary language (e.g., "such as") provided herein is merely intended to better illuminate the disclosure and does not pose a limitation on the scope of the disclosure as claimed. No language in the specification should be construed as indicating any non-claimed element is essential to the practice of the disclosure. Further, all methods described herein can be performed in any suitable order unless otherwise indicated herein or otherwise clearly contradicted by context.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including U.S. Provisional Patent Application No. 62/664,042 filed Apr. 27, 2018, and U.S. Provisional Patent Application No. 62/689,038 filed Jun. 22, 2018, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

Definitions used in the present disclosure are meant and intended to be controlling in any future construction unless clearly and unambiguously modified in the examples or when application of the meaning renders any construction meaningless or essentially meaningless. In cases where the construction of the term would render it meaningless or essentially meaningless, the definition should be taken from Webster's Dictionary, 3rd Edition or a dictionary known to those of ordinary skill in the art.

Although the subject matter has been described in language specific to structural features or methodological acts, it is to be understood that the subject matter defined in the appended claims is not necessarily limited to the specific features or acts described. Rather, the specific features and acts are disclosed as illustrative forms of implementing the claims.

What is claimed is:

1. An apparatus comprising:

at least one support structure configured to support a plurality of workpieces around a rotational axis, each workpiece of the plurality of workpieces having a substantially cylindrical shape with an outer surface and a longitudinal axis, and each workpiece of the plurality of workpieces having a hollow cavity defined by an inner surface;

a drive assembly configured to rotate the plurality of workpieces around the rotational axis, and a contact point assembly configured to enable electrical contact with the plurality of workpieces, wherein the contact point assembly comprises a plurality of contacts comprising a series of peripheral rods, wherein an individual peripheral rod of the series of peripheral rods is configured to be positioned within the hollow cavity of at least one workpiece of the plurality of workpieces substantially along the longitudinal axis of the at least one workpiece of the plurality of workpieces or an axis substantially parallel to the longitudinal axis of the at least one workpiece of the plurality of workpieces, wherein each of the contacts of the plurality of contacts comprises a threaded portion configured to couple to a threaded portion of an individual workpiece of the plurality of workpieces.

2. The apparatus of claim 1, wherein the contact point assembly is configured to rotate each workpiece of the plurality of workpieces around its respective longitudinal axis.

3. The apparatus of claim 1, wherein the drive assembly comprises a central rod aligned along the rotational axis.

4. The apparatus of claim 1, further comprising a motor coupled to the drive assembly and configured to provide rotational motion to the drive assembly; and wherein the drive assembly further comprises a gear configured to transfer motion from the motor to rotate the plurality of workpieces around the rotational axis.

5. The apparatus of claim 1, further comprising a conductive bus supported by the at least one support structure, the conductive bus configured to be in electrical contact with the plurality of workpieces via the contact point assembly, such that the plurality of workpieces are free to rotate around the rotational axis while maintaining electrical contact with the conductive bus.

6. The apparatus of claim 5, wherein the conductive bus is configured to maintain electrical contact with the inner surface of an individual workpiece of the plurality of workpieces.

7. A system comprising:

a plurality of workpieces around a rotational axis, each workpiece of the plurality of workpieces having a substantially cylindrical shape with an outer surface and a longitudinal axis; and an apparatus of claim 1.

8. The system of claim 7, further comprising:

a power supply; and a power supply controller that, in operation, controls a current density applied to the plurality of workpieces, wherein the current density varies over time.

9. The system of claim 8, further comprising an exterior anode electrically coupled to the power supply, wherein the exterior anode is positioned substantially parallel to the rotational axis at a substantially uniform distance from the rotational axis.

10. A method for producing a nanolaminate coating on a plurality of workpieces, the method comprising:

introducing the plurality of workpieces, each workpiece being substantially cylindrical, having a longitudinal axis, and having an outer surface, to a system of claim 7;

rotating the plurality of workpieces around a rotational axis at a rotational speed; and electrodepositing an electrodepositable species onto the plurality of workpieces as a first nanolaminate coating on at least a portion of the outer surface of each of the plurality of workpieces.

11. The method of claim 10, further comprising rotating each workpiece around the respective longitudinal axis at an individual rotational speed.

12. The method of claim 10, wherein the electrodepositing comprises applying a voltage or a current to a rod in contact with at least a portion of the plurality of workpieces, wherein the electrodepositing comprises varying the voltage or the current over time.

13. The method of claim 10, wherein introducing the plurality of workpieces comprises coupling individual workpieces of the plurality of workpieces together in series.

14. The method of claim 13, wherein introducing the plurality of workpieces comprises inserting a rod through an interior hollow cavity of a portion of the plurality of workpieces.

15. The method of claim 14, further comprising:

coupling the rod to a conductive bus; and positioning an exterior anode adjacent to the workpiece.

16. The apparatus of claim 1, wherein the contact point assembly is configured to rotate the plurality of workpieces around the rotational axis in a first direction and to rotate individual workpieces of the plurality of workpieces around its respective longitudinal axis in a second direction.

17. The apparatus of claim 1, wherein the contact point assembly comprises a first conductive article.

18. The apparatus of claim 17, wherein the first conductive article is configured to maintain physical contact with the inner surface of an individual workpiece of the plurality of workpieces.

19. The apparatus of claim 5, wherein the conductive bus is configured to maintain electrical contact with the outer surface of an individual workpiece of the plurality of workpieces.

* * * * *